US012331453B2

(12) United States Patent
Kim et al.

(10) Patent No.: US 12,331,453 B2
(45) Date of Patent: Jun. 17, 2025

(54) LAUNDRY TREATING APPARATUS

(71) Applicant: LG Electronics Inc., Seoul (KR)

(72) Inventors: Jongryul Kim, Seoul (KR); Eonhwa Hwang, Seoul (KR); Minseong Kim, Seoul (KR); Jeongwoo Kim, Seoul (KR); Jinhyouk Shin, Seoul (KR); Youngsoo Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 802 days.

(21) Appl. No.: 17/667,103

(22) Filed: Feb. 8, 2022

(65) Prior Publication Data

US 2022/0251773 A1 Aug. 11, 2022

(30) Foreign Application Priority Data

Feb. 8, 2021 (KR) ..... 10-2021-0017345

(51) Int. Cl.

| | |
|---|---|
| ***D06F 58/26*** | (2006.01) |
| ***D06F 58/08*** | (2006.01) |
| ***D06F 58/24*** | (2006.01) |
| ***D06F 103/32*** | (2020.01) |

(52) U.S. Cl.

CPC ..... *D06F 58/26* (2013.01); *D06F 58/08* (2013.01); *D06F 58/24* (2013.01); *D06F 2103/32* (2020.02)

(58) Field of Classification Search

None

See application file for complete search history.

(56) References Cited

U.S. PATENT DOCUMENTS 3,362,082 A * 1/1968 Hawkins ..... D06F 34/08 34/527
3,439,431 A * 4/1969 Heidtmann ..... D06F 58/266 219/709

(Continued)

FOREIGN PATENT DOCUMENTS

CN 1782207 6/2006
CN 101404426 4/2009

(Continued)

OTHER PUBLICATIONS

Extended European Search Report in European Appln. No. 22155566.7, dated Jul. 11, 2022, 8 pages.

(Continued)

*Primary Examiner* — David J Laux
(74) *Attorney, Agent, or Firm* — Fish & Richardson P.C.

(57) ABSTRACT

A laundry treating apparatus includes a cabinet having a bottom plate that defines a bottom surface of the cabinet, a drum rotatably disposed inside the cabinet and configured to accommodate laundry, a hot air supply disposed at the bottom plate and configured to generate hot air to be supplied into the drum, a rear plate that defines a rear surface of the cabinet and includes a duct configured to receive the hot air from the hot air supply and to guide the hot air into the drum, a driver coupled to a rear side of the rear plate and configured to provide a rotational force to the drum, and a fan duct that is coupled to a front side of the rear plate and connects the hot air supply to the duct. The fan duct is configured to transfer the hot air of the hot air supply to the duct.

20 Claims, 22 Drawing Sheets

(56) References Cited

U.S. PATENT DOCUMENTS

| | | | | |
|---|---|---|---|---|
| 3,536,308 | A * | 10/1970 | White | D06F 58/263 432/44 |
| 3,558,110 | A * | 1/1971 | Kushner | D06F 58/50 431/74 |
| 4,338,730 | A * | 7/1982 | Tatsumi | D06F 58/20 34/86 |
| 5,072,526 | A * | 12/1991 | Hirota | D06F 58/203 34/60 |
| 2003/0097764 | A1* | 5/2003 | St. Louis | D06F 34/10 34/526 |
| 2005/0034491 | A1* | 2/2005 | Tazawa | D06F 33/32 68/12.03 |
| 2005/0229650 | A1* | 10/2005 | Kim | D06F 58/26 68/23.2 |
| 2005/0278974 | A1* | 12/2005 | Chung | D06F 58/46 34/562 |
| 2015/0089832 | A1* | 4/2015 | Kang | D06F 29/005 34/499 |
| 2015/0247279 | A1* | 9/2015 | Bison | D06F 58/22 34/82 |
| 2017/0002508 | A1 | 1/2017 | Nam et al. | |
| 2017/0260683 | A1* | 9/2017 | Simon | D06F 58/50 |
| 2019/0249355 | A1 | 8/2019 | Hong | |
| 2019/0264377 | A1* | 8/2019 | Choi | D06F 58/06 |
| 2020/0063330 | A1* | 2/2020 | Kim | D06F 58/10 |
| 2020/0149213 | A1* | 5/2020 | Yoo | D06F 58/08 |

FOREIGN PATENT DOCUMENTS

| | | |
|---|---|---|
| CN | 209227256 | 8/2019 |
| CN | 110387727 | 10/2019 |
| CN | 112088231 | 12/2020 |
| EP | 2631353 | 8/2013 |
| EP | 2843116 | 3/2015 |
| EP | 2990521 | 3/2016 |
| JP | H06-114196 | 4/1994 |
| KR | 20140145431 | 12/2014 |
| KR | 10-2015-0040561 | 4/2015 |
| KR | 20160106265 | 9/2016 |
| KR | 20190121656 | 10/2019 |
| KR | 20190128468 | 11/2019 |
| KR | 10-2020-0065931 | 6/2020 |
| KR | 20200075667 | 6/2020 |
| WO | WO2019216631 | 11/2019 |
| WO | WO2019223850 | 11/2019 |

OTHER PUBLICATIONS

International Search Report and Written Opinion in International Appln. No. PCT/KR2022/001911, dated May 27, 2022, 9 pages.

Office Action in Chinese Appln. No. 202210118018.6, mailed on Mar. 25, 2023,13 pages(with English translation).

Office Action in Taiwanese Appln. No.111104564, mailed on Apr. 27, 2023, 15 pages(with English translation).

Notice of Allowance in Chinese Appln. No. 202210118018.6, mailed on May 8, 2024, 14 pages (with English translation).

Office Action in Australian Appln. No. 2022216171, mailed on Aug. 12, 2024, 5 pages.

* cited by examiner

LAUNDRY TREATING APPARATUS

CROSS-REFERENCE TO RELATED APPLICATIONS

This application claims the benefit of Korean Patent Application No. 10-2021-0017345, filed on Feb. 8, 2021, which is hereby incorporated by reference as if fully set forth herein.

TECHNICAL FIELD

The present disclosure relates to a laundry treating apparatus, and more particularly, to a laundry treating apparatus including a driver directly connected to a drum for accommodating laundry to rotate the drum.

BACKGROUND

A laundry treating apparatus may include a washing machine for washing laundry (an object to be washed or an object to be dried), a dryer for drying the laundry, and an apparatus capable of performing both the washing and the drying of the laundry.

For example, the washing machine may include a tub in which water is stored, a washing drum disposed inside the tub to store the laundry therein, and a driver (washing driver) that rotates the washing drum. The dryer may include a drying drum in which the laundry is stored, a driver (drying driver) that rotates the drying drum, a heat exchanger for removing moisture from the laundry by supplying hot air to the drying drum, and a hot air flow channel through which the hot air flows.

In some cases, the washing driver may be fixed to the tub. For the washing or dehydration of the laundry, the washing driver may control the number of rotations of the washing drum high or change a rotation direction of the washing drum. In some cases, the washing driver may be directly connected to the washing drum to control the number of rotations and the rotation direction of the washing drum.

In some cases, the drying driver may include a motor, a pulley fixed to a rotation shaft of the motor, and a power transmitter such as a belt connecting a rotational motion of the pulley to the drying drum.

For instance, the drying driver may have a structure connected to the drying drum through the power transmitter such as the belt. Specifically, the drying driver may be fixed to a base supporting a lower portion of the laundry treating apparatus, and may rotate the drying drum through the belt. The dryer may rotate the drying drum through the power transmitter such as the belt dryer since the number of rotations of the drying drum may be low or a rotation direction of the drying drum may not be changed.

In some examples, the number of rotations and the rotation direction of the drying drum may be changed such that a movement of the laundry inside the drying drum may be controlled, which may help reduce a drying time and improve a drying performance.

In some examples, where the dryer do not include a tub of a washing machine, structural design to fix the driver may be an important factor. In addition, when the driver is coupled to a rear surface of the drying drum, a structural design of the dryer to guide the hot air to the rear surface of the drying drum may be an important factor.

In some cases, the dryer may include a connector for connecting a component for guiding the hot air to the rear surface of the drying drum with the hot air flow channel. In order to help prevent leakage of the hot air and increase a drying efficiency, an arrangement and a shape of the connector may be one of important design factors.

In some cases, when a pressure inside the drying drum increases during a drying process, circulation of the hot air through an interior of the drying drum and an interior of the hot air flow channel may not be smooth. In some cases, when the interior of the drying drum has a pressure equal to or higher than a certain pressure, lint and water vapor inside the drying drum may leak to the outside of the drying drum.

The lint leaked to the outside of the drying drum may deteriorate a hygiene condition inside the dryer. In addition, the water vapor leaking to the outside of the drying drum may be condensed to form dew condensation inside the dryer. The formed dew condensation may deteriorate the hygiene condition inside the dryer and cause an operation error or a malfunction of another component located inside the dryer. Accordingly, it is an important task to adjust the pressure inside the drying drum during the drying process to improve the drying efficiency and help prevent the leakage of the lint and the water vapor.

SUMMARY

The present disclosure describes a laundry treating apparatus including a reducer fixed to a rear plate and a motor fixed to and supported by the reducer.

The present disclosure also describes a laundry treating apparatus that can efficiently supply hot air into a drum through a duct of a rear plate.

The present disclosure further describes a laundry treating apparatus that can efficiently guide hot air to a duct by connecting the duct and a hot air supply to each other through a fan duct.

The present disclosure further describes a laundry treating apparatus that can improve a drying efficiency through a bypass hole defined in a fan duct and reduce or prevent lint and water vapor from leaking to the outside of a drum.

The present disclosure further describes a laundry treating apparatus that can adjust a pressure inside a drum by adjusting an opening degree of a bypass hole.

The present disclosure further describes a laundry treating apparatus that can improve a drying efficiency by varying an opening degree of a bypass hole for each drying operation and that can help prevent lint and water vapor from leaking to the outside of a drum.

In some implementations, a laundry treating apparatus can include a motor for providing power to rotate a drum and a reducer for converting the power of the motor are coupled to each other.

The motor can be supported by being directly coupled to the reducer, and can be supported by being coupled only to the reducer. As such, the reducer itself can be a vibration reference of the motor. In addition, the reducer can be coupled to a rear plate to receive a strong supporting force.

In addition, the rear plate can have a duct to efficiently guide hot air introduced from a hot air supply into the drum through a rear surface of the drum. The fan duct can be disposed to form a portion of a circumference of the duct, so that hot air of the hot air supply can be efficiently guided to the duct.

In some implementations, the fan duct can have a bypass hole defined therein to discharge a portion of hot air flowing inside the fan duct to the outside. In addition, an opening degree of the bypass hole can be adjusted by an opening adjusting portion. The opening degree of the bypass hole can be adjusted for each drying operation to improve a drying efficiency and to prevent leakage of lint and water vapor to the outside of the drum.

According to one aspect of the subject matter described in this application, a laundry treating apparatus includes a cabinet having a bottom plate that defines a bottom surface of the cabinet, a drum rotatably disposed inside the cabinet and configured to accommodate laundry, a hot air supply disposed at the bottom plate and configured to generate hot air to be supplied into the drum, a rear plate that defines a rear surface of the cabinet and includes a duct configured to receive the hot air from the hot air supply and to guide the hot air into the drum, a driver coupled to a rear side of the rear plate and configured to provide a rotational force to the drum, and a fan duct that is coupled to a front side of the rear plate and connects the hot air supply to the duct. The fan duct is configured to transfer the hot air of the hot air supply to the duct.

Implementations according to this aspect can include one or more of the following features. For example, the duct can include a flow portion having an inner space that is recessed rearward from a front surface of the rear plate facing the drum and has an open front surface, where the inner space of the flow portion is configured to receive the hot air from the fan duct and configured to guide the hot air to the drum through the open front surface. The duct can include an inflow portion that extends from the flow portion and is connected to the fan duct. In some examples, the inflow portion can have an open front surface and be recessed rearward from the front surface of the rear plate to thereby define a space that accommodates at least a portion of the fan duct.

In some implementations, the inflow portion can accommodate at least the portion of the fan duct and a rear end of the hot air supply. In some examples, the hot air supply can include a blower fan configured to flow the hot air along the fan duct and a blower fan driver configured to provide power to the blower fan, where the inflow portion accommodates at least a portion of the blower fan driver. In some examples, the flow portion can include a flow outer circumferential portion that defines an outer circumferential surface of the inner space of the flow portion, where at least a portion of the fan duct can be accommodated inside the inflow portion and extend along a portion of the outer circumferential surface of the inner space of the flow portion.

In some examples, the fan duct can include a fan duct body having a first end that is connected to the hot air supply and a second end that is at least partially accommodated inside the inflow portion, where the second end extends along the outer circumferential surface of the inner space of the flow portion, and where the second end of the fan duct body is opened toward the flow portion and configured to discharge the hot air to the flow portion. In some examples, the flow portion and the inflow portion of the duct can be in fluid communication with each other, and the fan duct can include a fan duct shielding portion disposed at the second end of the fan duct body. The fan duct shielding portion can be inserted into the inflow portion and divide the flow portion and the inflow portion from each other.

In some implementations, the fan duct shielding portion can define one continuous surface with the flow outer circumferential portion, where the one continuous surface surrounds the inner space of the flow portion. In some examples, the fan duct can include a fan duct coupling portion disposed at an end of the fan duct shielding portion and coupled to the rear plate, where the fan duct coupling portion extends along a circumferential direction of the flow portion. In some examples, the rear plate can define a fan duct accommodating portion that extends from the inflow portion along the circumferential direction of the flow portion and seats the fan duct coupling portion, the fan duct coupling portion being coupled to a front side of the fan duct accommodating portion.

In some implementations, the laundry treating apparatus can further include a sealer disposed between the rear plate and the drum and configured to block leakage of the hot air, where the sealer can have an annular shape extending along an outer circumference of the flow portion. The fan duct can include a coupling guider that protrudes forward from the fan duct coupling portion and supports a portion of the sealer.

In some implementations, the flow portion can include a flow inner circumferential portion that defines an inner circumference of the inner space of the flow portion, where a portion of the flow inner circumferential portion protrudes toward the second end of the fan duct body is configured to guide the hot air from the fan duct body in a plurality of directions.

In some implementations, the fan duct can define a bypass hole that passes through an outer surface of the fan duct and is configured to discharge a portion of the hot air from an inside of the fan duct to an outside of the fan duct. In some examples, the fan duct can include an opening adjusting portion configured to adjust an opening degree of the bypass hole. In some implementations, the laundry treating apparatus can further include a controller configured to control the opening adjusting portion to adjust the opening degree of the bypass hole based on an amount of the laundry accommodated inside the drum.

In some examples, the opening adjusting portion can be configured to (i) adjust the opening degree of the bypass hole to a first opening degree in a main drying process in which a moisture evaporation amount from the laundry is greater than or equal to a preset amount, and (ii) adjust the opening degree of the bypass hole to a second opening degree in an amount decreasing drying process that is configured to decrease the moisture evaporation amount from the laundry to be less than the preset amount, where the first opening degree is greater than the second opening degree.

In some implementations, the laundry treating apparatus can include a temperature sensor disposed in the cabinet and configured to measure a temperature of the hot air discharged from the drum to the hot air supply, and a controller configured to, in a drying operation, control the opening adjusting portion to adjust the opening degree of the bypass hole. The controller can be configured to, based on the temperature being less than a first reference temperature, determine that a current process is a preheating process of the drying operation in which a moisture evaporation amount from the laundry increases and the opening degree of the bypass hole in the preheating process is a preheat opening degree. The controller can be configured to, based on the temperature being greater than or equal to the first reference temperature and less than or equal to a second reference temperature, determine that the current process is a main drying process in which the moisture evaporation amount from the laundry is greater than or equal to a preset amount. The controller can be configured to, based on determining that the current process is the main drying process of the drying operation, control the opening adjusting portion to increase the opening degree of the bypass hole to a first opening degree that is greater than the preheat opening degree. The controller can be configured to, based on the temperature exceeding the second reference temperature, determine that the current process is an amount decreasing drying process of the drying operation that is configured to decrease the moisture evaporation amount from the laundry to be less than the preset amount. The controller can be configured to, based on determining that the current process is the amount decreasing drying process, control the opening adjusting portion to decrease the opening degree of the bypass hole to a second opening degree that is less than the first opening degree.

In some implementations, the hot air supply can include a blower fan configured to flow the hot air along the fan duct, where the laundry treating apparatus can include a controller configured to control the hot air supply to reduce a rotation speed of the blower fan while the opening degree of the bypass hole is increased.

In some examples, the bypass hole can include an open hole that remains open and is spaced apart from the opening adjusting portion and an adjusted hole that is configured to be covered by the opening adjusting portion to thereby vary the opening degree. In some examples, the opening adjusting portion can include an opening and closing portion that is configured to open and close at least a portion of the bypass hole and an opening degree adjusting driver connected to the opening and closing portion and configured to provide a driving force to the opening and closing portion, where the fan duct can include an adjusting support that supports the opening degree adjusting driver and fixes the opening degree adjusting driver to the fan duct.

In some implementations, the drum can have a drum inlet that is defined at a rear surface of the drum facing the rear plate and is in fluid communication with the flow portion and configured to receive the hot air from the open front surface of the flow portion. In some examples, the flow portion can include a recessed surface that faces the drum inlet and is disposed rearward relative to the open front surface of the flow portion, where the duct can include a flow guider that protrudes from the recessed surface toward the drum inlet and be configured to guide the hot air toward the drum inlet.

In some implementations, the rear plate can include a mounting portion disposed at the rear side of the rear plate and coupled to the driver, and at least a portion of the duct can have an annular shape extending rearward from the rear plate and surrounding the mounting portion.

In some implementations, an electrode sensor for measuring an amount of moisture in contact with the laundry can be disposed inside the drum. The controller can determine that the current process is the amount decreasing drying process when the measured value of the temperature sensor exceeds the second reference temperature and a measured value of the electrode sensor is equal to or higher than a reference electrode value.

In some implementations, the rotation shafts of the motor providing the rotation power can rotate the drum while the reducer converts the revolutions per minute (RPM) of the motor and the torque of the rotation power. In some implementations, the reducer and the motor can tilt at the same time or vibrate at the same time. In some implementations, the reducer can be coupled to the rear plate to provide the strong supporting force.

In some implementations, the hot air can be efficiently supplied into the drum through the duct. In some implementations, the fan duct can efficiently guide the hot air flowing out of the hot air supply to the duct. In some implementations, through the bypass hole, the drying efficiency can be improved and the lint and the water vapor can be prevented from leaking to the outside of the drum. In some implementations, the opening degree of the bypass hole can be adjusted based on the drying operation, so that the efficient drying can proceed based on the situation.

DETAILED DESCRIPTION

Hereinafter, one or more implementations of the present disclosure will be described in detail with reference to the accompanying drawings.

Figure 1:
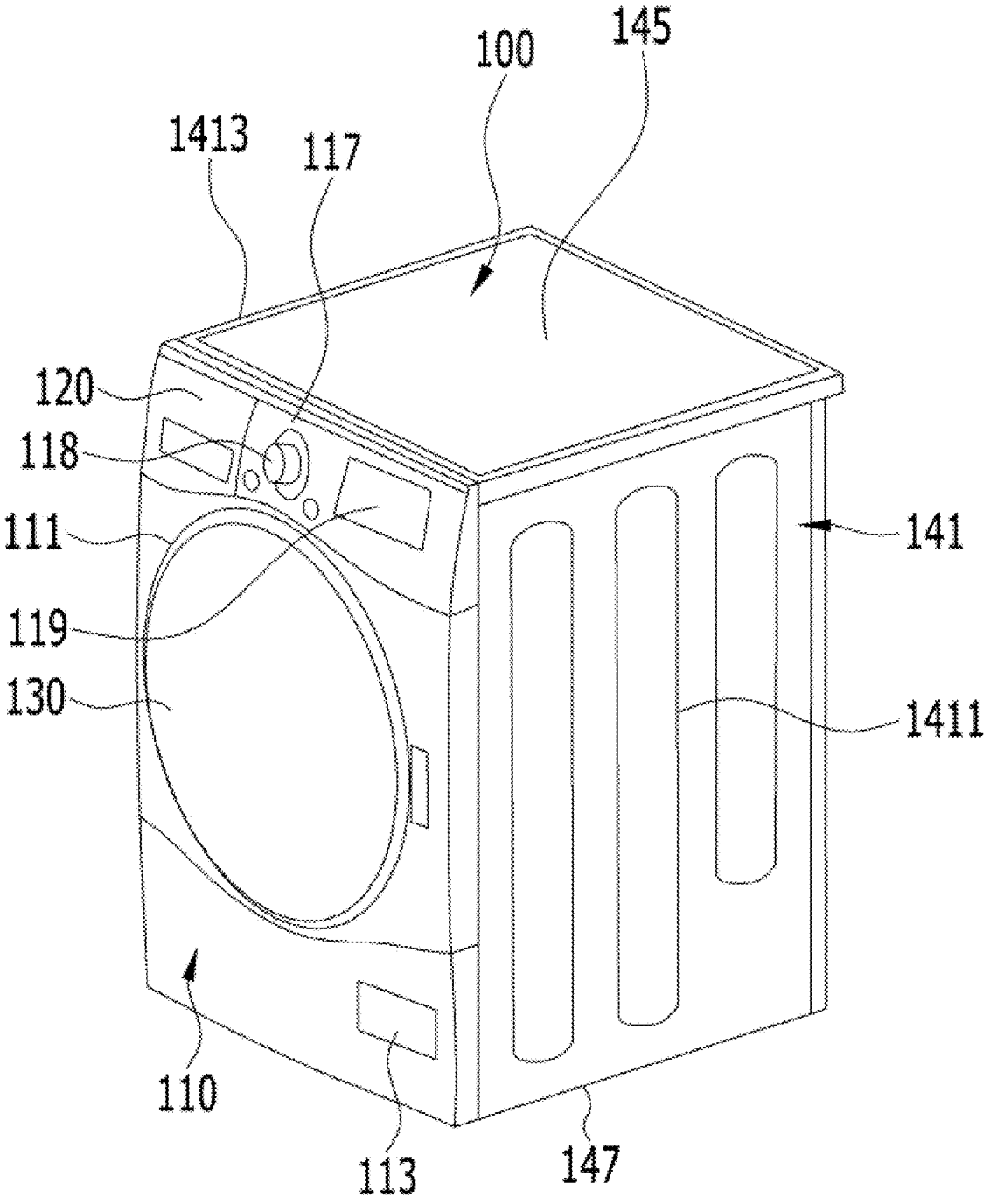
FIG. 1 is a perspective view showing an example of a laundry treating apparatus.
Figure 2:
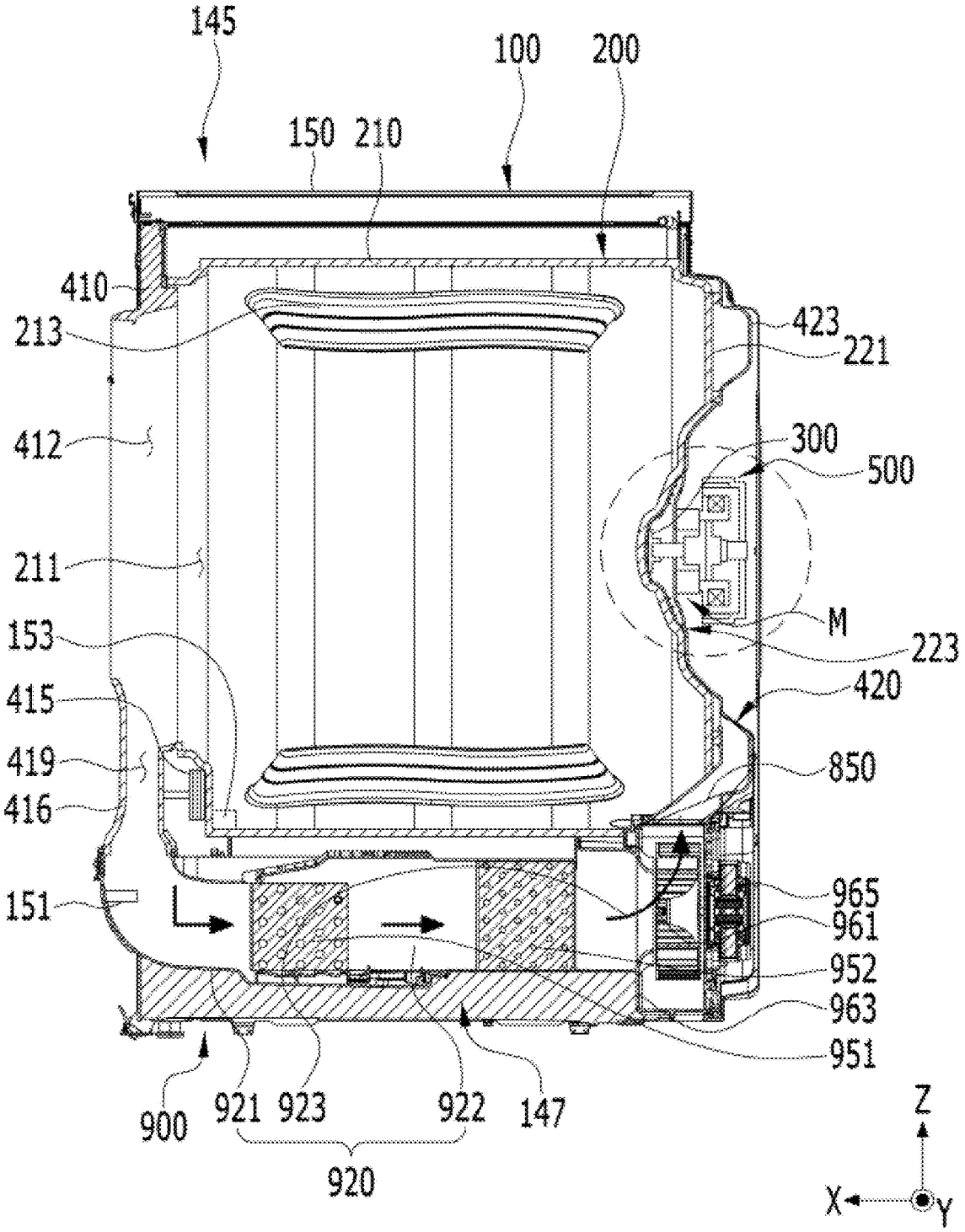
FIG. 2 is a view showing an internal cross-section of the laundry treating apparatus shown in FIG. 1.

FIG. 1 is a perspective view showing an example of a laundry treating apparatus, and FIG. 2 is a view showing an internal cross-section of the laundry treating apparatus shown in FIG. 1.

Referring to FIGS. 1 and 2, the laundry treating apparatus can include a cabinet 100 that constitutes an appearance of the laundry treating apparatus.

In some implementations, the cabinet 100 can have a front plate 410 forming a front surface thereof, side plates 141 respectively forming both side surfaces thereof, a top plate 145 forming a top surface thereof, and a bottom plate 147 forming a bottom surface thereof.

In some examples, the front plate 410, the side plates 141, the top plate 145, and the bottom plate 147 can be connected to each other to define a space in the cabinet 100. In addition, the cabinet 100 can further include a rear plate 420 forming a rear surface thereof, and the rear plate 420 can be coupled to the cabinet 100 from the rear to shield the interior of the cabinet 100.

That is, the rear plate 420 can form the rear surface of the cabinet 100. In some examples, referring to FIG. 15, a rear cover 430, which will be described later, can be coupled to the rear plate 420 from the rear, and the rear cover 430 can form the rear surface of the cabinet 100. In addition, the rear cover 430 and the rear plate 420 together can form the rear surface of the cabinet.

As the interior of the cabinet 100 can be shielded from the outside because of the rear plate 420, a drum 200, a hot air supply 900, a water collector 170, and the like can be disposed inside the cabinet 100, and the components disposed inside the cabinet 100 can be prevented from being exposed to the outside.

The front plate 410 and the rear plate 420 will be described later in detail.

In some implementations, the cabinet 100 can further include a front panel 110 coupled to the front plate 410 from the front. The front panel 110 can be coupled to a front surface of the front plate 410 to prevent the front plate 410 and components coupled to the front plate 410 from being exposed to the outside.

That is, the front panel 110 can form the front surface of the cabinet 100 together with the front plate 410. The front panel 110 can be formed integrally with or formed separately from the front plate 410. In FIGS. 1 and 2, the front panel 110 and the front plate 410 are illustrated as being separately formed, but the present disclosure should not be construed as being limited thereto.

The front panel 110 can include an inflow portion 111 defined to be in communication with the drum 200 to be described later and a door 130 pivotably coupled to the cabinet to open and close the inflow portion 111.

In some implementations, a control panel 117 can be installed on the front panel 110. The control panel 117 can include an input device 118 for receiving a control command from a user, and a display 119 for outputting information such as a control command or the like selectable by the user. The control command can include a drying course or a drying option capable of performing a series of drying operations. The control panel 117 can include a main controller for controlling a command for performing the drying course or the drying option.

The input device 118 can include a power supply requesting device that requests power supply of the laundry treating apparatus, a course input device that allows the user to select a course among a number of courses, and an execution requesting device that requests start of the course selected by the user.

The display 119 can include at least one of a display panel capable of outputting text and figures, and a speaker capable of outputting a voice signal and sound.

In some implementations, the laundry treating apparatus can include a water storage 7 constructed to separately store moisture generated in a process of drying laundry. The water storage 7 can include a water storage tank that is constructed to be withdrawn from one side of the front panel 110 to the outside. The water storage tank can be constructed to collect condensed water received from a drain pump to be described later.

The user can remove the condensed water by withdrawing the water storage tank from the cabinet 100 and then re-install the water storage tank in the cabinet 100. Accordingly, the laundry treating apparatus can be disposed at any place where a sewer or the like is not installed.

In some implementations, the water storage 7 can be disposed above the door 130. Accordingly, when the user withdraws the water storage tank from the front panel 110, the user may bend a waist relatively less.

The laundry treating apparatus can further include a filter member capable of removing foreign substances from a circulation flow channel. The front panel 110 can include a filter mounting hole 113 defined such that the filter member is withdrawn or inserted.

Figure 3:
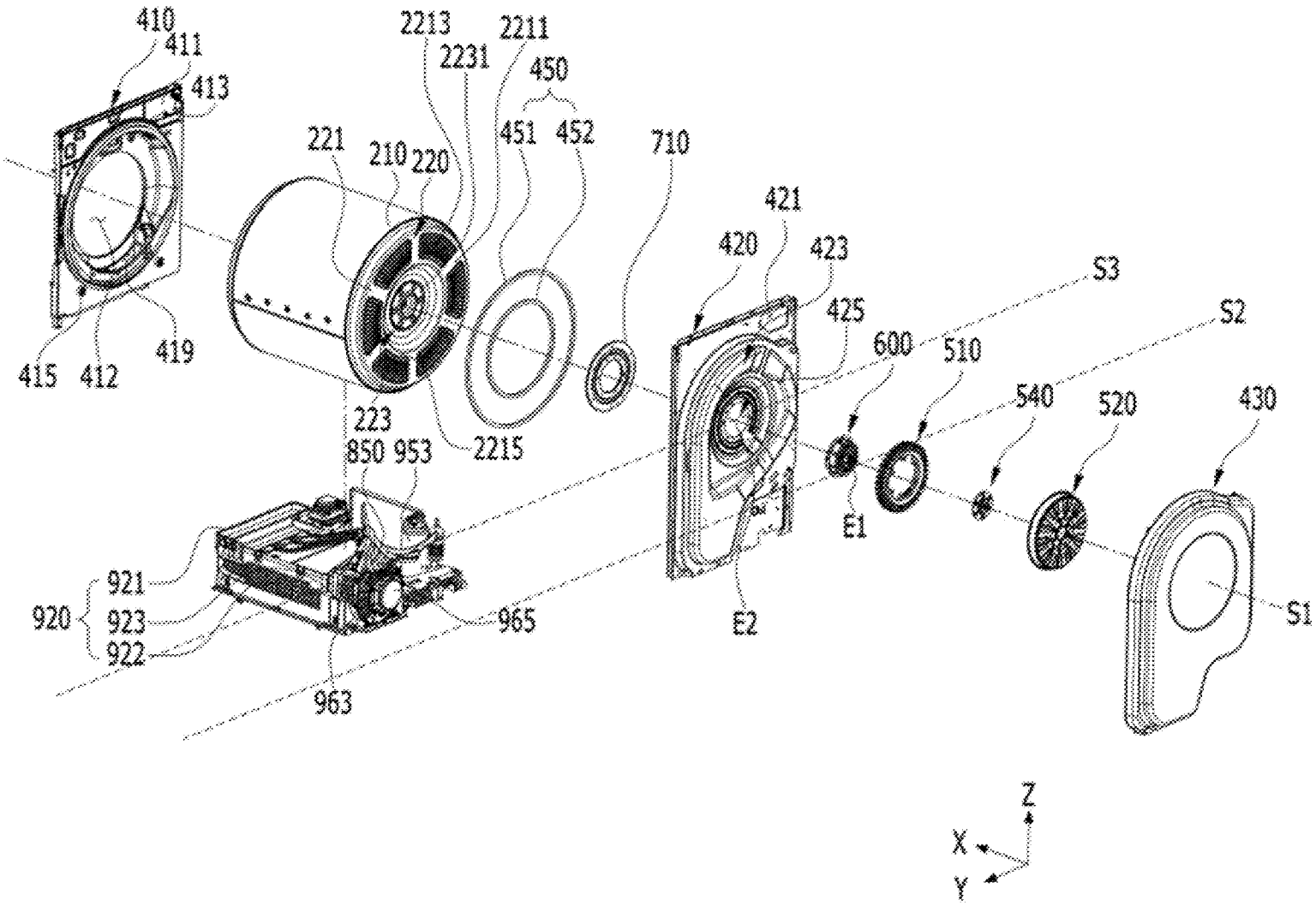
FIG. 3 is an exploded perspective view of the laundry treating apparatus.

FIG. 3 is an exploded perspective view of a laundry treating apparatus.

Referring to FIGS. 2 and 3, the laundry treating apparatus can include the drum 200 accommodated inside the cabinet 100 and accommodating the laundry therein, a driver M that rotates the drum 200, and the hot air supply 900 constructed to supply hot air to the drum 200.

The drum 200 can be formed in a cylindrical shape to accommodate the laundry therein. In some examples, where water is not supplied to the drum 200 and the water condensed inside the drum 200 is not discharged to the outside, a through-hole defined along a circumference of the drum 200 can be omitted.

The driver M can be in direct connection with the drum 200 to rotate the drum 200. For example, the driver M can be formed in a direct drive unit (DD) type. Accordingly, the driver M can control a rotation direction of the drum 200 or a rotation speed of the drum 200 by directly rotating the drum 200 by omitting a component such as a belt, a pulley, and the like.

In the case of the DD type washing machine, the driver M can be coupled and fixed to a tub that accommodates the drum 200 therein, and the drum 200 can be coupled to the driver M and supported by the tub. However, because the laundry treating apparatus is constructed to intensively perform a drying operation, the tub fixed to the cabinet 100 to accommodate the drum 200 is omitted.

Accordingly, the laundry treating apparatus can further include a support 400 constructed to fix or support the drum 200 or the driver M inside the cabinet 100. The support 400 can include the front plate 410 and the rear plate 420 described above.

The front plate 410 can be disposed in front of the drum 200, and the rear plate 420 can be disposed at the rear of the drum 200.

The front plate 410 and the rear plate 420 can be formed in a plate shape and respectively disposed to face a front surface and a rear surface of the drum 200. A distance between the front plate 410 and the rear plate 420 can be the same as a length of the drum 200 or can be set to be greater than the length of the drum 200.

The drum 200 can include a drum inlet 211 having an open front surface. The drum inlet 211 can be in communication with the inflow portion 111 defined in the front panel 110 through the front plate 410. The driver M can be installed on the rear plate 420 and connected to the rear surface of the drum 200 as the drum inlet 211 is defined in the front surface of the drum 200.

The rear plate 420 can be constructed such that the driver M is mounted and supported thereon in a region facing the rear surface of the drum 200. Accordingly, the driver M can rotate the drum 200 in a state in which a position thereof is stably fixed through the rear plate 420.

At least one of the front plate 410 and the rear plate 420 can rotatably support the drum 200. At least one of the front plate 410 and the rear plate 420 can rotatably accommodate a front end or a rear end of the drum 200 therein.

For example, the front surface of the drum 200 can be accommodated and rotatably supported in the front plate 410, and the rear surface of the drum 200 can be indirectly supported by the rear plate 420 by being spaced apart from the rear plate 420 and connected to the driver M mounted on the rear plate 420.

Accordingly, a region in which the drum 200 is in contact with or rubbed against the support 400 can be minimized and noise or vibration can be reduced or prevented from occurring.

In some implementations, the drum 200 can be rotatably supported by both the front plate 410 and the rear plate 420.

In some implementations, the laundry treating apparatus can include the circulation flow channel along which, based on the drum 200, air inside the drum 200 is discharged through the front surface of the drum 200, and the discharged air passes through an exterior of the drum 200 and again flows into the rear surface of the drum 200.

The hot air supply 900 can be disposed outside the drum such that the air discharged from the interior of the drum 200 flows therein, and can define a portion of the circulation flow channel. For example, the hot air supply 900 can be placed on the bottom plate 147 of the cabinet 100.

The hot air supply 900 can include an evaporator 951 for cooling the air discharged from the interior of the drum 200 and condensing water vapor contained in the air, and a condenser 952 for heating the air that has passed through the evaporator 951. The hot air supply 900 can be constructed to supply the air that has passed through the condenser 952 back into the drum 200.

The air discharged from the interior of the drum 200 can change in a temperature and a water vapor content by the hot air supply 900, and can dry the laundry accommodated in the drum 200 through continuous circulation by flowing along the circulation flow channel.

The air located inside the drum 200 can be hot air circulating along the circulation flow channel. That is, the air whose properties are changed by the hot air supply 900 and circulating along the circulation flow channel can be referred to as the hot air. The air and the hot air can be used as the same meaning hereinafter for convenience of description. A specific configuration of the hot air supply 900 will be described later.

The drum 200 can be disposed above the hot air supply 900, so that the drum inlet 211 of the drum 200 can be disposed at a relatively high position inside the cabinet 100. The user can easily withdraw the laundry located inside the drum 200.

As described above, the hot air supply 900 can have a plurality of heat exchangers installed therein for cooling or heating the hot air flowing therein, and can have a washer 940 installed therein for removing foreign substances attached to the heat exchanger using the condensed water in which the water vapor contained in the hot air is condensed.

Referring back to FIGS. 2 and 3, the drum 200 of the laundry treating apparatus can be rotated by being directly coupled to the driver M rather than being rotated by being indirectly coupled to a belt or the like. Therefore, unlike the drum of the conventional dryer formed in a cylindrical shape with open front and rear surfaces, the drum 200 of the laundry treating apparatus can have the shielded rear surface and be directly coupled to the driver M.

Specifically, the drum 200 can include a drum body 210 formed in a cylindrical shape to accommodate the laundry therein, and a drum rear surface 220 coupled to the drum body 210 from the rear to form the rear surface of the drum 200. That is, the drum rear surface 220 can refer to the rear surface of the drum 200.

The drum rear surface 220 can be constructed to shield the drum body 210 from the rear and can be coupled to a drum rotating shaft 650 of the driver M. That is, the drum rear surface 220 can be constructed so as to be connected to the driver M to receive power from the drum rotating shaft 650 to rotate the drum body 210. As a result, the drum inlet 211 into which the laundry is put can be defined in front of the drum body 210 and the drum body 210 can be shielded by the drum rear surface 220 from the rear.

FIG. 2 schematically shows a bushing. Referring back to FIG. 2, a bushing 300 can be coupled to or formed integrally with the drum rear surface 220. The drum rotating shaft 650 of the driver M can be coupled to the bushing 300, and the drum rear surface 220 can be coupled to the drum rotating shaft 650 through the bushing 300. The drum rotating shaft 650 can be coupled to the drum rear surface 220 from the rear through the bushing 300, or can penetrate the drum rear surface 220 through the bushing 300 such that a front end thereof is positioned inside the drum 200.

When the drum rotating shaft 650 penetrates the drum 200, the front end of the drum rotating shaft 650 can be coupled to fixing fastening means for fixing the drum rotating shaft 650 in an axial direction. In addition, a cap for preventing contact between the drum rotating shaft 650 and the laundry, and suppressing heat transfer can be installed inside the drum 200.

As a result, the drum 200 of the laundry treating apparatus may not be rotated by the belt or the like, but can be rotated as the drum rear surface 220 is directly coupled to the driver M.

Therefore, even when the driver M changes the rotation direction or a rotation acceleration is large, the drum 200 of the laundry treating apparatus can be rotated by reflecting the same immediately.

In some implementations, the front plate 410 can include an inflow portion communication hole 412 penetrating the front plate 410 to accommodate a front portion of the drum body 210 or the drum inlet 211 therein. A gasket 413 for accommodating the drum body 210 can be disposed on an outer circumferential surface of the inflow portion communication hole 412.

The gasket 413 can rotatably support the drum inlet 211 of the drum body 210 and can be in contact with an outer circumferential surface of the drum inlet 211. The gasket 413 can prevent the hot air inside the drum 200 from leaking between the drum body 210 and the front plate 410.

The gasket 413 can be made of a plastic resin or an elastic material, and a separate sealing member can be additionally coupled to an inner circumferential surface of the gasket 413 to prevent the laundry or the hot air from escaping the drum inlet 211 of the drum body 210 to the front plate 410.

In some implementations, a duct communication hole 419 in communication with the drum body 210 such that the hot air injected into the drum body 210 can be discharged can be defined in the inner circumferential surface of the gasket 413 or the inflow portion communication hole 412. A front flow channel connecting the duct communication hole 419 and the hot air supply 900 to each other can be installed in the front plate 410.

Accordingly, the duct communication hole 419 can guide the hot air discharged from the drum body 210 to be supplied to the hot air supply 900.

The filter member that blocks foreign substances, lint, or the like discharged from the drum 200 from being put to the hot air supply 900 as described above can be installed in the front flow channel.

A front wheel 415 constructed to be in contact with an outer circumferential surface of the drum body 210 to rotatably support the drum 200 can be installed on the front plate 410. The front wheel 415 can be constructed to support an outer circumferential surface of an inflow portion of the drum body 210, and can include a plurality of front wheels spaced apart from each other along the outer circumferential surface of the inflow portion communication hole 412. The front wheel 415 can rotate together when the drum 200 rotates while supporting a lower portion of the drum body 210.

The front plate 410 can include a front tank support hole 414, and the water storage tank of the water storage 7 can be inserted into and supported by the front tank support hole 414. The front tank support hole 414 can be defined in a region corresponding to a portion of the front panel 110 where the water storage 7 is disposed, and can be defined through the front plate 410.

The rear plate 420 can include a rear tank support hole 421 defined at a position corresponding to the front tank support hole 414. The water storage tank can be supported by being inserted into the front tank support hole 411 and the rear tank support hole 421 together. The rear tank support hole 421 can be defined through the rear plate 420.

Referring back to FIG. 2, as described above, the hot air supply 900 can define a portion of the circulation flow channel that circulates the hot air to the drum 200. That is, the hot air supply 900 can include a hot air flow channel 920 through which the hot air discharged from the drum 200 can circulate outside the drum 200.

The hot air flow channel 920 can be formed in a shape of a duct disposed outside the drum 200. The hot air flow channel 920 can include a supply duct 921 in communication with the duct communication hole 419 to be supplied with the hot air of the drum 200, a flow duct 922 through which the hot air supplied from the supply duct 921 flows, and a discharge duct 923 through which the hot air that has passed through the flow duct 922 is discharged.

The supply duct 921 can be formed to be in communication with the duct communication hole 419 of the front plate 410 to be in communication with the front flow channel installed inside the front plate 410. The flow duct 922 can extend from a distal end of the supply duct 921 rearwardly of the drum 200. The discharge duct 923 can be disposed at a distal end of the flow duct 922.

In some implementations, the hot air supply 900 can include a heat pump 950 that can cool the hot air to remove the water vapor contained in the hot air and re-heat the hot air from which the water vapor has been removed.

The heat pump 950 can include the evaporator 951 that is installed inside the flow duct 922 to cool the hot air to condense the water vapor contained in the hot air, and the condenser 952 that is disposed downstream of the evaporator 951 or disposed to be spaced apart from the evaporator 951 toward the discharge duct 923 and re-heats the hot air.

The heat pump 950 can further include an expansion valve that cools a refrigerant that has passed through the condenser 952 and guides the cooled refrigerant back to the evaporator 951, and a compressor 953 that pressurizes and heats the refrigerant that has passed through the evaporator 951 and supplies the pressurized and heated refrigerant to the condenser 952. The compressor 953 can be disposed outside the flow duct 922. That is, the plurality of heat exchangers described above installed inside the hot air supply 900 can mean the evaporator 951 and the condenser 952.

In some implementations, the hot air supply 900 can further include a blower 960 capable of providing power to circulate the hot air to the drum 200.

The blower 960 can be connected to the hot air flow channel 920. That is, the blower 960 can be connected to the discharge duct 923 from the rear, and can receive the hot air from the discharge duct 923, accelerate the hot air, and guide the hot air to the rear of the drum 200.

The blower 960 can include a blower fan 961 that accelerates the hot air in contact with the hot air, and a blower fan housing 963 connected to the discharge duct 923 and having the blower fan 961 disposed therein.

One side of the blower fan housing 963 can be opened and connected to the discharge duct 923, and the other side thereof can be opened to guide the hot air to the rear of the drum 200. For example, as shown in FIG. 2, the blower fan housing 963 can have an open front surface to be connected to the discharge duct 923, and can have an open top surface to guide the hot air to the rear of the drum 200.

In addition, the blower 960 can further include a blower fan driver 965 coupled to the blower fan housing 963. The blower fan driver 965 can be coupled to the blower fan housing 963 from the rear and connected to the blower fan 961 to provide power to rotate the blower fan 961.

Figure 4:
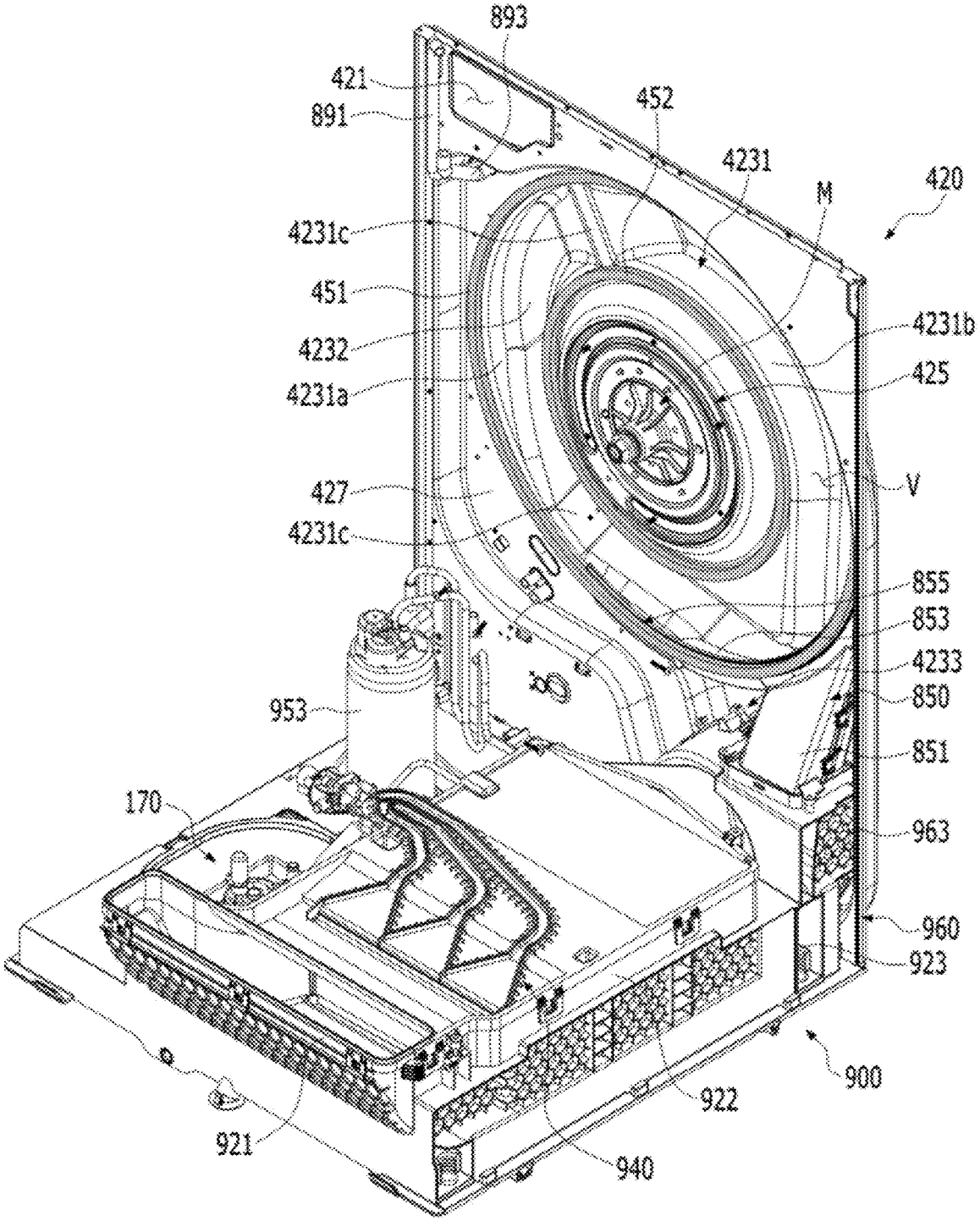
FIG. 4 is a view showing examples of a bottom plate and a rear plate.

In some implementations, FIG. 4 is a view showing a bottom plate and a rear plate.

Referring to FIG. 4, a space efficiency of the bottom plate 147 of the cabinet 100 can be increased as the driver M is disposed on the rear plate 420.

Specifically, the bottom plate 147 of the cabinet 100 can have the hot air supply 900 and other components. Other components can include the water collector 170 and the driver M. Other components may not be limited to the water collector 170 and the driver M, and can include any component that can be disposed on the bottom plate 147.

As described above, the hot air supply 900 can include the hot air flow channel 920, the evaporator 951 and the condenser 952 disposed inside the hot air flow channel 920, the compressor 953 disposed outside the hot air flow channel 920, and the blower 960 connected to the hot air flow channel 920.

On the bottom plate 147 of the cabinet 100, the hot air flow channel 920 in which the hot air flows and the blower 960 can be integrally disposed, or the hot air flow channel 920 and the blower 960 can be spaced apart from each other, so that the water collector 170 and the driver M can be disposed.

The space utilization efficiency of the bottom plate 147 of the cabinet 100 can be increased as the driver M is disposed on the rear plate 420 compared to the case in which the driver M is disposed on the bottom plate 147 of the cabinet 100.

That is, the bottom plate 147 of the cabinet 100 can increase a size of the existing component and make an arrangement of existing components to be efficient by utilizing the position where the driver M is disposed compared to the case in which the driver M is disposed on the bottom plate 147 of the cabinet 100.

For example, the water collector 170 can be disposed at the position where the driver M is disposed or extended to the position where the driver M is disposed compared to the case in which the driver M is disposed on the bottom plate 147 of the cabinet 100. That is, the water collector 170 can be larger than in the case in which the driver M is disposed on the bottom plate 147 of the cabinet 100, thereby storing relatively more condensed water.

In some implementations, referring to FIGS. 2 and 4, the water collector 170 can be disposed in parallel with the evaporator 951 along a lateral direction. In addition, the compressor 953 can be disposed in parallel with the condenser 952 in the lateral direction.

Specifically, the hot air flow channel 920 can extend from the front plate 410 toward the rear plate 420, and can be disposed close to one of the side plates 141 of the cabinet 100.

For example, FIG. 4 shows that the hot air flow channel 920 is disposed close to a first side plate 1411. However, the present disclosure may not be limited thereto, and the hot air flow channel 920 can be disposed close to a second side plate 1413. For convenience of description, the hot air flow channel 920 will be described as being disposed close to the first side plate 1411.

The water collector 170 and the compressor 953 can be disposed outside the hot air flow channel 920, and can be disposed close to the second side plate 1413 as the hot air flow channel 920 extends in a front and rear direction and is disposed close to the first side plate 1411.

The evaporator 951 and the condenser 952 can be disposed spaced apart from each other inside the hot air flow channel 920, and the water collector 170 can be disposed in parallel with the evaporator 951 to minimize a distance at which the condensed water is introduced from the evaporator 951. In addition, the compressor 953 can be disposed in parallel with the condenser 952 to minimize a distance at which the compressed refrigerant is supplied to the condenser 952.

FIG. 4 shows that, as the hot air is discharged from the front of the drum 200, the evaporator 951 is disposed forwardly of the condenser 952, and the water collector 170 is disposed forwardly of the compressor 953. However, the present disclosure may not be limited thereto, and an arrangement of the evaporator 951 and the condenser 952 can be changed depending on the direction in which the hot air is discharged from the drum 200, and an arrangement of the water collector 170 and the compressor 9530 can also be changed responding thereto.

In some implementations, referring back to FIG. 4, the rear plate 420 can include a duct 423.

The duct 423 can receive the hot air from the hot air supply 900 and guide the hot air into the drum 200.

The duct 423 can be recessed rearwards from one surface of the rear plate 420. As described above, the rear plate 420 can be located at the rear of the drum 200. The duct 423 can be recessed from one surface of the rear plate 420 to be away from the drum 200, and one surface of the rear plate 420 can be a front surface of the rear plate 420.

The duct 423 can be recessed rearwards from the front surface of the rear plate 420. That is, the duct 423 can have a flow space V through which the hot air can flow therein, and can have an open front surface.

From another point of view, the duct 423 can protrude rearwards from a rear surface of the rear plate 420, a front surface of the rearwardly protruding portion can be opened, and the flow space V can be defined as much as the portion protruding rearwards. In the flow space V, the hot air introduced from the hot air supply 900 can flow, and the hot air can be guided into the drum 200 from the rear of the drum 200.

Specifically, as the hot air is continuously supplied from the hot air supply 900 to the flow space V, the hot air can be diffused throughout the flow space V. As the hot air diffused throughout the flow space V flows into the drum 200 through the open front surface of the duct 423, an area in which the hot air is introduced can be maximized. Accordingly, the duct 423 can allow the hot air to be efficiently guided into the drum 200 through the flow space V.

In addition, in the duct 423, at least a portion of a fan duct 850 for connecting the hot air supply 900 and the duct 423 to each other can be disposed. The fan duct 850 can provide the hot air of the hot air supply 900 to the duct 423 by communicating the hot air supply 900 and the duct 423 to each other. A portion of the fan duct 850 can be inserted into the flow space V, and the fan duct 850 can be in contact with the duct 423 to receive a supporting force from the duct 423. The fan duct 850 will be described later in detail.

Further, a portion of the hot air supply 900 can be disposed in the duct 423. The portion of the hot air supply 900 can be a rear end of the hot air supply 900 as the duct 423 is defined in the rear plate 420, and specifically can be a portion of the blower 960 described above. The portion of the blower 960 can be inserted into the flow space V, and can be in contact with the duct 423 to receive the supporting force from the duct 423.

Figures 5A, 5B, 5C:
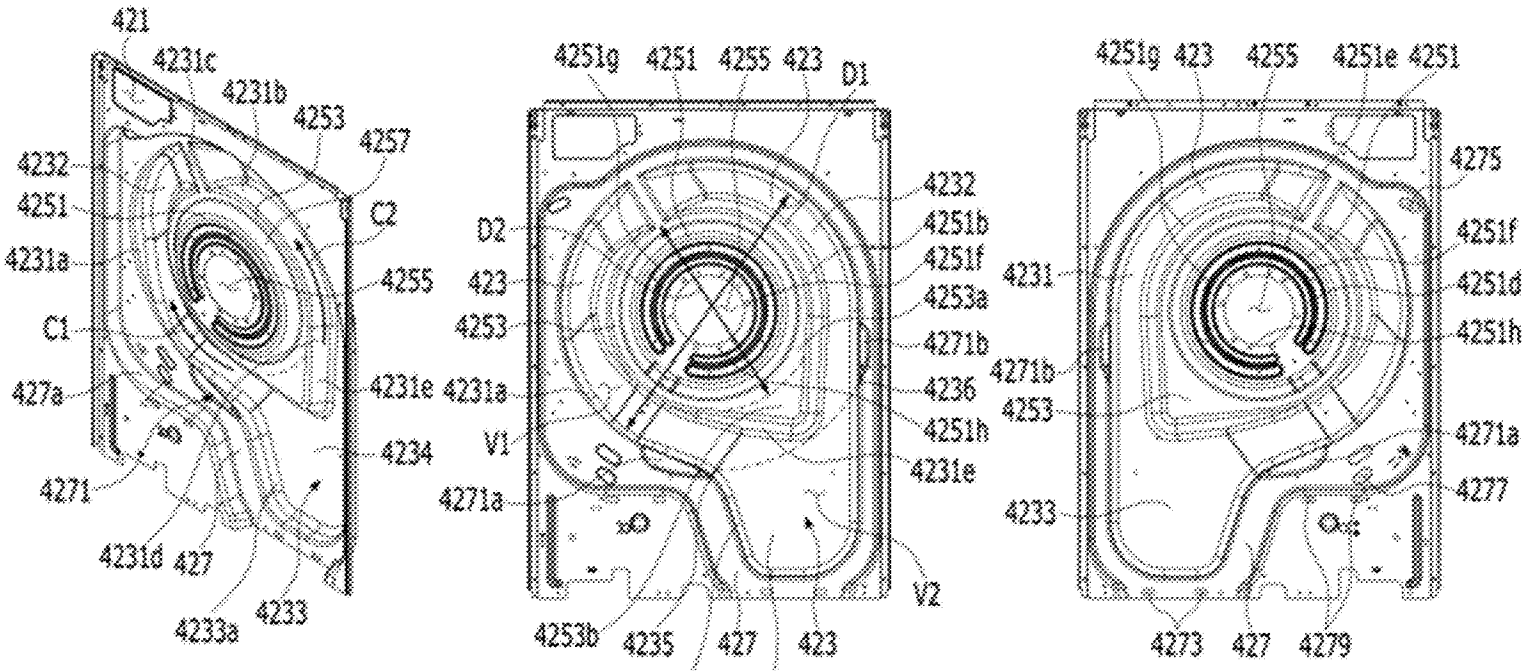
FIGS. 5A to 5C are views showing the rear plate.

In some implementations, FIGS. 5A to 5C are views showing an example of a rear plate of a laundry treating apparatus. Specifically, FIG. 5A is a perspective view of the rear plate, FIG. 5B is a front view of the rear plate, and FIG. 5C is a rear view of the rear plate.

Referring to FIG. 5A, the duct 423 can include a flow portion 4231.

The flow portion 4231 can guide the hot air introduced from the hot air supply 900 into the drum 200 through the drum rear surface 220 of the drum 200.

The flow portion 4231 can be recessed rearwards from one surface of the rear plate 420 facing the drum rear surface 220. That is, the flow portion 4231 can have a first flow space V1 defined therein through which the hot air can flow, and can have an open front surface. One surface of the rear plate 420 can be the front surface of the rear plate 420, and the aforementioned flow space V can include the first flow space V1.

In the flow portion 4231, the hot air introduced from the fan duct 850 flows in the first flow space V1, and the hot air flowing in the first flow space V1 can be guided into the drum 200 through the drum rear surface 220.

The flow portion 4231 can be formed in an annular shape. The above-mentioned annular shape can be understood that an extended shape forms a closed curve. Accordingly, the annular shape can be defined as a closed cross-section surrounded by the closed curve.

Specifically, the flow portion 4231 can include a flow outer circumferential portion 4231*a* for surrounding the first flow space V1 in which the hot air flows from the outside. That is, the flow outer circumferential portion 4231*a* can correspond to an outer circumferential surface of the flow portion 4231 in the state in which the flow portion 4231 protrudes rearwards.

The flow portion 4231 can include a flow inner circumferential portion 4231*b* surrounding the first flow space V1 in which the hot air flows from the inside. That is, the flow outer circumferential portion 4231*a* can correspond to an inner circumferential surface of the flow portion 4231 in the state in which the flow portion 4231 protrudes rearwards.

In addition, the flow portion 4231 can include a flow recessed surface 4232 connecting the flow outer circumferential portion 4231*a* and the flow inner circumferential portion 4231*b* to each other. The flow recessed surface 4232 can correspond to one surface facing the drum rear surface 220.

The flow outer circumferential portion 4231*a* can be a portion extending rearwards from the front surface of the rear plate 420. Based on a radial direction of the flow portion 4231, the flow inner circumferential portion 4231*b* can be located inwardly of the flow outer circumferential portion 4231*a*, and can be a portion extending rearwards from the front surface of the rear plate 420. The flow recessed surface 4232 can be curved or extend parallel to the front surface of the rear plate 420, and can connect the flow outer circumferential portion 4231*a* and the flow inner circumferential portion 4231*b* to each other.

FIG. 5C shows the rear plate in FIGS. 5A and 5B viewed from the rear. Referring to FIG. 5C, the rear plate will be described as viewed from the rear.

The flow outer circumferential portion 4231*a* can be a portion protruding rearwards from the rear surface of the rear plate 420. The flow inner circumferential portion 4231*b* can be located inwardly of the flow outer circumferential portion 4231*a*, and can be a portion protruding rearwards from the rear surface of the rear plate 420. The flow recessed surface 4232 can be the portion connecting the flow outer circumferential portion 4231*a* and the flow inner circumferential portion 4231*b* to each other.

In some implementations, with reference to FIGS. 5A to 5C, the flow outer circumferential portion 4231*a* and the flow inner circumferential portion 4231*b* can be constructed such that boundary portions thereof with the front surface of the rear plate 420 is rounded. In addition, the flow outer circumferential portion 4231*a* and the flow inner circumferential portion 4231*b* can extend rearwards in parallel with each other, or can extend rearwards such that a distance therebetween decreases rearwardly. In FIG. 5, the flow outer circumferential portion 4231*a* and the flow inner circumferential portion 4231*b* are shown to be closer to each other rearwardly, but the present disclosure is not limited thereto. Furthermore, the flow recessed surface 4232 can be constructed such that portions thereof connected to the flow outer circumferential portion 4231*a* and the flow inner circumferential portion 4231*b* are rounded.

When viewed from the front with reference to FIG. 5B, the flow outer circumferential portion 4231*a* and the flow inner circumferential portion 4231*b* can be formed in a generally circular shape. For example, when a diameter of the flow outer circumferential portion 4231*a* is D1 and a diameter of the flow inner circumferential portion 4231*b* is D2, D1 can be greater than D2. The flow recessed surface 4232 can be an annular surface having an outer diameter of D1 and an inner diameter of D2. An overall shape of the flow portion 4231 can be a donut shape.

Figure 22:
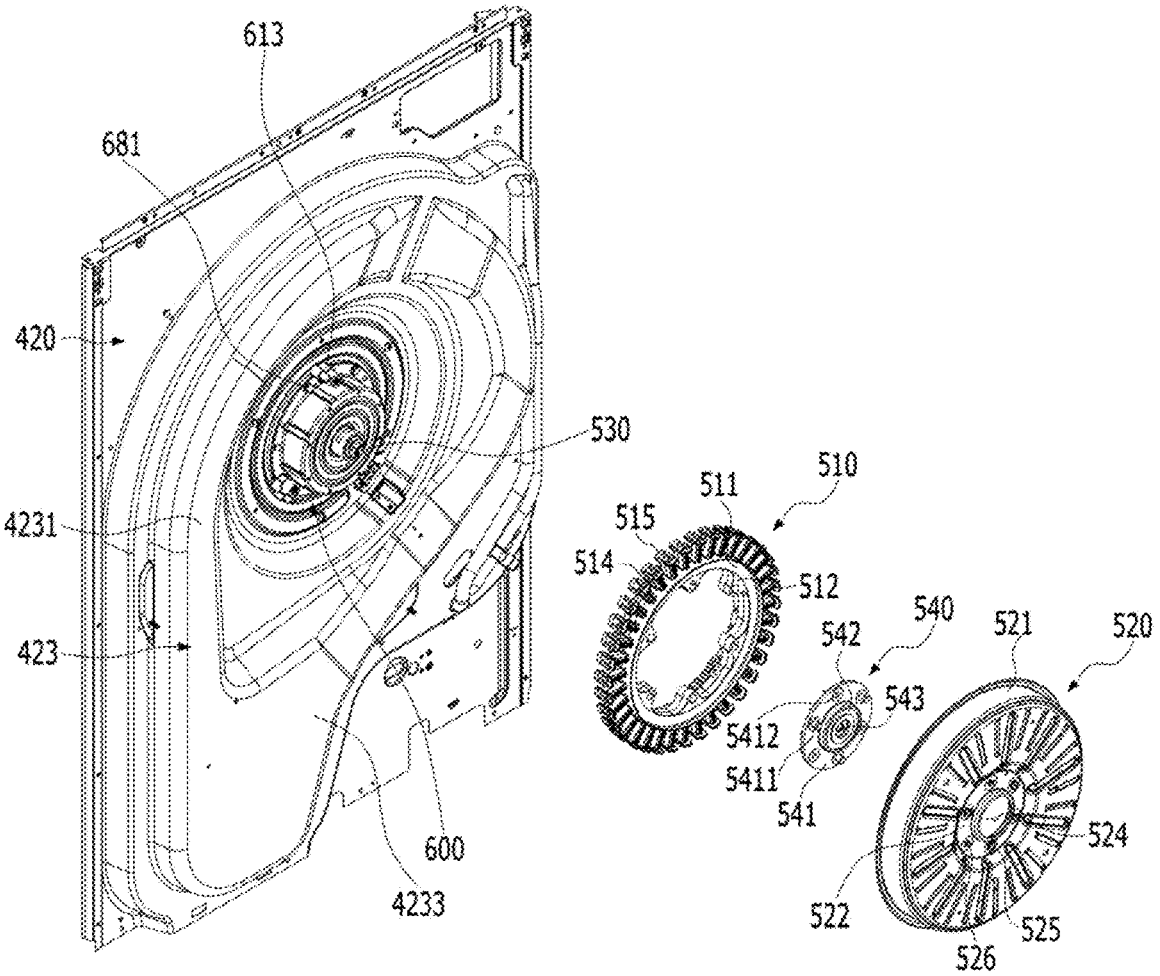
FIG. 22 is a view showing the motor separated from the reducer that is coupled to the rear plate.

Referring to FIG. 22 together, the driver M can be coupled to the rear surface of the rear plate 420 at a location inwardly of the flow inner circumferential portion 4231*b*. That is, the flow inner circumferential portion 4231*b* can be constructed to surround the driver M to protect the driver M from external impact.

Figure 6B:
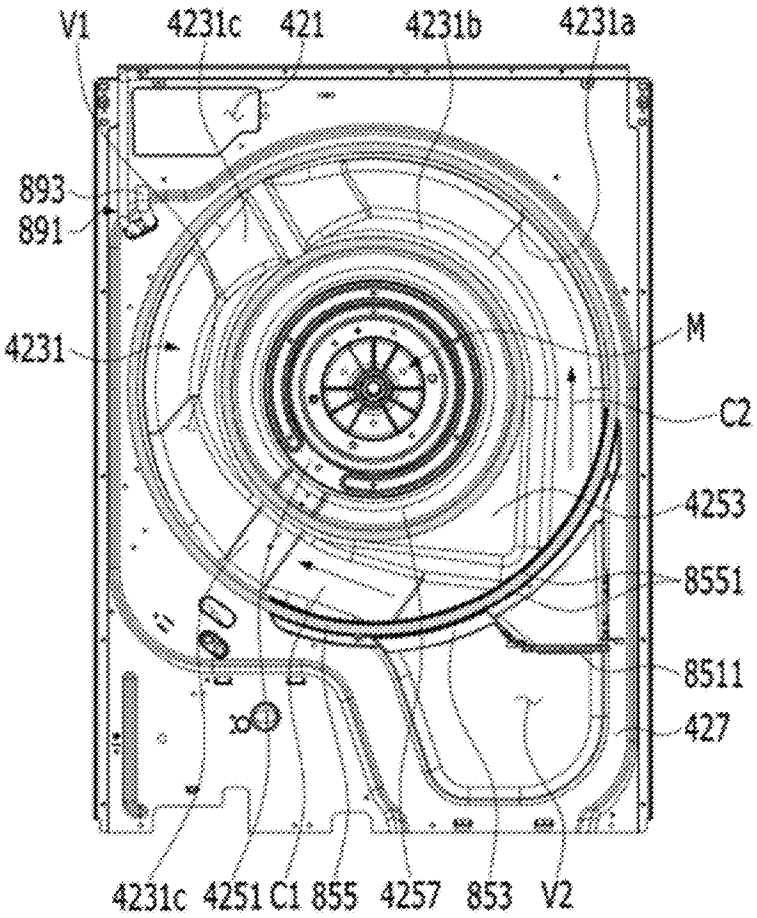
FIGS. 6A and 6B are views showing the rear plate and an example of a fan duct.
Figure 6A:
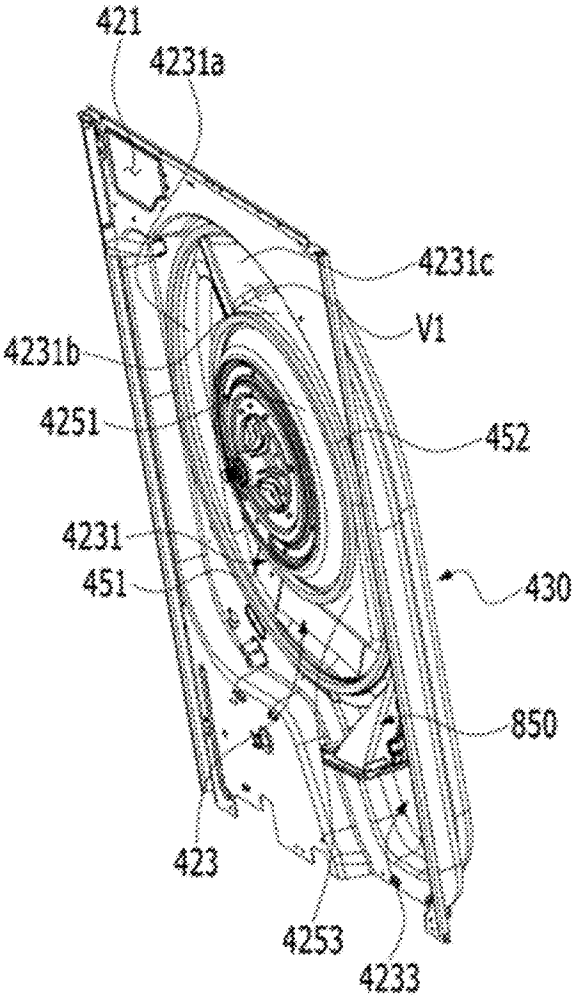

In some implementations, FIGS. 6A and 6B are views showing examples of a rear plate and a fan duct. Specifically, FIG. 6A is a perspective view of the rear plate to which the fan duct is coupled, and FIG. 6B is a front view of the rear plate to which the fan duct is coupled.

Referring to FIGS. 5A and 5B and FIGS. 6A and 6B, the duct 423 can further include an inflow portion 4233 in which the fan duct 850 can be disposed.

The inflow portion 4233 can extend in a shape protruding from the flow portion 4231. The inflow portion 4233 can extend from the flow portion 4231 in a radial direction of the flow portion 4231. The inflow portion 4233 can extend downwards from the flow portion 4231. The inflow portion 4233 can extend from the flow portion 4231 toward the fan duct 850 and can be in communication with the flow portion 4231.

The fan duct 850 can be disposed in the inflow portion 4233, and the inflow portion 4233 can receive the hot air from the fan duct 850 and guide the hot air to the flow portion 4231. In addition, the inflow portion 4233 can provide only an installation space for the fan duct 850 such that the flow portion 4231 can directly receive the hot air from the fan duct 850 without via the inflow portion 4233. FIG. 6 shows that the fan duct 850 is disposed in the inflow portion 4233 and directly supplies the hot air to the flow portion 4231, but the present disclosure is not construed as being limited thereto.

For example, as described above, the hot air supply 900 can be located below the drum 200, the flow portion 4231 can face the drum rear surface 220, and the fan duct 850 can guide the hot air from the hot air supply 900 to the flow portion 4231.

Accordingly, at least a portion of the fan duct 850 can be located below the flow portion 4231, and the inflow portion 4233 can extend downwards from the flow portion 4231 to provide the installation space for the fan duct 850. For example, the inflow portion 4233 can extend downwards from one side in the lateral direction of the flow portion 4231.

Specifically, the inflow portion 4233 can be recessed rearwards from one surface of the rear plate 420 facing the fan duct 850. That is, the inflow portion 4233 can be recessed to be away from the fan duct 850 from one surface of the rear plate 420 facing the fan duct 850. One surface of the rear plate 420 can be the front surface of the rear plate 420.

The inflow portion 4233 can have a second flow space V2 defined therein, and can have an open front surface. That is, the second flow space V2 can be the same as the installation space for the fan duct 850 described above, and can be in communication with the first flow space V1 to define the aforementioned flow space V together.

At least a portion of the fan duct 850 can be coupled by being inserted into the second flow space V2 of the inflow portion 4233. That is, the fan duct 850 can be supported by an inflow portion circumferential portion 4233*a* to be described later, and can be coupled to an inflow portion recessed surface 4234 to be described later to receive supporting and coupling forces. The inflow portion circumferential portion 4233*a* and the inflow portion recessed surface 4234 will be described in detail later.

In some implementations, in the inflow portion 4233, the fan duct 850 and the hot air supply 900 can be disposed together.

That is, the inflow portion 4233 can extend from the flow portion 4231 to have the fan duct 850 inserted thereinto, and can have a shape of further extending from the fan duct 850 toward the hot air supply 900.

Accordingly, the inflow portion 4233 can provide an installation space for the hot air supply 900 as well as the installation space for the fan duct 850 disposed between the hot air supply 900 and the flow portion 4231.

As described above, the hot air supply 900 can be disposed on the bottom plate 147 of the cabinet 100, and can be disposed close to the first side plate 1411. The inflow portion 4233 can extend downwards from the flow portion 4231, and can extend to be closer to the first side plate 1411 in a direction toward the bottom plate 147. That is, the inflow portion 4233 can extend from the flow portion 4231 toward the first side plate 1411.

Specifically, in the inflow portion 4233, one surface of the rear plate 420 facing the fan duct 850 and the hot air supply 900 can be recessed rearwards. That is, the inflow portion 4233 can be recessed away from the fan duct 850 and the hot air supply 900 from one surface of the rear plate 420 facing the fan duct 850 and the hot air supply 900. One surface of the rear plate 420 can be the front surface of the rear plate 420.

In other words, the second flow space V2 of the inflow portion 4233 described above can be additionally extended from the fan duct 850 to define the space in which the hot air supply 900 is disposed.

As the inflow portion 4233 is defined in the rear plate 420, a rear end of the hot air supply 900 can be disposed in the inflow portion 4233, and the rear end of the hot air supply 900 can be the blower 960 described above. As the blower 960 is disposed in the second flow space V2, the limited internal space of the cabinet 100 can be efficiently utilized.

For example, a length of the hot air flow channel 920 located in front of the blower 960 can be greater than that before utilizing the second flow space V2 of the inflow portion 4233, and sizes of the evaporator 951 and the condenser 952 disposed inside the hot air flow channel 920 can also be greater.

Specifically, in the inflow portion 4233, the blower fan driver 965 and the blower fan housing 963 of the blower 960 can be inserted into and disposed in the second flow space V2. For example, in FIG. 2, a portion of the blower fan driver 965 is illustrated as being inserted into the second flow space V2.

However, the present disclosure may not be limited thereto. An entirety of the blower fan driver 965 can be inserted into and disposed in the second flow space V2, and an entirety of the blower fan driver 965 and the blower fan housing 963 can be inserted into and disposed in the second flow space V2. In addition, the rear end of the hot air flow channel 920 can further be inserted into and disposed in the second flow space V2.

In some implementations, more specifically, the inflow portion 4233 can include the inflow portion circumferential portion 4233*a* and the inflow portion recessed surface 4234 that provide the supporting and coupling forces to the fan duct 850 and the hot air supply 900.

The second flow space V2 can have a shape extending from the first flow space V1, and the inflow portion circumferential portion 4233*a* can extend from the flow outer circumferential portion 4231*a* to form a circumference of the second flow space V2. That is, the flow outer circumferential portion 4231*a* and the inflow portion circumferential portion 4233*a* can together form a circumference of the duct 423.

The inflow portion circumferential portion 4233*a* can extend toward the hot air supply 900 from one side of the flow outer circumferential portion 4231*a*, and can be connected to the other side of the flow outer circumferential portion 4231*a* via a lower portion of the rear plate 420.

The first flow space V1 and the second flow space V2 can be in communication with each other as described above as one side and the other side of the flow outer circumferential portion 4231*a* are opened, and can define one flow space V.

That is, the flow outer circumferential portion 4231*a* can be formed in a shape of a partially open circle, that is, in a shape of an arc, rather than forming a perfect circle shape. The inflow portion circumferential portion 4233*a* can form a continuous circumference with the flow outer circumferential portion 4231*a* from one side to the other side of the flow outer circumferential portion 4231*a*.

In addition, the inflow portion recessed surface 4234 can connect opposite sides of the inflow portion circumferential portions 4233*a*. For example, the flow outer circumferential portion 4231*a* can extend in the shape of the arc, the inflow portion circumferential portion 4233*a* can extend to connect the both sides of the flow outer circumferential portion 4231*a* to each other, and the inflow portion recessed surface 4234 can extend from the flow recessed surface 4232 of the flow portion 4231 to connect the opposite sides of the inflow portion circumferential portions 4233*a* to each other.

That is, the inflow portion circumferential portion 4233*a* can surround a portion of the circumference of the inflow portion recessed surface 4232, and the inflow portion recessed surface 4234 can be connected to the flow recessed surface 4232 in a region excluding the inflow portion circumferential portion 4233*a*.

The inflow portion recessed surface 4234 can defined the second flow space V2 by shielding the inflow portion circumferential portions 4233*a*. That is, the inflow portion recessed surface 4234 can mean a recessed surface of the inflow portion 4233. One side and the other side of the flow outer circumferential portion 4231*a* connected to the inflow portion circumferential portion 4233*a* can be opened, so that the inflow portion recessed surface 4234 and the flow recessed surface 4232 can be connected to each other, and the inflow portion recessed surface 4234 and the flow recessed surface 4232 can form a continuous surface.

For example, as described above, the inflow portion 4233 can extend downwardly from the flow portion 4231 and can extend downwardly from a lower portion of the flow portion 4231. Further, the inflow portion 4233 can extend from a portion biased to one side in the lateral direction of the cabinet 100 of the flow portion 4231. That is, the inflow portion 4233 can extend downwards from one side in the lateral direction of the flow portion 4231.

The inflow portion 4233 can extend from the flow portion 4231 toward the bottom plate 147, and further, can extend to be closer to the first side plate 1411. One side of the flow outer circumferential portion 4231*a* can be located farther from the first side plate 1411 than the other side, and can be located closer to the bottom plate 147 of the cabinet 100.

The flow outer circumferential portion 4231*a* can form a 'q-shaped' circumference together with the inflow portion circumferential portion 4233*a*, and the inflow portion recessed surface 4234 can form a 'q-shaped' cross-section together with the flow recessed surface 4232.

As described above, the fan duct 850 and the blower fan driver 965 can be coupled to the inflow portion recessed surface 4234. As a coupling scheme, various schemes such as screw coupling, rivet coupling, fitting coupling, and the like can be used. In addition, the fan duct 850 and the blower fan driver 965 can be supported in contact with the inflow portion circumferential portion 4233*a*.

That is, the inflow portion 4233 can provide strong coupling and supporting forces to the fan duct 850 and the blower fan driver 965 through the inflow portion circumferential portion 4233*a* and the inflow portion recessed surface 4234.

In addition, the inflow portion circumferential portion 4233*a* can be constructed such that a portion thereof connected to the flow outer circumferential portion 4231*a*, a portion thereof connected to the front surface of the rear plate 420, and a portion thereof connected to the inflow portion recessed surface 4234 are rounded, so that injury can be prevented as much as possible even when the user is in contact with the inflow portion circumferential portion 4233*a*.

In some implementations, referring back to FIG. 5B, the flow portion 4231 and the inflow portion 4233 can be integrally formed. The inflow portion recessed surface 4234 can form one continuous surface of the duct 423 with the flow recessed surface 4232, and the flow outer circumferential portion 4231*a* can form a continuous circumference of the duct 423 of the same depth as the inflow portion circumferential portion 4233*a*. As the flow portion 4231 and the inflow portion 4233 are integrally manufactured, manufacturing convenience can be increased.

In addition, the rear plate 420 can be formed integrally with the duct 423. That is, the duct 423 can be defined by being recessed rearwards from the front surface of the rear plate 420. Accordingly, leakage of the hot air through a gap of a portion where the duct 423 and the rear plate 420 are coupled to each other that occurs when the duct 423 is separately formed and attached to the rear plate 420 can be prevented. In addition, convenience of manufacturing the rear plate 420 can be increased.

That is, as the inflow portion 4233 and the flow portion 4231 are integrally manufactured and the rear plate 420 and the duct 423 are integrally manufactured, the leakage can be prevented as much as possible in the rear plate 420.

In some implementations, referring back to FIGS. 2 and 3, the drum rear surface 220 can include a drum shielding portion 221 through which the hot air flows into the drum 200.

As described above, the drum rear surface 220 can face the flow portion 4231, and can receive the hot air from the flow portion 4231 and guide the hot air into the drum 200.

The drum shielding portion 221 can be disposed in front of the open front surface of the flow portion 4231. The drum shielding portion 221 can shield the open front surface of the flow portion 4231. That is, the drum shielding portion 221 can be disposed in front of the first flow space V1, and can shield the first flow space V1.

The drum shielding portion 221 can face the flow recessed surface 4232, and the hot air can flow between the drum shielding portion 221 and the flow recessed surface 4232. The drum shielding portion 221 can be formed in a shape corresponding to the flow portion 4231 to more easily receive the hot air from the flow portion 4231. That is, the drum shielding portion 221 can be formed in a donut shape.

In addition, the drum shielding portion 221 can include a drum inlet 2213 constructed such that the hot air can be introduced into the drum 200.

The drum inlet 2213 can be defined as a plurality of holes defined through the drum shielding portion 221 or can be defined as a net in a form of a mesh. In addition, a plurality of drum inlet 2213 can be defined to be spaced apart from each other in a circumferential direction of the drum shielding portion 221.

In addition, the drum shielding portion 221 can further include a reinforcing rib 2211 and a circumferential rib 2215 to secure structural rigidity.

The reinforcing rib 2211 can be disposed between the two adjacent drum inlets 2213 along the circumferential direction of the drum shielding portion 221, and the circumferential rib 2215 can include circumferential ribs 2215 disposed inwardly of the reinforcing rib 2211 and inwardly of the drum inlet 2213. The circumferential rib 2215 can be formed in an annular shape, and can be formed integrally with the reinforcing rib 2211.

In addition, the reinforcing rib 2211 and the circumferential rib 2215 can be disposed relatively rearward as the drum inlet 2213 protrudes frontwards from the drum shielding portion 221, or can protrude rearwards from the drum shielding portion 221.

Figure 7:
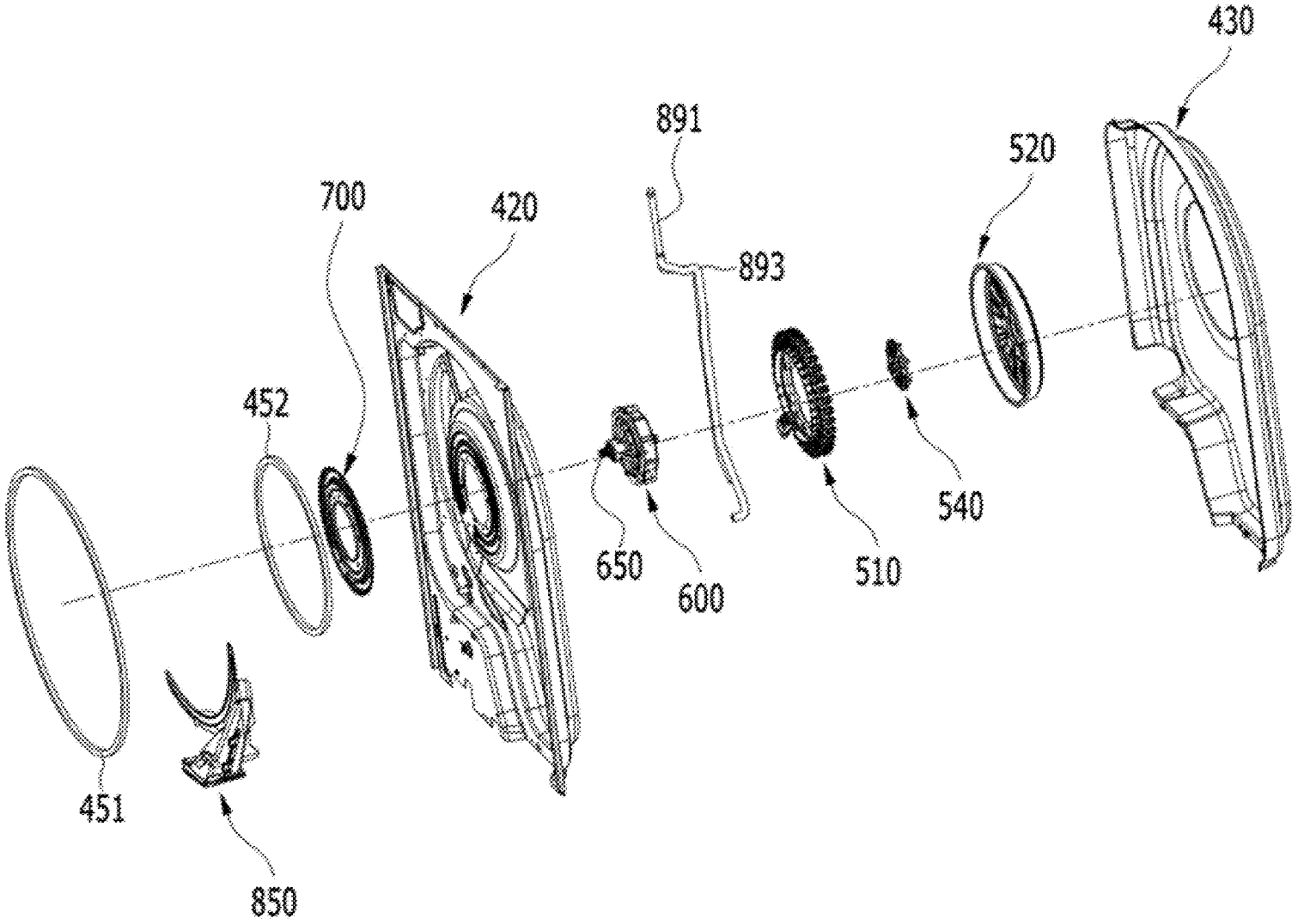
FIG. 7 is an exploded perspective view of the rear plate, the fan duct, and an example of a driver.
Figure 8:
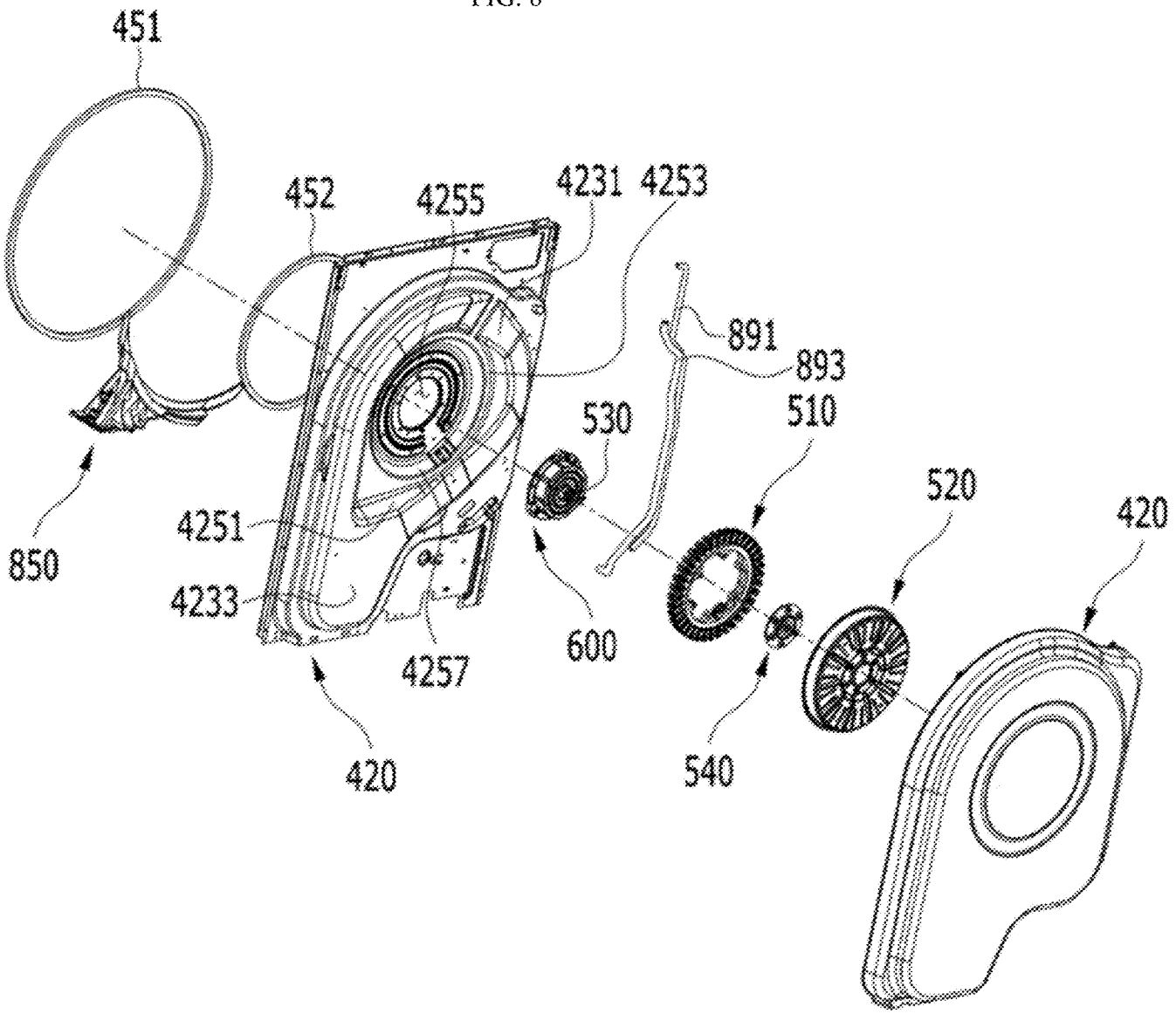
FIG. 8 is an exploded perspective view of the rear plate, the fan duct, and the driver shown in FIG. 7 viewed from another side.

In some implementations, FIG. 7 is an exploded perspective view of a rear plate, a fan duct, and a driver. FIG. 8 is an exploded perspective view of a rear plate, a fan duct, and a driver shown in FIG. 7 viewed from another side.

Referring to FIGS. 4 and 7 to 8, the laundry treating apparatus can include a sealer 450 for preventing the leakage of the hot air to the outside of the drum 200.

The sealer 450 can prevent the leakage of the hot air flowing through the first flow space V1 to the outside of the drum 200 through the space between the flow outer circumferential portion 4231*a* and the drum rear surface 220 resulted from the front surface of the flow portion 4231 being opened. In addition, the sealer 450 can prevent the hot air flowing through the first flow space V1 from leaking to the outside of the drum 200 through the space between the flow inner circumferential portion 4231*b* and the drum rear surface 220.

The sealer 450 can include a first sealer 451 disposed along an outer circumference of the flow portion 4231.

The first sealer 451 can be disposed between the front surface of the rear plate 420 and the drum shielding portion 221 of the drum rear surface 220. The first sealer 451 can be disposed between the drum shielding portion 221 and the flow portion 4231.

The first sealer 451 can be formed in a shape corresponding to the flow outer circumferential portion 4231*a*, and can be disposed outwardly of the flow outer circumferential portion 4231*a*. When the flow outer circumferential portion 4231*a* is formed in a circular shape, the first sealer 451 can be formed in an annular shape in which both inner and outer sides thereof are formed in a circular shape.

Referring to FIG. 6, when a diameter of the flow outer circumferential portion 4231*a* is D1, an outer diameter of the first sealer 451 can be greater than D1, and an inner diameter of the first sealer 451 can be equal to or greater than D1.

The first sealer 451 can be disposed at an outer edge of the drum shielding portion 221. The first sealer 451 can have an inner circumferential surface located outwardly of the drum inlet 2213. A thickness of the first sealer 451 can be greater than a rearwardly protruding length of the drum inlet 2213.

As described above, the hot air flows into the drum 200 through the plurality of through-holes defined in the drum inlet 2213, so that the first sealer 451 can be disposed to surround the drum inlet 2213 from the outside of the drum inlet 2213 to effectively prevent the leakage to the outside of the drum 200.

In addition, the first sealer 451 has the thickness greater than the rearwardly protruding depth of the drum inlet 2213, so that the leakage of the hot air to the outside of the drum 200 before flowing into the drum 200 through the drum inlet 2213 can be prevented as much as possible. The first sealer 451 can be constructed to be in contact with both the drum shielding portion 221 and the front surface of the rear plate 420 to more effectively prevent the leakage.

The sealer 450 can include a second sealer 452 disposed along an inner circumference of the flow portion 4231.

The second sealer 452 can be disposed between the front surface of the rear plate 420 and the drum shielding portion 221 of the drum rear surface 220. The second sealer 452 can be disposed between the drum shielding portion 221 and the flow portion 4231.

The second sealer 452 can be formed in a shape corresponding to the flow inner circumferential portion 4231*b*. When the flow inner circumferential portion 4231*b* is formed in a circular shape, the second sealer 452 can be formed in an annular shape in which both inner and outer sides thereof are formed in a circular shape. The second sealer 452 can be disposed inwardly of the flow inner circumferential portion 4231*b*. When a diameter of the flow inner circumferential portion 4231*b* is D2, an outer diameter of the second sealer 452 can be equal to or smaller than D2.

The second sealer 452 can be disposed at an inner edge of the drum shielding portion 221. That is, the second sealer 452 can be disposed on the circumferential rib 2215. The second sealer 452 can be disposed to surround the driver M connected to the drum rear surface 220.

The second sealer 452 can have an inner circumferential surface located inwardly of the drum inlet 2213. A thickness of the second sealer 452 can be greater than the rearwardly protruding length of the drum inlet 2213.

As described above, the hot air flows into the drum 200 through the plurality of through-holes defined in the drum inlet 2213, so that the second sealer 452 can be disposed to surround the driver M from the inside of the drum inlet 2213 to effectively prevent the hot air from leaking to the driver M.

In addition, the first sealer 451 has the thickness greater than the rearwardly protruding depth of the drum inlet 2213, so that the leakage of the hot air to the driver M before flowing into the drum 200 through the drum inlet 2213 can be prevented as much as possible.

When the heat is generated by the rotation of the driver M and the hot air of the flow portion 4231 is introduced, the driver M can be further heated and a malfunction of the driver M can occur. The driver M can be disposed to be exposed to the outside. When the hot air flows into the driver M, the hot air can leak to the outside of the drum 200. The second sealer 452 can be disposed to be in contact with both the drum shielding portion 221 and the front surface of the rear plate 420 to more effectively prevent the leakage.

Because the drum 200 rotates during the operation of the laundry treating apparatus, continuous friction is applied to the sealer 450 by the drum rear surface 220. Therefore, the sealer 450 can be made of an elastic material capable of sealing the drum rear surface 220 and the flow portion 4231 without deterioration in performance even with a frictional force and frictional heat generated based on the rotation.

In some implementations, FIGS. 9A to 9D are views showing a fan duct. FIG. 10 is a view showing a fan duct connected to a hot air supply.

Figure 9C:
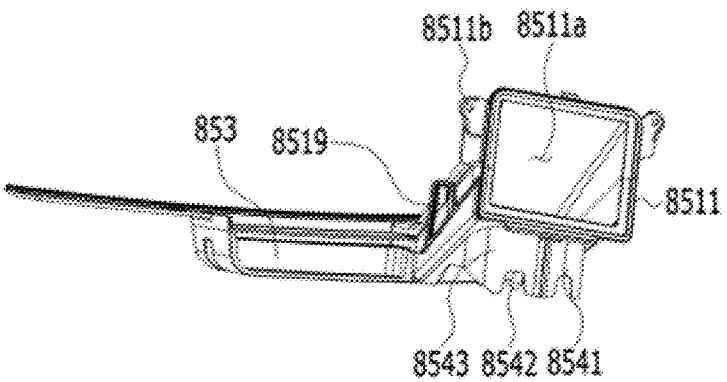
FIGS. 9A to 9D are views showing the fan duct.
Figure 9A:
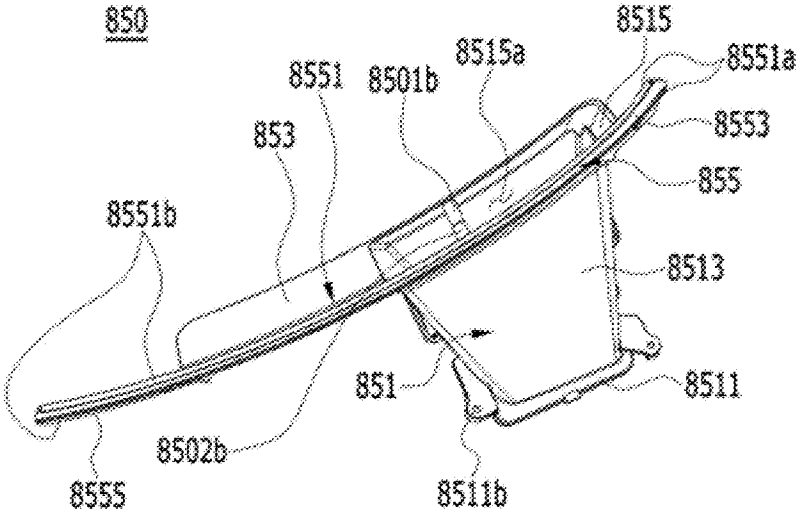
Figure 9D:
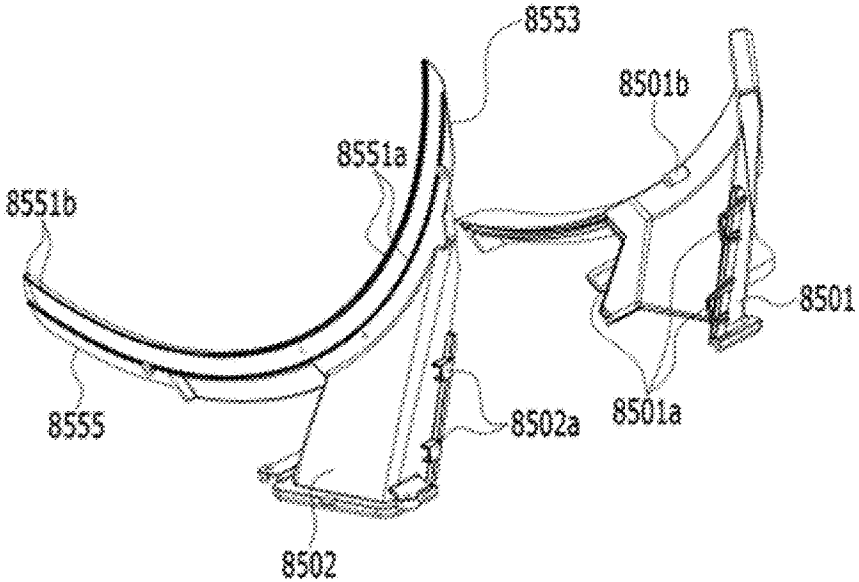
Figure 9B:
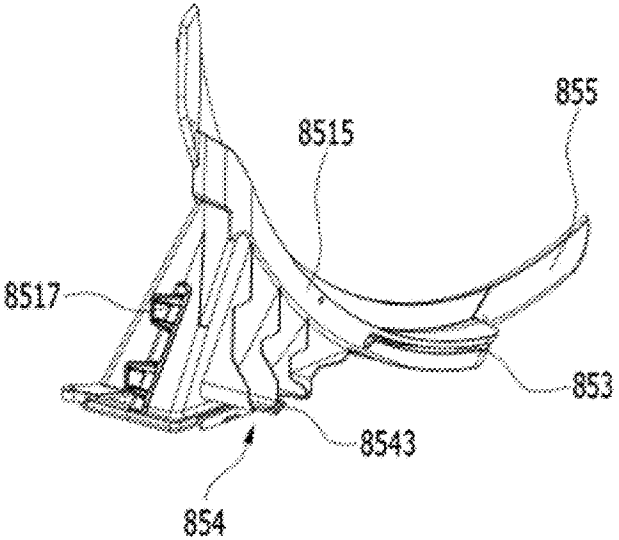
Figure 10:
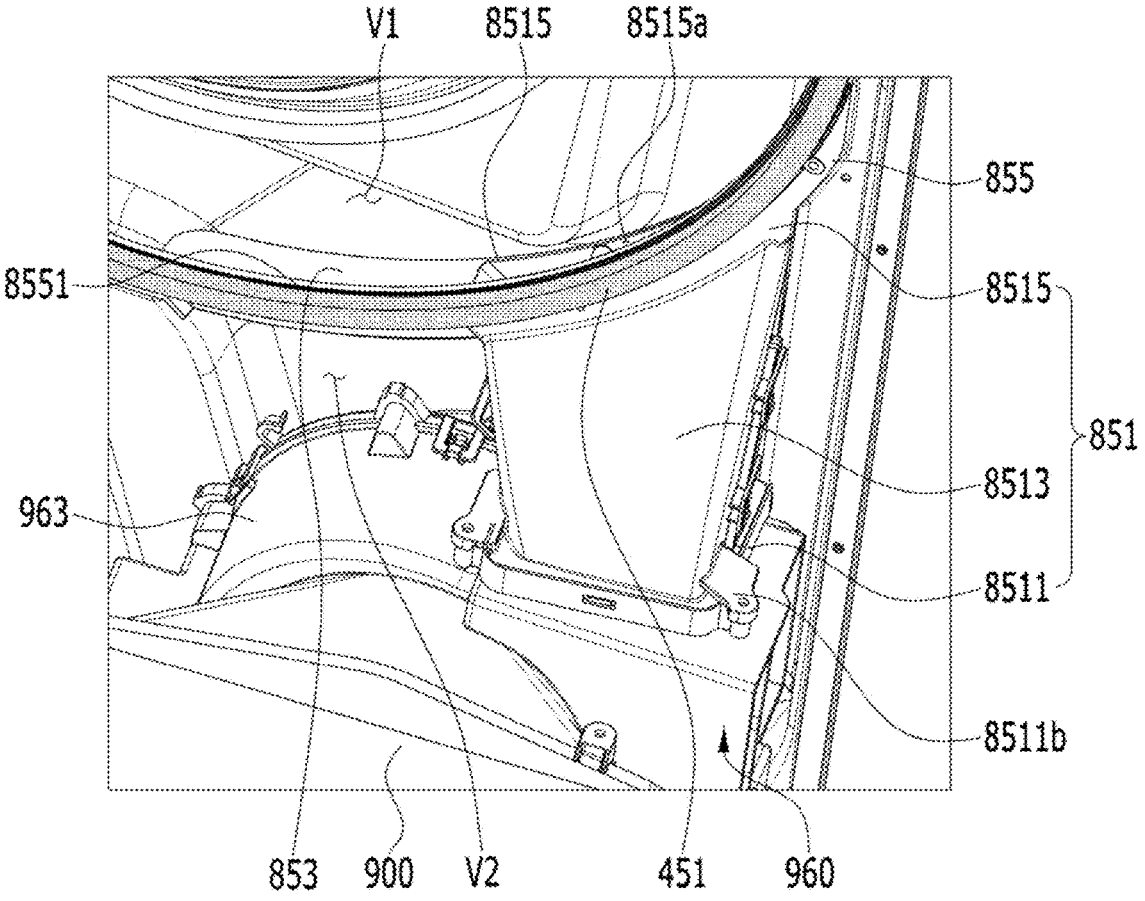
FIG. 10 is a view showing the fan duct connected to an example of a hot air supply.

Specifically, FIG. 9A is a view of the fan duct viewed from the front, FIG. 9B is a view of the fan duct viewed from the rear, FIG. 9C is a view of the fan duct viewed from below, and FIG. 9D is a view showing the fan duct being separated.

Referring to FIG. 9A and FIG. 10, the laundry treating apparatus can include the fan duct 850 for supplying the hot air from the hot air supply 900 to the duct 423.

Specifically, the fan duct 850 can include a fan duct body 851 that forms an appearance of the fan duct 850.

One end of the fan duct body 851 can be connected to the hot air supply 900, and the other end thereof can be opened to receive the hot air from the hot air supply 900.

Specifically, one end of the fan duct body 851 can be coupled to the blower fan housing 963 of the blower 960 to receive the hot air from the blower fan housing 963.

For example, the blower fan housing 963 can be connected to the hot air flow channel 920 such that the hot air can be introduced thereinto, and can discharge the introduced hot air through the open top surface thereof. One end of the fan duct body 851 can be coupled to the open top surface of the blower fan housing 963.

The fan duct body 851 can include a fan duct inlet 8511 coupled to the open top surface of the blower fan housing 963.

The fan duct inlet 8511 can be formed in a shape corresponding to the open top surface of the blower fan housing 963. In FIG. 9C, the fan duct inlet 8511 is shown in a rectangular shape.

In addition, the fan duct inlet 8511 can include a fan duct inlet hole 8511*a* defined to receive the hot air from the blower fan housing 963, and the fan duct inlet hole 8511*a* can be defined to correspond to a hole for discharging the hot air to the outside of the blower fan housing 963.

The fan duct inlet 8511 can be inserted into and coupled to the blower fan housing 963. Accordingly, the fan duct inlet hole 8511*a* can receive the hot air from the interior of the blower fan housing 963.

Because the fan duct inlet 8511 is inserted into and coupled to the blower fan housing 963, the fan duct inlet 8511 can receive a strong coupling force, and the leakage of the hot air to the outside through the space between the fan duct inlet 8511 and the blower fan housing 963 can be prevented as much as possible.

In some implementations, the fan duct body 851 can include a plurality of connection fastening portions 8511*b* disposed on an outer circumferential surface thereof to be coupled to the blower fan housing 963. The connection fastening portion 8511*b* can be coupled to the blower fan housing 963 by being penetrated by a separate fastening member.

The connection fastening portion 8511*b* can be disposed on the outer circumferential surface of the fan duct body 851 adjacent to the fan duct inlet 8511 or on the fan duct inlet 8511. Specifically, the connection fastening portion 8511*b* can protrude from the outer circumferential surface of the fan duct body 851 or the fan duct inlet 8511, and can have a fastening hole through which the fastening member can pass at an end thereof.

In addition, the plurality of connection fastening portions 8511*b* can be disposed along a circumference of the fan duct body 851 and coupled to the blower fan housing 963 as the separate fastening member penetrates each of the plurality of connection fastening portions 8511*b*. The connection fastening portion 8511*b* can provide a coupling force for an entirety of the fan duct 850 to be strongly fixed to the blower fan housing 963.

In some implementations, referring to FIG. 9B, the fan duct body 851 can include a fan duct support rib 854 that increases structural rigidity of the entire fan duct 850.

The fan duct support rib 854 can have a bypass hole 857 to be described later at the front of the fan duct body 851, so that the fan duct support rib 854 can be disposed at the rear of the fan duct body 851. That is, the fan duct support rib 854 can protrude from a rear surface of the fan duct body 851.

The fan duct support rib 854 can be formed in a plate shape that protrudes toward the inflow portion recessed surface 4234 and extends along a longitudinal direction of the fan duct body 851, and can include a plurality of fan duct support ribs spaced apart from each other by a predetermined distance. The plurality of fan duct support ribs 854 can be spaced apart from each other in a width direction as they extend in the longitudinal direction of the fan duct body 851. The fan duct support rib 854 can be disposed on an entirety of the rear surface of the fan duct body 851 to further increase the structural rigidity of the fan duct 850.

In addition, when the fan duct 850 is coupled to the inflow portion recessed surface 4234 as described above, the fan duct support rib 854 can be in contact with the inflow portion recessed surface 4234 to further increase the supporting force of the fan duct 850.

In some implementations, the fan duct body 851 can include a support rib connection portion 8541 for connecting the plurality of fan duct support ribs 854 to each other. The support rib connection portion 8541 can connect the plurality of fan duct support ribs 854 to each other, so that the plurality of fan duct support ribs 854 can integrally absorb vibration or shock.

For example, in FIG. 9B, the support rib connection portion 8541 is shown to connect lower ends of the plurality of fan duct support rib 854 to each other. However, the present disclosure should not be construed as being limited thereto, and a position of the support rib connection portion 8541 can be varied.

In addition, the fan duct body 851 can include a support coupling portion 8543 for coupling the inflow portion recessed surface 4234 to the fan duct body 851.

The support coupling portion 8543 can be disposed on the fan duct support rib 854 or the support rib connection portion 8541 and can have a predetermined area, and can be coupled to the inflow portion recessed surface 4234 by being penetrated by a separate fastening member. Accordingly, the support coupling portion 8543 can strongly fix the fan duct 850 to the inflow portion recessed surface 4234.

For example, in FIG. 9B, the support coupling portion 8543 is illustrated to be disposed in a portion where the fan duct support rib 854 and the support rib connection portion 8541 are connected to each other. However, the present disclosure should not be construed as being limited thereto, and a position of the support coupling portion 8543 can be varied.

In addition, when the fan duct support rib 854 is in contact with the inflow portion recessed surface 4234, a space surrounded by the fan duct support rib 854 and the support rib connection portion 8541 can be shielded from the outside, and the fan duct body 851 can include a support rib connection hole 8542 for communicating an interior of the fan duct support rib 854 and an exterior of the fan duct support rib 854 with each other. The support rib connection hole 8542 can be defined in the fan duct support rib 854 or the support rib connection portion 8541.

Figure 11B:
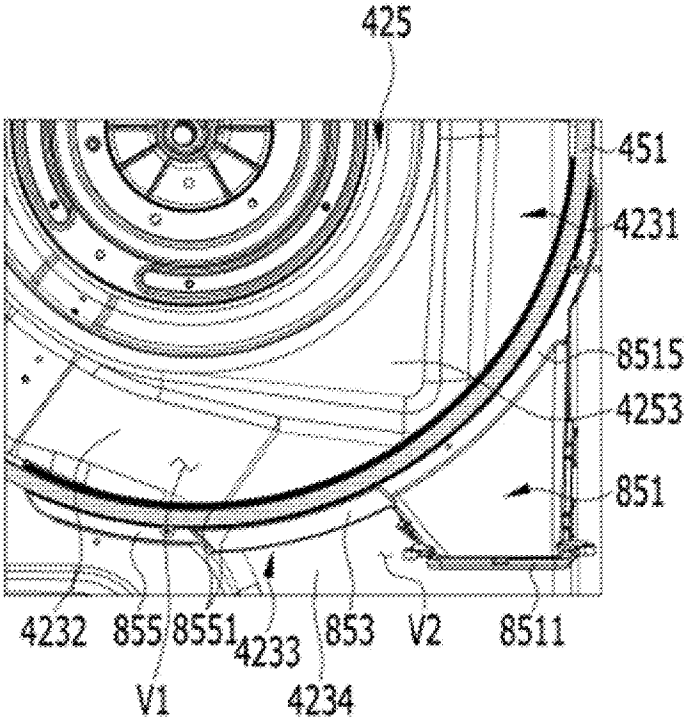
FIGS. 11A and 11B are views showing the fan duct and an example of a duct.
Figure 11A:
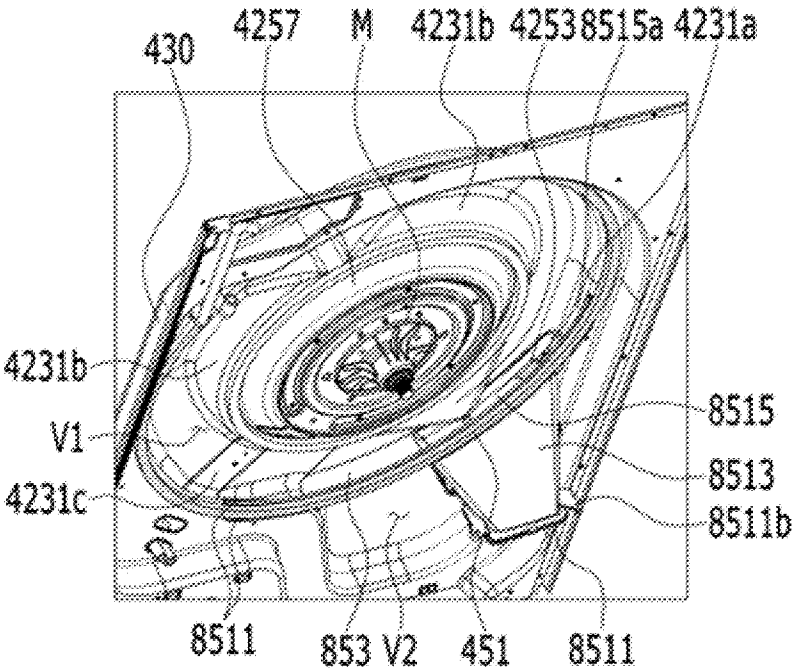

In some implementations, FIGS. 11A and 11B are views showing examples of a fan duct and a duct. Specifically, FIG. 11A shows the fan duct coupled to the duct from the top, and FIG. 11B shows the fan duct coupled to the duct from the front.

Referring to FIG. 11A, the fan duct body 851 can include a fan duct outlet 8515 for guiding the hot air supplied from the hot air supply 900 to the flow portion 4231.

As described above, the fan duct body 851 can have one end connected to the hot air supply 900 and the other end connected to the inflow portion 4233 or the flow portion 4231, and the fan duct outlet 8515 can form the other end of the fan duct body 851.

Specifically, the fan duct outlet 8515 can be disposed to be inserted into the first flow space V1 of the flow portion 4231 or the second flow space V2 of the inflow portion 4233. In addition, the fan duct outlet 8515 can be coupled to the flow recessed surface 4232 of the flow portion 4231 and the inflow portion recessed surface 4234 of the inflow portion 4233.

The fan duct outlet 8515 can be constructed such that a rear surface thereof is in contact with the inflow portion recessed surface 4234 or the flow recessed surface 4232 over a certain area, so that the fan duct outlet 8515 can be strongly supported by the flow recessed surface 4232 or the inflow portion recessed surface 4234.

As described above, the first flow space V1 and the second flow space V2 can be in communication with each other as one side to be connected with the inflow portion circumferential portion 4233*a* and the other side of the flow outer circumferential portion 4231*a* are opened, and the inflow portion circumferential portion 4233*a* can have the arc shape.

For convenience of description, one side of the flow outer circumferential portion 4231*a* will be described as a first flow connection portion 4235, and the other side of the flow outer circumferential portion 4231*a* will be described as a second flow connection portion 4236.

That is, the first flow connection portion 4235 can be located farther from the first side plate 1411 than the second flow connection portion 4236, and can be located close to the bottom plate 147 of the cabinet 100.

The fan duct outlet 8515 can be disposed at a boundary between the flow portion 4231 and the inflow portion 4233, can be inserted at a boundary between the first flow space V1 and the second flow space V2, and can be in contact with a boundary between the flow recessed surface 4232 and the inflow portion recessed surface 4234.

The fan duct outlet 8515 can be disposed at the boundary between the flow portion 4231 and the inflow portion 4233 to directly guide the hot air flowing inside the fan duct 850 to the flow portion 4231, thereby minimizing a flow distance. The fan duct outlet 8515 can minimize a heat loss of the hot air by minimizing the flow distance of the hot air.

In some implementations, the fan duct outlet 8515 can be constructed to partition the flow portion 4231 and the inflow portion 4233.

The fan duct outlet 8515 can extend along a circumference of the flow outer circumferential portion 4231*a* to form a portion of the flow portion 4231. The fan duct outlet 8515 can form a circle shape together with the flow outer circumferential portion 4231*a* to partition the flow portion 4231 and the inflow portion 4233.

That is, a length of the fan duct outlet 8515 can be the same as a length of a portion between the first flow connection portion 4235 and the second flow connection portion 4236. The fan duct outlet 8515 can be constructed such that both side surfaces thereof are in contact with the first flow connection portion 4235 and the second flow connection portion 4236 of the flow outer circumferential portion 4231*a* described above.

Specifically, one side surface of the fan duct outlet 8515 can be in contact with the second flow connection portion 4236, and the other side surface thereof can be in contact with the first flow connection portion 4235.

Accordingly, the hot air flowed into the flow portion 4231 can be prevented from flowing to the inflow portion 4233 through the fan duct outlet 8515 as much as possible.

In some implementations, the fan duct 850 can further include a fan duct shielding portion 853 partitioning the flow portion 4231 and the inflow portion 4233 together with the fan duct outlet 8515.

First, the fan duct outlet 8515 will be described. The fan duct outlet 8515 can have a width smaller than an open width of the flow outer circumferential portion 4231*a*. The reason that the fan duct outlet 8515 has the width smaller than the open width of the flow outer circumferential portion 4231*a* can be varied.

For example, the blower 960 can have the blower fan 961 disposed therein and can have a width greater than that of the fan duct outlet 8515 to sufficiently secure a flow rate of the hot air. As the blower 960 and the fan duct outlet 8515 are disposed together in the second flow space V2 of the inflow portion 4233, the width of the fan duct outlet 8515 can be smaller than a width between the first flow connection portion 4235 and the second flow connection portion 4236 of the flow outer circumferential portion 4231*a*.

In addition, as described above, a portion of one surface of the blower 960 can be opened and coupled to the fan duct inlet 8511. When an open area of the fan duct outlet 8515 is too large, an efficiency of the hot air supplied to the flow portion 4231 can be reduced, such as a rapid decrease in a flow velocity of the hot air. In addition to the above reason, there can be various reasons.

In some implementations, the fan duct outlet 8515 can shield a portion of the boundary between the flow portion 4231 and the inflow portion 4233, and the fan duct shielding portion 853 can shield a portion of the boundary that is not shielded by the fan duct outlet 8515. That is, the fan duct shielding portion 853 can extend along the circumference of the flow outer circumferential portion 4231*a* from the fan duct outlet 8515, and can form a portion of the flow portion 4231.

Specifically, one side surface or the other side surface of the fan duct outlet 8515 can be spaced apart from the flow outer circumferential portion 4231*a*, and the fan duct shielding portion 853 can extend from one side or the other side of the fan duct outlet 8515 to the first flow connection portion 4235 or the second flow connection portion 4236 described above. That is, the fan duct shielding portion 853 can form the circle shape together with the fan duct outlet 8515 and the flow outer circumferential portion 4231*a*.

In some implementations, the fan duct shielding portion 853 can extend from one of the both side surfaces of the fan duct outlet 8515.

That is, one of one side surface and the other side surface of the fan duct outlet 8515 can be in contact with the first flow connection portion 4235 or the second flow connection portion 4236, and the fan duct shielding portion 853 can extend toward the first flow connection portion 4235 or the second flow connection portion 4236 from the other of one side surface and the other side surface of the fan duct outlet 8515.

One side surface of the fan duct outlet 8515 can refer to a side surface disposed closer to the first side plate 1411 among the both side surfaces.

For example, FIG. 11B illustrates that one side surface of the fan duct outlet 8515 is in contact with the second flow connection portion 4236, and the fan duct shielding portion 853 extends from the other side surface of the fan duct outlet 8515 to be in contact with the first flow connection portion 4235. However, the present disclosure may not be limited thereto. The other side surface of the fan duct outlet 8515 may be in contact with the first flow connection portion 4235, and the fan duct shielding portion 853 can extend from one side surface of the fan duct outlet 8515 to be in contact with the first flow connection portion 4235.

The fan duct shielding portion 853 can extend from only one of the both side surfaces of the fan duct outlet 8515, so that manufacturing thereof can become more facilitated. In addition, the fan duct 850 can include a fan duct extension 8513 for connecting the fan duct outlet 8515 and the fan duct inlet 8511 to each other. As the fan duct outlet 8515 is in contact with the first flow connection portion 4235 or the second flow connection portion 4236, a portion of the fan duct extension 8513 can be in contact with the inflow portion circumferential portion 4233*a*. That is, as the fan duct extension 8513 is in contact with the inflow portion circumferential portion 4233*a*, the support force of the fan duct 850 can be improved.

In some implementations, referring to FIG. 11B, the fan duct 850 can include a fan duct outlet hole 8515*a* defined in the fan duct outlet 8515 to discharge the hot air supplied from the hot air supply 900 to the flow portion 4231.

The fan duct outlet hole 8515*a* can be opened from the fan duct outlet 8515 toward the first flow space V1. Specifically, the fan duct outlet hole 8515*a* can be defined through one surface of the fan duct outlet 8515 facing the flow inner circumferential portion 4231*b*.

As described above, the fan duct outlet 8515 can partition the first flow space V1 and the second flow space V2 from each other alone or together with the fan duct shielding portion 853. As the fan duct outlet hole 8515*a* faces the flow inner circumferential portion 4231*b*, the hot air passing through the fan duct outlet hole 8515*a* may not directly face the drum shielding portion 221 of the drum rear surface 220, but can face the first flow space V1.

The fan duct outlet hole 8515*a* can allow the hot air passing through the fan duct outlet hole 8515*a* to diffuse throughout the flow portion 4231 and uniformly flow into the drum 200 through the drum shielding portion 221 facing the flow portion 4231. Furthermore, it is possible to prevent the hot air supplied to the flow portion 4231 from leaking to the outside through the fan duct 850 as much as possible.

In some implementations, referring to FIG. 5A to 5C again, the hot air introduced through the fan duct 850 can flow in one direction C1 and the other direction C2 in the flow portion 4231 of the duct 423. One direction C1 can refer to a clockwise direction. In addition, the other direction C2 can refer to a counterclockwise direction.

In some implementations, referring to FIG. 11B, the fan duct 850 can include a fan duct coupling portion 855 coupled to the rear plate 420. The fan duct 850 can be coupled to the rear plate 420 through the fan duct coupling portion 855.

The fan duct coupling portion 855 can include a first fan duct coupling portion 8553 disposed in the fan duct shielding portion 853 and a second fan duct coupling portion 8555 disposed in the fan duct outlet 8515.

That is, the first fan duct coupling portion 8553 can be disposed on a front surface of the fan duct outlet 8515, and can be formed in a shape corresponding to the flow outer circumferential portion 4231*a*, so that one end thereof can extend further outward than the fan duct outlet 8515.

For example, one end of the first fan duct coupling portion 8553 can extend further in the other direction C2 than the fan duct outlet 8515, and the first fan duct coupling portion 8553 can be coupled to the front surface of the rear plate 420 outwardly of the flow outer circumferential portion 4231*a*.

In addition, the second fan duct coupling portion 8555 can be disposed on the front surface of the fan duct shielding portion 853, can be formed in a shape corresponding to the flow outer circumferential portion 4231*a*, and can have the other end extending further outward than the fan duct shielding portion 853. The second fan duct coupling portion 8555 can have the other end extending further in one direction C1 than the fan duct shielding portion 853, and can be coupled to the front surface of the rear plate 420 outwardly of the flow outer circumferential portion 4231*a*.

A separate fastening member can pass through each of the first fan duct coupling portion 8553 and the second fan duct coupling portion 8555 to be coupled to the rear plate 420, thereby forming a strong coupling force.

In addition, the first fan duct coupling portion 8553 can be connected to the second fan duct coupling portion 8555. That is, the fan duct coupling portion 855 can extend from one end to the other end thereof, and a length of an arc formed from one end to the other end of the fan duct coupling portion 855 can be greater than a length of the arc formed by the fan duct shielding portion 853 and the fan duct outlet 8515.

In some implementations, the rear plate 420 can include a fan duct accommodating portion 4271 coupled to the fan duct coupling portion 855.

The fan duct accommodating portion 4271 can be coupled to both ends of the fan duct coupling portion 855, and can include a first fan duct accommodating portion 4271*a* coupled to the first fan duct coupling portion 8553 and a second fan duct accommodating portion 4271*b* coupled to the second fan duct coupling portion 8555.

The first fan duct accommodating portion 4271*a* can be recessed in a shape corresponding to a portion protruding more in one direction C1 than the fan duct shielding portion 853 of the first fan duct coupling portion 8553.

In addition, the second fan duct accommodating portion 4271*b* can be recessed in a shape corresponding to a portion protruding more in the other direction C2 than the fan duct outlet 8515 of the second fan duct coupling portion 8555.

The fan duct coupling portion 855 can receive strong supporting force as the both ends thereof are accommodated in the fan duct accommodating portion 4271, an entirety of the fan duct 850 can be more strongly fixed by the fan duct accommodating portion 4271.

In some implementations, the fan duct 850 can include a coupling guider 8551 disposed to support the first sealer 451.

As described above, the fan duct outlet 8515 can form the portion of the outer circumference of the flow portion 4231, and the first sealer 451 can be formed in the annular shape and disposed along the outer circumference of the flow portion 4231 including the fan duct outlet 8515.

The coupling guider 8551 can include a first coupling guider 8551*a* disposed in front of the fan duct outlet 8515, and a second coupling guider 8551*b* disposed in front of the fan duct shielding portion 853.

The first fan duct coupling portion 8553 can be disposed in front of the fan duct outlet 8515, and the first coupling guider 8551*a* can be disposed on a front surface of the first fan duct coupling portion 8553.

The first coupling guider 8551*a* can protrude from the front surface of the first fan duct coupling portion 8553, and can be formed as a plurality of ribs extending to correspond to the circumference of the first sealer 451.

When the first coupling guider 8551*a* is formed as the plurality of ribs, the plurality of ribs can be spaced apart from each other, so that the first sealer 451 can be disposed therebetween. The plurality of ribs can respectively be in contact with the inner circumferential surface and the outer circumferential surface of the first sealer 451 to support the first sealer 451. In addition, the plurality of ribs can extend throughout the first fan duct coupling portion 8553 along the circumferential direction of the flow portion 4231, and an area thereof in contact with the first sealer 451 can be increased to more strongly support the first sealer 451.

In addition, the second fan duct coupling portion 8555 can be disposed in front of the fan duct shielding portion 853, and the second coupling guider 8551*b* can be disposed on a front surface of the second fan duct coupling portion 8555.

The second coupling guider 8551*b* can protrude from the front surface of the second fan duct coupling portion 8555, and can be formed as a plurality of ribs extending to correspond to the circumference of the first sealer 451.

When the second coupling guider 8551*b* is formed as the plurality of ribs, the plurality of ribs can be spaced apart from each other, so that the first sealer 451 can be disposed therebetween. The plurality of ribs can respectively be in contact with the inner circumferential surface and the outer circumferential surface of the first sealer 451 to support the first sealer 451. In addition, the plurality of ribs can extend throughout the first fan duct coupling portion 8553 along the circumferential direction of the flow portion 4231, and an area thereof in contact with the first sealer 451 can be increased to more strongly support the first sealer 451.

The first coupling guider 8551*a* can be connected to the second coupling guider 8551*b* to support the first sealer 451 together. The first coupling guider 8551*a* and the second coupling guider 8551*b* can be connected to each other to support the first sealer 451 with a larger area.

In some implementations, referring to FIG. 11A, the fan duct coupling portion 855 can be located closer to the center of the flow portion 4231 than the fan duct outlet 8515 and the fan duct shielding portion 853.

For example, the fan duct coupling portion 855 can protrude more toward a center of the flow portion 4231 than the fan duct outlet 8515 and the fan duct shielding portion 853. That is, the fan duct coupling portion 855 can have an increased cross-sectional area than the fan duct outlet 8515 and the fan duct shielding portion 853, so that the coupling guider 8551 can be easily disposed on the front surface of the fan duct coupling portion 855.

In some implementations, referring to FIG. 9D, the fan duct 850 can be formed as a plurality of divided bodies. That is, the fan duct 850 can be constructed such that the plurality of divided bodies are coupled to each other to define a flow channel therein.

The fan duct 850 can be manufactured as an integral body, but as the shape thereof is complicated and a space in which the hot air flows is defined, the fan duct 850 can be manufactured as the plurality of divided bodies coupled to each other for manufacturing convenience. As for a coupling scheme of the plurality of divided bodies, various schemes such as screw coupling, riveting coupling, fitting coupling, bonding, welding, and the like can be used.

Specifically, the fan duct 850 can include a first fan duct forming portion 8501 and a second fan duct forming portion 8502.

The first fan duct forming portion 8501 can form a shape of a portion of the fan duct 850, and the second fan duct forming portion 8502 can form a shape of the remaining portion of the fan duct 850, so that, when the first fan duct forming portion 8501 and the second fan duct forming portion 8502 are coupled to each other, the shape of the fan duct 850 can be completed.

For example, the first fan duct forming portion 8501 can face the rear plate 420, and can form a portion of the above-described fan duct inlet 8511, a portion of the fan duct body 851, a portion of the fan duct outlet 8515, and a portion of the fan duct shielding portion 853.

In addition, the second fan duct forming portion 8502 can face the drum rear surface 220, and can form a portion of the above-described fan duct inlet 8511, a portion of the fan duct body 851, a portion of the fan duct outlet 8515, a portion of the fan duct shielding portion 853, the fan duct coupling portion 855, and the coupling guider 8551.

That is, when viewing from the side, the first fan duct forming portion 8501 and the second fan duct forming portion 8502 can be divided at a center of the fan duct 850 in a direction from the top plate 145 to the bottom plate 147. The first fan duct forming portion 8501 can form a rear portion of the fan duct 850, and the second fan duct forming portion 8502 can form a front portion of the fan duct 850.

However, a divided shape of the fan duct 850 can be varied depending on an overall shape of the fan duct 850, manufacturing conditions, and the like.

In some implementations, the first fan duct forming portion 8501 can be coupled to the second fan duct forming portion 8502 by a separate coupling portion.

That is, the first fan duct forming portion 8501 can include a first fan duct coupling portion 8501*a* disposed on one surface of the first fan duct forming portion 8501, and the second fan duct forming portion 8502 can include a second fan duct coupling portion 8502*a* disposed on one surface of the second fan duct forming portion 8502. The first fan duct coupling portion 8501*a* and the second fan duct coupling portion 8502*a* can be coupled to each other as one thereof is fastened to the other.

As described above, the first fan duct forming portion 8501 and the second fan duct forming portion 8503 can form the fan duct body 851 together, and each of the first fan duct coupling portion 8501*a* and the second fan duct coupling portion 8502*a* can be disposed on both side surfaces of the fan duct body 851.

Hereinafter, for convenience of description, a structure in which the second fan duct coupling portion 8502*a* is inserted into and coupled to the first fan duct coupling portion 8501*a* will be described. The structure in which one component is inserted into and coupled to another component can be a kind of hook coupling.

However, the present disclosure may not be limited thereto, and the first fan duct coupling portion 8501*a* can be inserted into and coupled to the second fan duct coupling portion 8502*a*.

The first fan duct coupling portion 8501*a* can protrude from both side surfaces of the first fan duct forming portion 8501, can extend frontwards toward the second fan duct coupling portion 8502*a*, and can have a fan duct coupling hole 8501*c* defined therein.

The second fan duct coupling portion 8502*a* can protrude from both side surfaces of the second fan duct forming portion 8502 and can be formed in a shape corresponding to the fan duct coupling hole 8501*c*.

The second fan duct coupling portion 8502*a* can be inserted into and coupled to the fan duct coupling hole 8501*c*. In addition, the first fan duct coupling portion 8501*a* and the second fan duct coupling portion 8502*a* can respectively include a plurality of first fan duct coupling portions and a plurality of second fan duct coupling portions to increase a coupling force and a supporting force of the first fan duct forming portion 8501 and the second fan duct forming portion 8502.

In some implementations, the first fan duct forming portion 8501 and the second fan duct forming portion 8502 can include a support that can support both.

The first fan duct forming portion 8501 can define a space inside the fan duct 850 together with the second fan duct forming portion 8502. For example, the fan duct inlet 8511, the fan duct body 851, and the fan duct outlet 8515 can all have an empty space defined therein. The fan duct 850 may be damaged or unable to maintain the shape thereof when an external force is applied thereto during the coupling process or the manufacturing process.

The support can provide a supporting force for maintaining the shape of the fan duct 850 by the first fan duct forming portion 8501 and the second fan duct forming portion 8502.

The support can include a first fan duct support 8501*b* disposed on the first fan duct forming portion 8501, and a second fan duct support 8502*b* disposed on the second fan duct forming portion 8502.

The first fan duct support 8501*b* and the second fan duct support 8502*b* can respectively protrude from the first fan duct forming portion 8501 and the second fan duct forming portion 8502 such that ends thereof are in contact with each other, thereby providing the supporting force to the first fan duct forming portion 8501 and the second fan duct forming portion 8502.

For example, the first fan duct support 8501*b* and the second fan duct support 8502*b* can be disposed inside the fan duct outlet 8515.

Specifically, the first fan duct support 8501*b* can protrude toward the second fan duct support 8502*b* from one surface of the first fan duct forming portion 8501 forming the fan duct outlet 8515, and the second fan duct support 8502*b* can protrude toward the first fan duct support 8501*b* from one surface of the second fan duct forming portion 8502 forming the fan duct outlet 8515. The ends of the first fan duct support 8501*b* and the second fan duct support 8502*b* can be in contact with each other inside the fan duct outlet 8515.

In addition, a separate fastening member can penetrate the first fan duct support 8501*b* and the second fan duct support 8502*b* together to fix the first fan duct forming portion 8501 and the second fan duct forming portion 8502.

Furthermore, the separate fastening member can penetrate the rear plate 420 together with the first fan duct forming portion 8501 and the second fan duct forming portion 8502, thereby increasing the coupling force between the first fan duct forming portion 8501 and the second fan duct forming portion 8502, as well as the coupling force between the rear plate 420 and the fan duct 850.

In some implementations, referring to FIG. 9A and FIG. 10, the fan duct 850 can be prevented from being in contact with the drum 200.

For efficient utilization of the space inside cabinet 100, the fan duct 850 can be inclined to be prevented from being in contact with the drum 200.

As described above, in the fan duct body 851, the fan duct inlet 8511 forming one end can be connected to the blower 960 of the hot air supply 900, and the fan duct outlet 8515 forming the other end can be connected to the duct 423 of the rear plate 420.

As the blower 960 can be disposed below the drum 200 and the duct 423 can be disposed at the rear of the drum 200 to face the drum 200, the fan duct body 851 connecting the blower 960 and the drum 200 to each other can be inclinedly extended from the fan duct inlet 8511 to the fan duct outlet 8515.

For example, referring to FIG. 10, the fan duct body 851 can extend upwardly from the fan duct inlet 8511 to the fan duct outlet 8515 to be inclined rearwards.

When the fan duct 850 extends upwards to be inclined rearwards, interference with the drum can be reduced compared to a case in which the fan duct 850 vertically extends upwards, so that a design freedom of the drum can be improved. For example, the drum 200 can further extend rearwards and can have a larger size to increase a laundry accommodating capacity.

In some implementations, the flow inner circumferential portion 4231*b* can be constructed to guide the hot air into the flow portion 4231.

As described above, the hot air introduced through the fan duct 850 can flow in one direction C1 and the other direction C2 in the flow portion 4231 of the duct 423. One direction C1 can refer to the clockwise direction, and the other direction C2 can refer to the counterclockwise direction.

The flow inner circumferential portion 4231*b* can be constructed such that a portion thereof facing the fan duct outlet 8515 protrudes toward the fan duct outlet 8515. That is, the flow inner circumferential portion 4231*b* can prevent concentration of the hot air in one of one direction C1 and the other direction C2, can allow the hot air to be supplied into the drum 200 in a balanced manner.

Referring to FIG. 6B and FIG. 11B, specifically, the flow inner circumferential portion 4231*b* can include a flow inner circumferential body 4231*d* and a flow inner circumferential guide portion 4231*e*. the flow inner circumferential portion 4231*b* can be formed in a shape of a circle, and the flow inner circumferential guide portion 4231*e* can protrude from the flow inner circumferential body 4231*d* toward the fan duct outlet 8515.

That is, an overall shape of the flow inner circumferential portion 4231*b* can be a water droplet shape or a streamlined shape. In other words, the flow inner circumferential guide portion 4231*e* can face the fan duct outlet 8515 and can extend with overlapping arcs, and a length of an arc can be reduced toward the fan duct outlet 8515.

The hot air discharged from the fan duct outlet 8515 can be divided in one direction C1 and the other direction C2 by the flow inner circumferential guide portion 4231*e*, so that the hot air can be guided to an entirety of the first flow space V1 in a balanced manner.

In some implementations, referring back to FIG. 4 and FIG. 6B, the flow portion 4231 can include a flow guider 4231*c* for more efficiently guiding the hot air to the drum rear surface 220.

The flow guider 4231*c* can protrude frontwards from the flow recessed surface 4232. The flow guider 4231*c* can extend in a direction in which the hot air of the first flow space V1 flows.

The flow guider 4231*c* can extend to connect the flow outer circumferential portion 4231*a* and the flow inner circumferential portion 4231*b* to each other. That is, the flow guider 4231*c* can change the flow direction of the hot air introduced into the first flow space V1 toward the drum rear surface 220 and reduce the flow rate of the hot air, thereby allowing the hot air to be efficiently introduced into the drum 200.

The flow guider 4231*c* can have different protruding heights along a circumferential direction of the flow portion 4231 in the flow recessed surface 4232. The flow guider 4231*c* can be inclined in the circumferential direction.

That is, the flow guider 4231*c* can include an inclined section in which a height protruding forward increases as a distance from the fan duct outlet 8515 along the circumferential direction of the flow portion 4231 increases, a constant section in which the height protruding forward is constant as the distance from the fan duct outlet 8515 along the circumferential direction of the flow portion 4231 increases, and a decreasing section in which the height protruding forward decreases as the distance from the fan duct outlet 8515 along the circumferential direction of the flow portion 4231 increases.

The flow guider 4231*c* can be constructed such that an overall protrusion height thereof varies. The hot air flowing through the first flow space V1 can be efficiently guided to the drum rear surface 220 as the flow velocity and flow direction of the hot air change by the flow guider 4231*c*.

For example, the flow guider 4231*c* can extend to further protrude frontwards from the flow recessed surface 4232 along one direction C1 with respect to the fan duct 850. In addition, after the flow guider 4231*c* protrudes to a predetermined height to prevent contact with the drum rear surface 220, the flow guider 4231*c* can extend to maintain the predetermined height along one direction C1. In addition, the flow guider 4231*c* can extend to maintain the predetermined height, and can extend to decrease the protrusion height again along one direction C1.

In some implementations, referring back to FIG. 4 and FIG. 6B, the flow guider 4231*c* can include a plurality of flow guiders spaced apart from each other along the circumferential direction. FIG. 4 shows a flow portion with two flow guider 4231*c*.

One flow guider 4231*c* can be disposed to be positioned furthest from the fan duct 850. That is, one flow guider 4231*c* can be disposed on an opposite side of the fan duct 850 with respect to a center of the flow portion 4231.

The other flow guider 4231*c* can be disposed between the fan duct 850 and one flow guider 4231*c*, and can be disposed along one of the one direction C1 and the other direction C2.

The number and an arrangement of the flow guiders 4231*c* may not be limited thereto, and can be determined in consideration of a volume of the first flow space V1, a size of the drum rear surface 220, a speed of the hot air, and the like.

Figure 12:
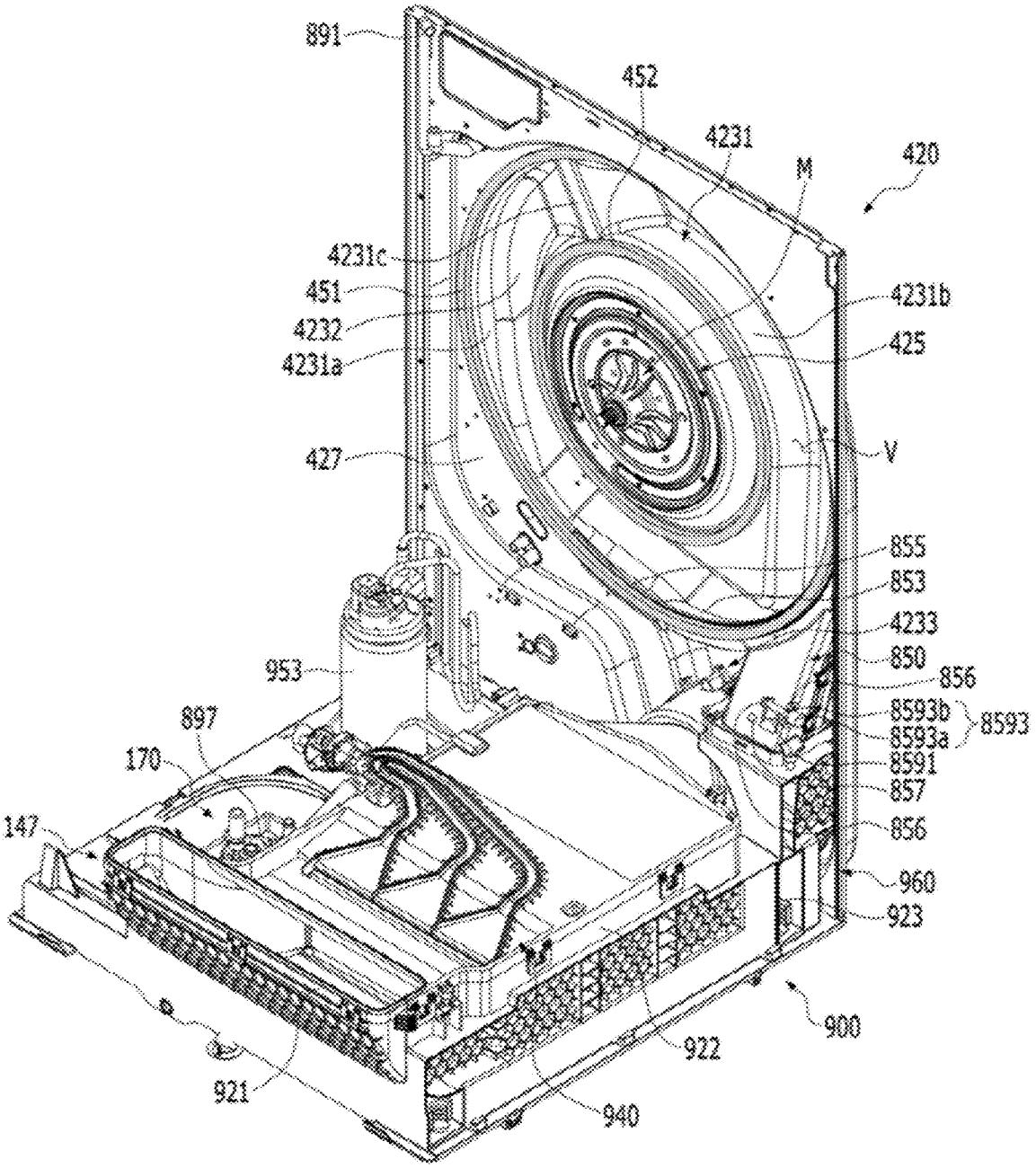
FIG. 12 is a view showing examples of a bypass hole and an opening adjusting portion.
Figure 13B:
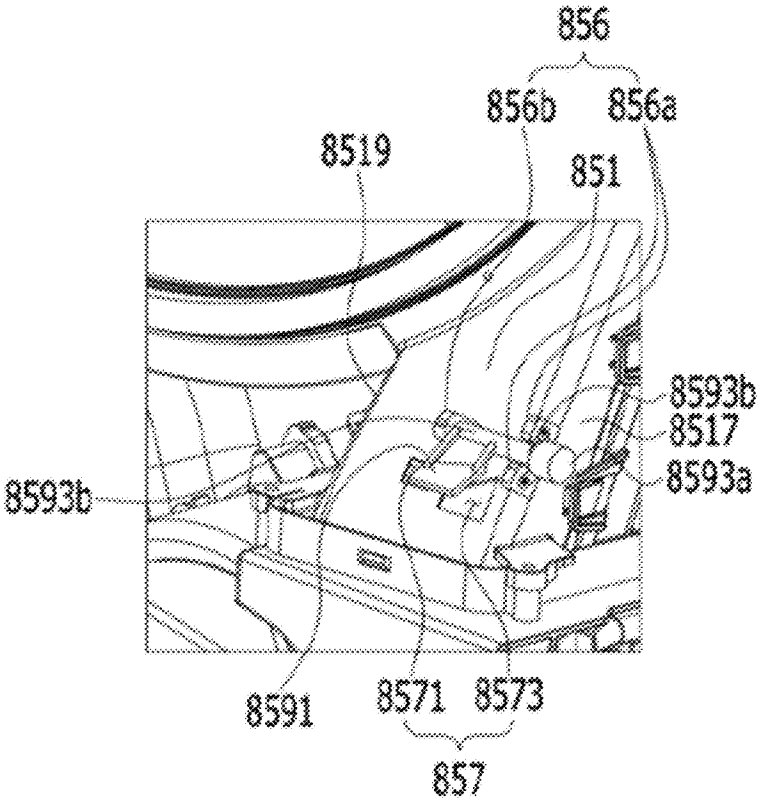
FIGS. 13A and 13B are enlarged views of the bypass hole and the opening adjusting portion in FIG. 12.
Figure 13A:
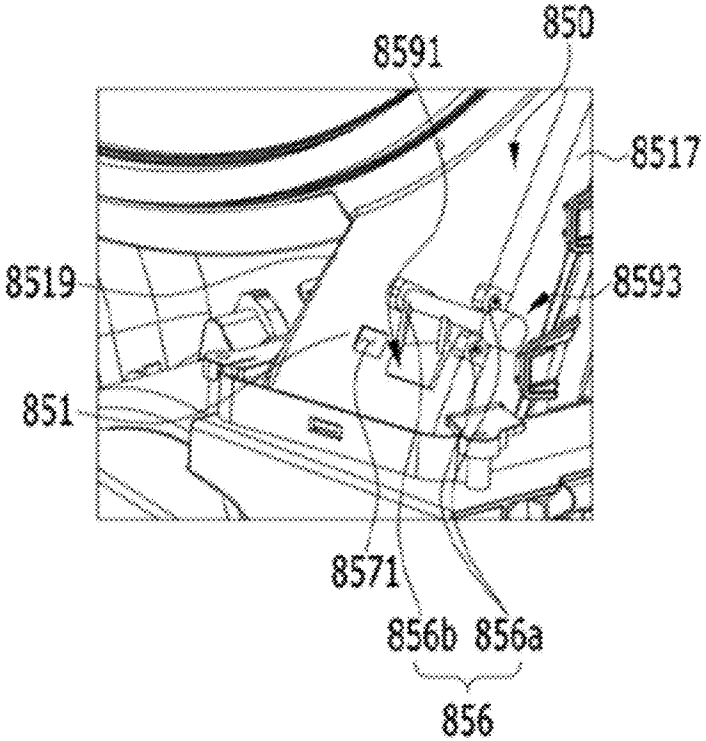

FIG. 12 is a view showing an example of a bypass hole and an opening adjusting portion. FIGS. 13A and 13B show enlarged views of a bypass hole and an opening adjusting portion in FIG. 12.

Specifically, FIG. 13A shows that the bypass hole is shielded by the opening adjusting portion, and FIG. 13B shows that the bypass hole is opened by the opening adjusting portion.

In some implementations, referring to FIG. 12 and FIG. 13A, the laundry treating apparatus can include a bypass hole 857 for discharging a portion of the hot air flowing inside the fan duct 850 to the outside of the fan duct 850.

As the drying progresses, the pressure inside the drum 200 can increase. The reason for the increase in the pressure inside the drum 200 can be various. For example, one reason can be that a temperature inside the drum 200 increases as the drying proceeds, and one reason can be that the water vapor inside the drum 200 increases as the drying proceeds.

In some implementations, the pressure inside the drum 200 can be effectively reduced through the bypass hole 857 defined in the fan duct 850.

As described above, with respect to the interior of the drum 200, the hot air discharged from the interior of the drum 200 can be introduced into the hot air flow channel 920, the water vapor can be removed and heated by the evaporator 951 and the condenser 952 in the hot air flow channel 920, the hot air can be guided to the blower 960 and flow into the fan duct 850 by being pressurized and accelerated by the blower 960, and the hot air can be discharged from the fan duct 850 and flow back into the drum 200 through the duct 423.

The bypass hole 857 can reduce a pressure at a rear end of the blower 960 connected to fan duct 850 by discharging a portion of the hot air that has been accelerated and pressurized by blower 960 and flowed into fan duct 850 to the outside.

Accordingly, circulation of the hot air can be promoted from a front end to the rear end of the blower 960, and the discharge of the hot air can be promoted inside the drum 200, which is in communication with the front end of the blower 960 through the hot air flow channel 920.

Therefore, the pressure inside the drum 200 can be reduced and the circulation of the hot air flowing through the circulation flow channel can be activated.

The bypass hole 857 can promote the circulation process in which the water vapor discharged from the laundry is condensed and the hot air is heated and supplied to the drum 200 again. Accordingly, the bypass hole 857 can increase the drying efficiency.

In addition, the bypass hole 857 can prevent the pressure inside the drum 200 from becoming a pressure equal to or higher than a certain pressure, so that formation of dew condensation resulted from the leakage of the water vapor to the outside of the drum 200 can be prevented as much as possible.

In some implementations, because the hot air discharged by the bypass hole 857 is in a state in which the lint and the water vapor are minimized, even when the hot air is discharged to the outside of drum 200, deterioration of a hygiene condition of the exterior of the drum 200 or the formation of the dew condensation can be prevented.

That is, the hot air flowing inside the fan duct 850 can be in a state of being re-heated by the condenser 952 after the water vapor is condensed and removed in the evaporator 951. Because the hot air flowing inside the fan duct 850 is in the state in which the water vapor has been removed as much as possible, even when the hot air is discharged to the outside of the drum 200, the formation of the dew condensation can be prevented as much as possible.

In addition, in the hot air flowing inside the fan duct 850, the lint can be removed by a filter, and the lint can be removed once more by the condensation of the water vapor in the evaporator 951. Because the hot air flowing inside the fan duct 850 is in the state in which the lint has been removed as much as possible, even when the hot air is discharged to the outside of drum 200, the deterioration of the hygiene condition can be prevented as much as possible.

The bypass hole 857 can be defined through one surface of the fan duct 850, and can communicate the interior of the fan duct 850 with the interior of the cabinet 100. A shape of the bypass hole 857 can be various such as a circle, a polygon, and the like depending on manufacturing conditions and usage conditions. FIG. 12 shows that the bypass hole 857 is in a rectangular shape, but the present disclosure is not limited thereto.

An area of the bypass hole 857 can be determined by considering various factors such as a size of the drum 200, a size of the fan duct 850, a laundry accommodating capacity of the drum 200, and the like. That is, the area of the bypass hole 857 can be determined through an experimental value.

In some implementations, the laundry treating apparatus can include an opening adjusting portion 859 for adjusting an opening degree of the bypass hole 857.

The opening adjusting portion 859 can be constructed to adjust the opening degree of the bypass hole 857, and can be controlled by a controller C, which will be described later. For example, the opening adjusting portion 859 can include a cover, a plate, a gate, or the like, and a rotational shaft.

An amount of water vapor evaporated from the laundry during the drying process can change, and the pressure inside the drum 200 can change depending on the temperature inside the drum 200 and the like. When the pressure inside the drum becomes a level equal to or higher than a certain level, it can be difficult to reduce the pressure inside the drum 200 when a size of the bypass hole 857 is small.

In addition, when the size of the bypass hole 857 is too great, a drying time can be increased or the hot air can be excessively discharged to the outside, so that the drying efficiency can be reduced. Accordingly, the opening adjusting portion 859 can increase the drying efficiency by adjusting the opening degree of the bypass hole 857.

Referring to FIG. 13B, the opening adjusting portion 859 can completely shield the bypass hole 857 to make the opening degree 0%, or can completely open the bypass hole 857 to make the opening degree 100%.

In some implementations, the bypass hole 857 can include an open hole 8571, which is defined to be open at all times, and an adjusted hole 8573 whose opening degree is adjusted by the opening adjusting portion 859.

The open hole 8571 can allow a certain amount of hot air flowing inside the fan duct 850 to be discharged to the outside of the drum 200 at all times. It can be advantageous in terms of the drying efficiency for the open hole 8571 to be opened over a certain area regardless of whether an amount of laundry to be dried is small or regardless of the drying operation. That is, the laundry open hole 8571 can have an open area for lowering the pressure inside the drum 200 to a pressure lower than a certain pressure when the minimum laundry is accommodated inside the drum 200.

The open hole 8571 can increase the drying efficiency by discharging the certain amount of hot air flowing inside the fan duct 850 to the outside at all times.

The area (size) of the open hole 8571 can be determined in consideration of the size of the drum 200, the size of the fan duct 850, the laundry accommodating capacity of the drum 200, the drying time, and the like. For instance, the area of the open hole 8571 can be determined to be an area improving the drying efficiency and with which the change in the drying time is not large in an optimal state in which a small amount of laundry is dried or the filter may not be clogged. The area of the open hole 8571 can be determined by the experimental value based on the above description.

The opening degree of the adjusted hole 8573 can be increased by the opening adjusting portion 859 to increase the amount of hot air discharged when the amount of hot air discharged by the open hole 8571 is insufficient, and accordingly, the drying efficiency can be increased. The area of the adjusted hole 8573 can be determined in consideration of the area of the open hole 8571, the size of the drum 200, the size of the fan duct 850, the laundry accommodating capacity of the drum 200, the drying time, and the like.

In summary, the bypass hole 857 can have the open hole 8571 and the adjusted hole 8573 separately to change the opening degree of the adjusted hole 8573 to change a total open area of the bypass hole 857. That is, the bypass hole 857 can increase the drying efficiency as an opening and closing operation of the opening adjusting portion 859 is minimized, and can prevent the pressure of inside the drum 200 from becoming the pressure equal to or higher than the certain pressure.

In some implementations, the adjusted hole 8573 can be spaced apart from the open hole 8571, and can be defined through one surface of the fan duct body 851. A separation distance between the adjusted hole 8573 and the open hole 8571 can be determined in consideration of a structural rigidity of one surface of the fan duct body 851 and in consideration of the size and the arrangement of the opening adjusting portion 859 for opening and closing the adjusted hole 8573.

One surface of the fan duct body 851 can be set as a surface whose contact with other components are prevented as much as possible in consideration of installation of the opening adjusting portion 859 among surfaces forming the circumference of the fan duct body 851.

For convenience of description, the fan duct body 851 will be briefly described. The fan duct body 851 can include a rear surface facing the rear plate 420, a front surface spaced forwardly apart from the rear surface, and both side surfaces connecting the front surface and the rear surface to each other.

One side surface disposed close to the first side plate 1411 among the both side surfaces of the fan duct body 851 can be referred to as a first fan duct side surface 8517, and the other side surface disposed close to the second side plate 1412 can be referred to as a second fan duct side surface 8519.

For example, FIG. 12 shows that the adjusted hole 8573 and the open hole 8571 are defined in the front surface of the fan duct body 851. That is, a space can be defined between the front surface of the fan duct body 851 and the drum 200, and the opening adjusting portion 859 can be easily disposed in the defined space.

In some implementations, the adjusted hole 8573 can be defined to be positioned as far as possible from the drum 200. As the adjusted hole 8573 is positioned as far as possible from the drum 200, the opening adjusting portion 859 that adjusts the opening degree of the adjusted hole 8573 can also be defined as far as possible from the drum 200, so that a sufficient space can be secured from the drum 200.

For example, in FIG. 12, the fan duct body 851 can be located close to the first side plate 1411 from the center of the drum 200, and the adjusted hole 8573 can be defined in a portion adjacent to the first side plate 1411 of the front surface of the fan duct body 851.

In some implementations, referring back to FIGS. 9A to 9D and 13A and 13B, the adjusted hole 8573 can be defined in a portion with a gentle inclination of one surface of the fan duct body 851.

As described above, one surface of the fan duct body 851 can be the front surface of the fan duct body 851.

Specifically, the first fan duct side surface 8517 can extend with a rearwardly inclined degree smaller than that of the second fan duct side surface 8519 in the fan duct inlet 8511. The front surface of the fan duct body 851 shielding the first fan duct side surface 8517 and the second fan duct side surface 8519 can be constructed to have an inclination decreasing in a direction toward the first fan duct side surface 8517 from the second fan duct side surface 8519.

Accordingly, the front surface of the fan duct body 851 can have a gentle inclination in a portion adjacent to the first fan duct side surface 8517, and the adjusted hole 8573 can be defined in the portion adjacent to the first fan duct side surface 8517 of the front surface of the fan duct body 851.

The reason that the front surface of the fan duct body 851 has the gentle inclination in the portion adjacent to the first fan duct side surface 8517 can be various. For example, as described above, the adjusted hole 8573 can be defined in the portion adjacent to the first fan duct side surface 8517 of the front surface of the fan duct body 851 for efficient arrangement of the opening adjusting portion 859, and the portion adjacent to the first fan duct side surface 8517 of the front surface of the fan duct body 851 can be designed to have the gentle inclination.

The adjusted hole 8573 can be defined in the portion with the gentle inclination of one surface of the fan duct body 851 and can be easily opened and closed by an opening and closing portion 8591 of the opening adjusting portion 859 to be described later. It can be easy to manufacture the opening and closing portion 8591 to correspond to the adjusted hole 8573.

In some implementations, the front surface of the fan duct body 851 can be more inclined in a direction toward the fan duct outlet 8515, and the adjusted hole 8573 can extend such that a width thereof decreases toward the fan duct outlet 8515 corresponding thereto.

In addition, as described above, the adjusted hole 8573 can be defined in the portion adjacent to the first side plate 1411 of the front surface of the fan duct body 851 for the efficient arrangement of the opening adjusting portion 859, and the portion adjacent to the first fan duct side surface 8517 of the front surface of the fan duct body 851 can be designed to have the gentle inclination.

In some implementations, referring to FIG. 13, the opening adjusting portion 859 can include an opening degree adjusting motor 8593 disposed outwardly of the fan duct body 851 and spaced apart from the drum 200 as much as possible.

For convenience of description, the opening adjusting portion 859 will be described first. The opening adjusting portion 859 can include the opening and closing portion 8591 defined in a shape corresponding to the adjusted hole 8571, and an opening degree adjusting driver 8593 that provides power to rotate the opening and closing portion 8591.

The opening degree adjusting driver 8593 can include an opening degree adjusting motor 8593*a*, and an opening degree adjusting rotation shaft 8593*b* connected to the opening degree adjusting motor 8593*a*. The opening degree adjusting motor 8593*a* can rotate the opening degree adjusting rotation shaft 8593*b*, and the opening and closing portion 8591 connected to the opening degree adjusting rotation shaft 8593*b* can be rotated by the opening degree adjusting rotation shaft 8593*b*. A type of the opening degree adjusting motor 8593*a* can be varied. For example, the opening degree adjusting motor 8593*a* can be a stepping motor.

The opening degree adjusting motor 8593 can have a certain volume, and can be damaged when being in contact with the rotating drum 200. The opening degree adjusting motor 8593 can be disposed in an empty space outside the fan duct body 851 to utilize a dead space inside the cabinet 100, and can be separated from the drum 200 as much as possible to prevent contact with drum 200 in advance.

In addition, depending on the position of the opening degree adjusting motor 8593*a*, the opening degree adjusting rotation shaft 8593*b* and an adjusting support 856 can be sufficiently spaced apart from the drum 200 as a whole, so that the contact of the opening adjusting portion 859 with the drum 200 can be prevented in advance.

For example, referring to FIG. 13, the opening degree adjusting motor 8593*a* can be disposed between the first fan duct side surface 8517 and the first fan duct plate 1411, and the opening degree adjusting rotation shaft 8593*b* can extend to be away from the first fan duct plate 1411 from the opening degree adjusting motor 8593 to be connected to the opening and closing portion 8591 disposed at a position corresponding to the adjusted hole 8573.

In addition, the fan duct 850 can include the adjusting support 856 constructed to support the opening degree adjusting driver 8593. The adjusting support 856 can include a first adjusting support 856*a* that can protrude from one surface of the fan duct body 851 and supports the motor, and a second adjusting support 856*b* for supporting the opening degree adjusting rotation shaft 8593*b*.

The first adjusting support 856*a* can be disposed in a portion in contact with the front surface of the fan duct body 851 and the first fan duct side surface 8517, and can be coupled to the opening degree adjusting motor 8593*a* disposed between the first fan duct side surface 8517 and the first fan duct plate 1411.

The first adjusting support 856*a* can be penetrated by a separate fastening member to fix the opening degree adjusting motor 8593*a*. The first adjusting support 856*a* can include a plurality of first adjusting supports 856*a* that are spaced apart from each other in a longitudinal direction of the fan duct body 851, and the opening degree adjusting motor 8593*a* can be disposed between the first adjusting supports 856*a* and coupled to the first adjusting supports 856*a*.

The second adjusting support 856*b* can be disposed on the front surface of the fan duct body 851, and coupled with the opening degree adjusting rotation shaft 8593*b* extending from the opening degree adjusting motor 8593*a* through a portion between the first adjusting supports 856*a*. The second adjusting support 856*b* can be penetrated by a separate fastening member to fix the opening degree adjusting rotation shaft 8593*b*.

That is, the adjusting support 856 can provide supporting and coupling forces to the entire opening degree adjusting portion 859.

Figure 14:
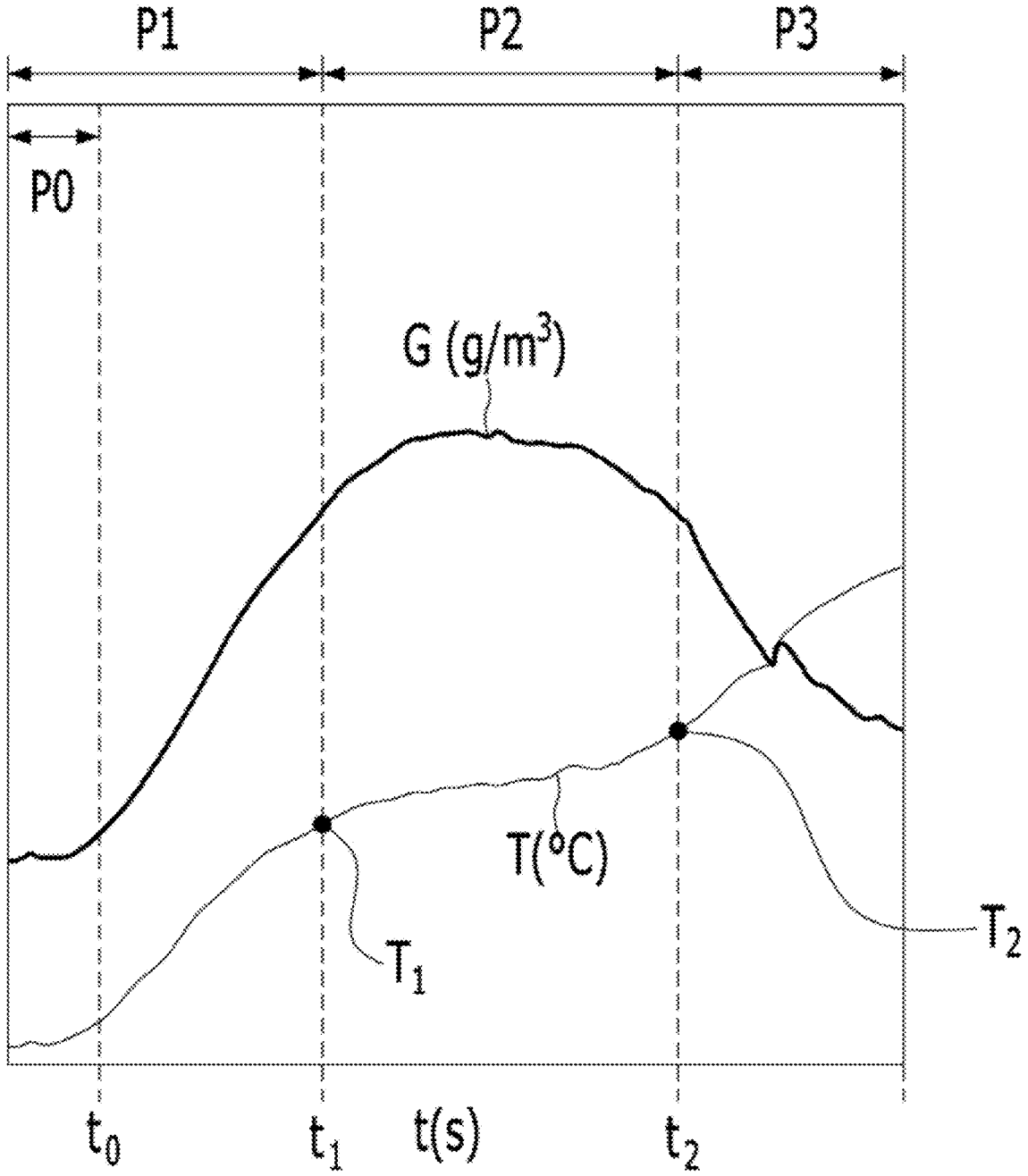
FIG. 14 is a graph showing an example of an evaporation amount and an internal temperature of a drum of a drying operation.

In some implementations, FIG. 14 is a graph showing an evaporation amount and an internal temperature of a drum of each drying operation.

Referring to FIGS. 12 to 14, in the laundry treating apparatus, the opening degree of the bypass hole 857 can be adjusted based on the amount of laundry.

Specifically, the laundry treating apparatus 10 can include the controller C for controlling the driver M, the hot air supply 900, and the opening adjusting portion 859. Specifically, the controller C can control the compressor 953, the blower fan 961, and the like. In addition, the controller C can perform the drying operation of the laundry treating apparatus 10. For example, the controller C can include an electric circuit, a processor, or the like.

The controller C can control the opening adjusting portion 859 to adjust the opening degree of the bypass hole 857 based on the amount of laundry. Specifically, the amounts of laundry can be classified through a reference weight of the laundry. That is, the controller C can determine that the amount of laundry is small when the amount of laundry is less than the reference weight. In addition, the controller C can determine that the amount of laundry is large when the amount of laundry is greater than the reference weight. The reference weight can be determined in consideration of the size of drum 200, the laundry accommodating capacity of the drum 200, the amount of water vapor generated inside the drum 200, the pressure inside the drum 200, and the like. That is, the reference weight can be derived from an experimental value.

An amount of water vapor generated by being evaporated from the laundry when the controller C determines that the amount of laundry is small can be relatively less than an amount of water vapor generated by being evaporated from the laundry when the controller C determines that the amount of laundry is large. Accordingly, the increase in the internal pressure of drum 200 can be relatively small. That is, the drying efficiency of the drum 200 can be increased only with the amount of hot air discharged by the open hole 8571. In addition, the internal pressure of the drum 200 can be prevented from becoming the pressure equal to or higher than the certain pressure only with the amount of hot air discharged by the open hole 8571. Furthermore, the drum 200 can be prevented from increasing the drying time only with the amount of hot air discharged by the open hole 8571.

In some implementations, the amount of water vapor generated by being evaporated from the laundry when the controller C determines that the amount of laundry is large can be relatively larger than the amount of water vapor generated by being evaporated from the laundry when the controller C determines that the amount of laundry is small. Accordingly, the increase in the internal pressure of drum 200 can be relatively large. That is, it can be difficult for the drum 200 to increase the drying efficiency only with the amount of hot air discharged by the open hole 8571. In addition, it can be difficult for the drum 200 to maintain the internal pressure at the pressure equal to or lower than the certain pressure only with the amount of hot air discharged by the open hole 8571. Furthermore, it can be difficult for the drum 200 to prevent the increase in the drying time only with the amount of hot air discharged by the open hole 8571.

That is, the controller C can efficiently adjust the opening degree of the adjusted hole 8573 by determining the amount of laundry. Specifically, the controller C can increase the drying efficiency by adjusting the total open area of the bypass hole 857 based on the amount of laundry. In addition, the controller C can prevent the internal pressure of the drum 200 from becoming the pressure equal to or higher than the certain pressure.

Accordingly, the drying operation can include a laundry amount determination process P0. The laundry amount determination process P0 can be a process in which the controller C determines the amount of laundry accommodated in the drum 200. In addition, the laundry amount determination process P0 can be performed within a laundry amount reference time t0 after the laundry is accommodated in the drum 200 and the drying operation is started. The drying operation can be started by a method of pressing, by the user, a start button or the like. That is, the controller C can sense the amount of laundry in the laundry amount determination process P0 and determine an approximate time, a progress method, and the like of the drying operation. In addition, the controller C can determine whether to adjust the opening degree of the bypass hole 857 described above.

The controller C can determine the amount of laundry through an amount of current of the driver M in the laundry amount determination process P0. That is, the current can flow through the driver M to rotate the drum 200. The amount of current of the driver M can increase as the amount of laundry accommodated in the drum 200 increases. Accordingly, the controller C can determine the amount of laundry through the amount of current of the driver M.

In addition, the controller C can determine that the amount of laundry accommodated in the drum 200 is large when the amount of current of driver M is equal to or greater than a reference current amount. In addition, the controller C can control the opening adjusting portion 859 to adjust the opening degree of the bypass hole 857 when the amount of current of the driver M is equal to or greater than the reference current amount.

The reference current amount can refer to an amount of current with which the driver M rotates the drum with the reference weight described above. That is, the reference current amount can be derived from an experimental value. In addition, the reference current amount can be determined in consideration of the size of the drum 200, the laundry accommodating capacity of the drum 200, the amount of water vapor generated inside the drum 200, the pressure inside the drum 200, and the like.

The controller C can adjust the opening degree of the bypass hole 857 when the amount of laundry is large.

In some implementations, the laundry treating apparatus can vary the opening degree of the bypass hole for each drying operation.

That is, the laundry treating apparatus can vary the opening degree of the bypass hole 857 for each drying operation to respond flexibly to the change in the amount of water vapor evaporated in the laundry inside the drum 200 and the change in the pressure inside the drum 200 depending on the drying operation.

Referring back to FIG. 14, the drying operation can include a preheating process. A preheating process P1 can be a process in which the operation of the hot air supply 900 is started.

The refrigerant circulating in the heat pump 950 can be started to be compressed by the compressor 953 at high temperature and high pressure. In addition, the refrigerant discharged from the compressor 953 can pass through the condenser 952 to heat the hot air. In addition, the refrigerant that has passed through the condenser 952 can be decompressed through the expansion valve. In addition, the refrigerant that has passed through the expansion valve can flow into the evaporator 951. The evaporator 951 can condense the water vapor from the hot air discharged from the drum 200 and containing a large amount of water vapor. The refrigerant that has passed through the evaporator 951 can be introduced into the compressor 953 again and compressed. The refrigerant can increase in temperature through a series of circulation processes. Accordingly, the heat pump 950 can condense the water vapor discharged from the laundry through the evaporator 951 and supply the hot air heated back into the drum 200 through the condenser 952.

The preheating process P1 can be a process in which the temperature of the refrigerant increases as the circulation process of the heat pump 950 described above proceeds and the temperature inside the drum 200 increases based on the supply of the hot air. In addition, the preheating process P1 can be a process in which the moisture contained in the laundry is evaporated to become the water vapor. In addition, the preheating process P1 can be a process in which an evaporation amount inside the drum 200 (the amount of water vapor formed as the moisture in the laundry is evaporated) is less than a certain amount. Furthermore, the preheating process P1 can be a process in which the evaporation amount inside the drum 200 is increased. The evaporation amount inside the drum 200 can be used in the same meaning as the evaporation amount in the laundry.

The preheating process P1 is a process in which the moisture starts to evaporate from the laundry and the interior of the drum 200 is heated by the hot air. In the preheating process P1, the pressure inside the drum 200 can be relatively low. Accordingly, the preheating process P1 can increase the drying efficiency with the hot air flowing out through the open hole 8571, and can prevent the pressure inside the drum 200 from becoming the pressure equal to or higher than the certain pressure.

Accordingly, when the preheating process P1 is performed, the controller C can control the opening adjusting portion 859 such that the adjusted hole 8573 is shielded. When the adjusted hole 8573 is shielded at the start of the drying operation, the controller C may not control the opening adjusting portion 859, so that it is possible to maintain the shielded state of the adjusted hole 8573. As a result, the controller C can prevent the opening of the adjusted hole 8573, so that it is possible to prevent the reduction of the drying efficiency or the increase in the drying time occurring as the hot air flows out more in the state in which the pressure inside the drum 200 is low.

In addition, the drying operation P can include a main drying process P2 that is performed after the preheating process P1. The main drying process P2 can be in a state in which the circulation process of the heat pump 950 has sufficiently progressed and the temperature of the refrigerant is increased to the maximum. The main drying process P2 can be a process in which the temperature inside the drum 200 is sufficiently raised by the hot air. In addition, in the main drying process P2, the evaporation of the moisture from the laundry can be actively performed. That is, the main drying process P2 can be a process in which the evaporation amount inside the drum 200 is equal to or greater than a certain amount. In addition, the main drying process P2 can be a process in which the evaporation amount inside the drum 200 is maintained at an amount equal to or higher than the certain amount.

The main drying process P2 is a process in which the interior of the drum 200 is sufficiently heated by the hot air as the moisture is maximally evaporated from the laundry. In the main drying process P2, the pressure inside the drum 200 can be relatively high. Accordingly, in the main drying process P2, even when the hot air flows out through the open hole 8571, because the pressure inside the drum 200 is high, the circulation of the hot air may not be smooth. In addition, in the main drying process P2, even when the hot air leaks through the open hole 8571, the internal pressure of the drum 200 can become the pressure equal to or higher than the certain pressure, and the lint and the water vapor can leak out of the drum 200.

Accordingly, the controller C can control the opening adjusting portion 859 to open the adjusted hole 8573 when the main drying process P2 is performed. At the start of the drying operation, the adjusted hole 8573 is shielded, and the shielding of the adjusted hole 8573 can be configured to be maintained in the preheating process P1. Accordingly, the controller C can control the opening adjusting portion 859 to open the adjusted hole 8573. Accordingly, the controller C can open the adjusted hole 8573 to increase the drying efficiency as the hot air flows out more while the pressure inside the drum 200 is high. In addition, the controller C can prevent the lint and the water vapor from leaking to the outside of the drum 200 by preventing the internal pressure of the drum 200 from becoming the pressure equal to or higher than the certain pressure.

In addition, the drying operation P can include an amount decreasing drying process P3 that is performed after the main drying process P2. In addition, the amount decreasing drying process P3 can be a process in which the moisture has been sufficiently evaporated from the laundry and there is little moisture remaining in the laundry. That is, the amount decreasing drying process P3 can be a process in which the evaporation amount inside the drum 200 is less than a certain amount. In addition, the amount decreasing drying process P3 can be a process in which the evaporation amount inside the drum 200 is reduced.

The amount decreasing drying process P3 has little moisture remaining in the laundry, so that the laundry can be damaged when a large amount of hot air is supplied or high-temperature hot air is supplied. In addition, the amount decreasing drying process P3 has little moisture remaining in the laundry, so that the drying efficiency may not increase even when the large amount of hot air is supplied or the high-temperature hot air is supplied. Accordingly, the controller C can decrease the temperature of the refrigerant by reducing the output of the compressor 953 in the amount decreasing drying process P3. In addition, the controller C can reduce the amount of hot air flowing into drum 200 by controlling the operation of the blower fan 961 in the amount decreasing drying process P3.

The amount decreasing drying process P3 is in the state in which the moisture is sufficiently removed from the laundry. In the amount decreasing drying process P3, the amount of water vapor inside the drum 200 can be relatively small and can be continuously reduced. That is, in the amount decreasing drying process P3, the pressure inside the drum 200 can be relatively low. In the amount decreasing drying process P3, the drying efficiency can be sufficiently increased only with the hot air flowing out through the open hole 8571, and the pressure inside the drum 200 can be prevented from becoming the pressure equal to or higher than the certain pressure.

Accordingly, when the amount decreasing drying process P3 is performed, the controller C can control the opening adjusting portion 859 such that the adjusted hole 8573 is shielded. When the adjusted hole 8573 is opened during the main drying process P2, the controller C can control the opening adjusting portion 859 to shield the adjusted hole 8573. As a result, the controller C can shield the adjusted hole 8573 to prevent the drying efficiency from being reduced or the drying time from being increased as the hot air flows out more in the state in which the pressure inside the drum 200 is low.

In some implementations, there can be several methods for the controller C to determine the drying operation. The laundry treating apparatus can include a temperature sensor 151 for measuring the temperature of the hot air discharged from the drum 200. Referring to FIG. 2, the temperature sensor 151 can be disposed between a rear end of the filter and a front end of the evaporator.

Referring back to FIG. 14, when a measured value of the temperature sensor 151 is in a range from the first reference temperature T1 and the second reference temperature T2, the controller C can determine that a current process is the main drying process P2. That is, in the preheating process P1, the evaporation amount inside the drum 200 can be small, and the hot air can consume heat energy to heat the interior of the drum 200. In other words, the heat energy can be used to heat the air inside drum 200, rather than the heat energy is used to evaporate the moisture with high specific heat. Accordingly, the temperature of the hot air discharged from the drum 200 can be increased, and an increasing inclination of the temperature can be relatively high.

In the main drying process P2, most of the heat energy of the hot air supplied to the drum 200 can be used for the evaporation of the moisture from the laundry. That is, the heat energy of the hot air can be used for the evaporation of the moisture with the high specific heat. Accordingly, the temperature of the hot air discharged from the drum 200 can be increased, and the increasing inclination of the temperature can be decreased.

The first reference temperature T1 can be a temperature at which a temperature increase rate of the hot air discharged from the drum 200 is reduced. That is, the first reference temperature T1 can be a temperature at which most of the heat energy of the hot air is used to evaporate the moisture of the laundry and the drying of the laundry starts to occur most actively.

When the main drying process P2 continues, most of the moisture in the laundry can be evaporated, so that the amount of moisture with the high specific heat inside the drum 200 can be reduced. Accordingly, the temperature of the hot air discharged from the drum 200 can be increased, and the temperature increase rate can be increased again.

The second reference temperature T2 can be a temperature at which the temperature increase rate of the hot air discharged from the drum 200 is increased again. That is, the second reference temperature T2 can be a temperature at which most of the moisture of the laundry is evaporated and the heat energy of the hot air starts to increase the temperature inside the drum 200.

In summary, the controller C can determine that the current process is the preheating process P1 when the temperature of the hot air discharged from the drum 200 is lower than the first reference temperature T1. In addition, the controller C can determine that the current process is the main drying process P2 when the temperature of the hot air discharged from the drum 200 is equal to or higher than the first reference temperature T1 and equal to or lower than the second reference temperature T2. Furthermore, the controller C can determine that the current process is the amount decreasing drying process P3 when the temperature of the hot air discharged from the drum 200 exceeds the second reference temperature T2.

The controller C can control the opening adjusting portion 859 to increase the opening degree of the bypass hole 857 when the temperature of the hot air discharged from the drum 200 is equal to or higher than the first reference temperature T1. The controller C can control the opening adjusting portion 859 to decrease the opening degree of the bypass hole 857 when the temperature of the hot air discharged from the drum 200 exceeds the second reference temperature T2.

In other words, temperature increase rates (gradients) in the preheating process P1 and the amount decreasing drying process P3 can have similar shapes. In addition, the temperature increase rates (the gradients) in the preheating process P1 and the amount decreasing drying process P3 can represent values greater than a temperature increase rate (a gradient) in the main drying process P2. This is because, as described above, in the main drying process P2, the moisture contained in the laundry with the high specific heat is evaporated and the temperature increase rate is small.

The first reference temperature T1 and the second reference temperature T2 can be determined by experimental values. That is, the first reference temperature T1 and the second reference temperature T2 can be determined in consideration of the size of the drum 200, a performance of the heat pump 950, the laundry accommodating capacity of the drum 200, and the like.

In some implementations, the controller C can use an electrode sensor for accurate and efficient opening and closing of the bypass hole 857. Specifically, referring to FIG. 2, an electrode sensor 153 for measuring the amount of moisture in contact with the laundry can be disposed inside the drum 200. The electrode sensor 153 can be disposed in the drum 200 to measure the amount of moisture of the laundry accommodated inside the drum 200. For example, the electrode sensor 153 can include a pair of electrodes and can measure the amount of moisture in the laundry by analyzing conduction characteristics occurred in the pair of electrodes when in contact with the laundry. The lower the measured value of the electrode sensor 153, the higher the amount of moisture in the laundry, and the higher the measured value of the electrode sensor, the lower the amount of moisture in the laundry.

The controller C can more accurately distinguish between the main drying process P2 and the amount decreasing drying process P3 by utilizing the measured value of the electrode sensor 153 as auxiliary means of the measured value of the temperature sensor 151. That is, when the measured value of the temperature sensor 151 exceeds the second reference temperature T2 and the measured value of the electrode sensor 153 is equal to or higher than a reference electrode value, the controller C can determine that the current process is the amount decreasing drying process P3. That is, the controller C can more accurately determine the main drying process P2 and the amount decreasing drying process P3. Accordingly, the controller C can more accurately adjust the opening degree of the adjusted hole 8573. As a result, the drying efficiency can be further increased and the leakage of the lint and the water vapor to the outside of the drum can be prevented more effectively. The reference electrode value can be determined by an experimental value. That is, the reference electrode value can be determined in consideration of the size of the drum 200, the performance of the heat pump 950, the laundry accommodating capacity of the drum 200, and the like.

When the measured value of the temperature sensor 151 exceeds the second reference temperature T2 and the measured value of the electrode sensor 153 is equal to or higher than the reference electrode value, the controller C can control the opening adjusting portion 859 to decrease the opening degree of the bypass hole 857.

In addition, the classification of the drying operation can be performed based on time. That is, the controller C can determine that the current process is the preheating process P1 when it is within a first reference time t1 after the start of the drying operation. In addition, the controller C can determine that the current process is the main drying process P2 when it is between the first reference time t1 and a second reference time t2 after the drying operation starts. Furthermore, the controller C can determine that the current process is the amount decreasing drying process P3 when it is after the second reference time t2.

The first reference time t1 and the second reference time t2 can be determined by experimental values. That is, the first reference time t1 and the second reference time t2 can be determined in consideration of the size of the drum 200, the performance of the heat pump 950, the laundry accommodating capacity of the drum 200, and the like.

Furthermore, the classification of the drying operation can be made with an operation efficiency. The operation efficiency corresponds to an actual evaporation amount to a theoretical maximum evaporation amount that can occur inside the drum 200. For the operation efficiency, the theoretical maximum evaporation amount can be calculated from a difference between a maximum absolute humidity for the current temperature of the air (the hot air) discharged from the drum 200 and a humidity amount of the air (the hot air) supplied into the drum 200, and the actual evaporation amount can be calculated from a difference between an actual absolute humidity of the air (the hot air) discharged from the drum 200 and the humidity amount of the air (the hot air) supplied into the drum 200. That is, the preheating process P1 can be a drying operation to increase the operation efficiency. In addition, the main drying process P2 can be a drying operation in which the drying of the laundry is in progress while maintaining the operation efficiency that has increased rapidly in the preheating process P1. The main drying process P2 can be a maximum region in which the operation efficiency no longer increases or an increase amount thereof may be meaningless. The amount decreasing drying process P3 can be a drying operation in which the operation efficiency decreases by the decrease in the amount of moisture in the laundry itself.

The operation efficiency can be determined by an experimental value. That is, the operation efficiency can be determined in consideration of the size of the drum 200, the performance of the heat pump 950, the laundry accommodating capacity of the drum 200, and the like.

In the main drying process P2, the adjusted hole 8573 can be opened 100% during the drying operation. In the main drying process P2, the open area of the bypass hole 857 can be the largest. When a rotation speed (the number of rotations) of the blower fan 961 is kept constant, a large amount of hot air can be discharged to the outside through the bypass hole 857 when the pressure inside the drum 200 is high. The main drying process P2 may cause waste of the hot air.

When the opening degree of the adjusted hole 8573 is increased, the controller C can control the blower fan 961 such that the rotation speed (the number of rotations) of the blower fan 961 is reduced. The controller C can reduce the rotation speed of the blower fan 961 to help prevent power loss.

Figure 15B:
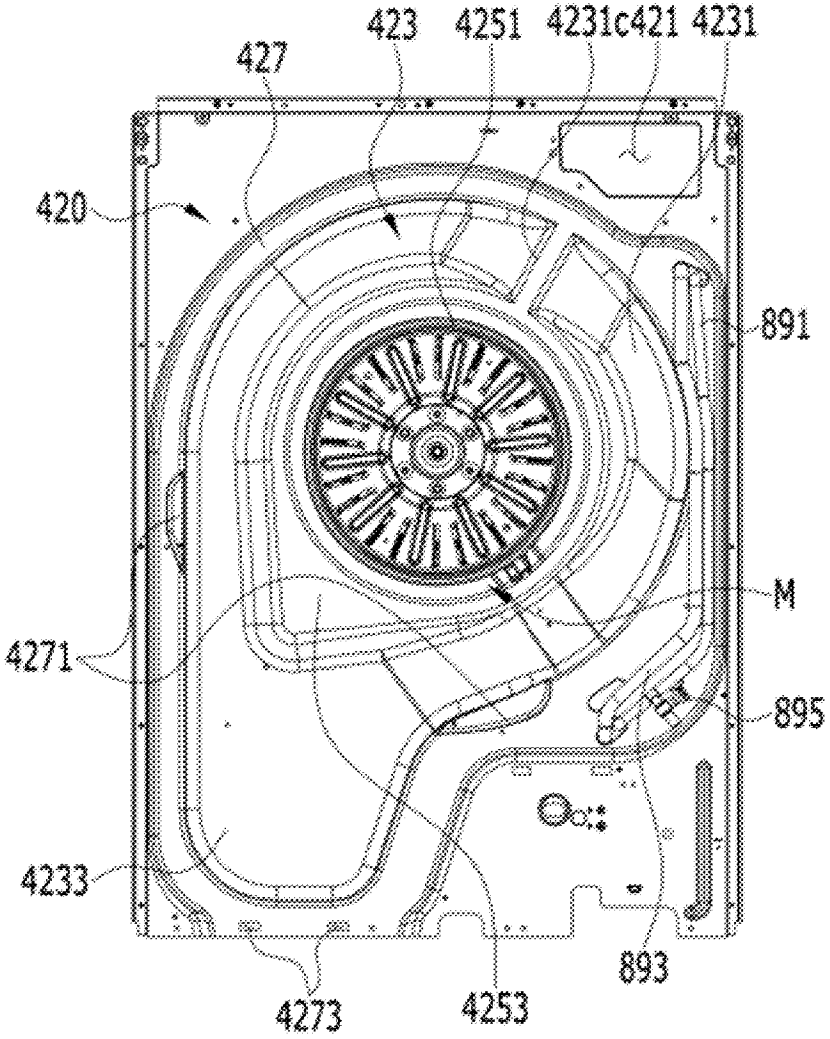
FIGS. 15A and 15B are views showing an example of a rear cover.
Figure 15A:
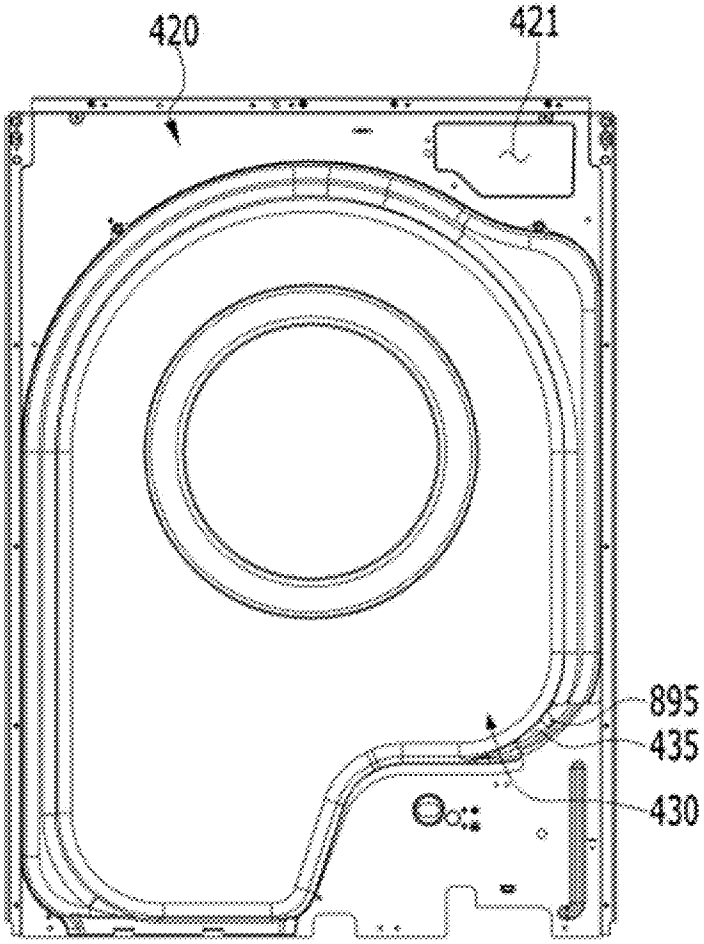

In some implementations, FIG. 15 is a view showing a rear cover.

Referring to FIG. 15, the laundry treating apparatus can include a rear cover 430 covering the rear plate 420.

The rear cover 430 can be constructed to cover the duct 423 and the driver M to prevent the duct 423 and the driver M from being exposed to the outside.

The rear cover 430 can prevent the damage that can occur as the driver M is coupled to the rear plate 420 from the rear and the driver M is exposed to the outside. In addition, as the duct 423 of the rear cover 430 can be heated by the flow of the hot air, a risk of burns and injuries caused by the user coming into contact with the rear plate 420 can be reduced.

The rear cover 430 can be formed in a shape at least partially corresponding to the duct 423. That is, the rear cover 430 can be constructed to cover a portion of the rear plate 420.

As the duct 423 protrudes rearwards, the duct 423 can be a portion of the rear plate 420 with the highest probability of direct contact with the user. In addition, the duct 423 can be a portion heated with the highest temperature of the rear plate 420 because a space for the hot air to flow is defined therein.

Accordingly, the rear cover 430 can be constructed to cover the duct 423 by being formed in a shape at least partially corresponding to the duct 423. The rear cover 430 can have a minimum volume, so that an economic efficiency can be increased.

In addition, the driver M can be disposed to be surrounded by the rear surface of the duct 423 at a center of the duct 423. When the rear cover 430 is formed in the shape at least partially corresponding to the duct 423 to cover the duct 423, the driver M can also be covered. Accordingly, the rear cover 430 can be constructed to cover the driver M and the duct 423 while minimizing the volume to prevent the injury to the user and protect the driver M from external impact.

In some implementations, referring back to FIG. 6, the rear plate 420 can include a mounting portion 425 to which the driver M is coupled and seated. The mounting portion 425 can be defined inwardly of the flow portion 4231. That is, the mounting portion 425 can be defined to be surrounded by the flow portion 4231.

The mounting portion 425 can include a mounting accommodating portion 4251 disposed at a center of the mounting portion 425. Further, the mounting portion 425 can include a mounting circumferential portion 4253 that surrounds the mounting accommodating portion 4251 and is connected to the flow portion 4231. The mounting accommodating portion 4251 can protrude frontwards than the mounting circumferential portion 4253. Accordingly, the driver M can be accommodated in and coupled to the mounting accommodating portion 4251.

Specifically, the mounting accommodating portion 4251 can include a mounting hole 4255 defined through a center thereof. The driver M can be connected to the drum rear surface 220 via the mounting hole 4255. Additionally, the mounting accommodating portion 4251 can include a mounting surface 4251*a* in with the mounting hole 4255 is defined and onto which the driver M is coupled. The mounting surface 4251*a* can be formed in a circular shape, and the mounting hole 4255 can be defined in a circular shape through the center of the mounting surface 4251*a*. The driver M can be accommodated in the mounting accommodating portion 4251 and protected from the external impact by the mounting accommodating portion 4251.

In addition, the mounting accommodating portion 4251 can include a mounting connecting portion 4257 that extends rearwards from the mounting surface 4251*a* and is connected to the mounting circumferential portion 4253.

The mounting connecting portion 4257 can face an outer circumferential surface of the driver M, and can be prevented from being in contact with the driver M. The mounting connecting portion 4257 can be extended to increase in diameter rearwardly from the mounting surface 4251*a*. The mounting connecting portion 4257 can protect the driver M from the external impact, and can be prevented from being in contact with the driver as much as possible.

The mounting accommodating portion 4251 can include mounting supports 4251*d* and 4251*e* that protrude rearwards from the mounting surface 4251*a* in an annular shape. The mounting supports 4251*d* and 4251*e* can increase a structural rigidity of the mounting surface 4251*a*.

A plurality of mounting supports 4251*d* and 4251*e* can be disposed to be radially spaced apart from each other. Accordingly, it is possible to further increase the structural rigidity of the mounting surface 4251*a*. A partial section of the mounting supports 4251*d* and 4251*e* can be prevented from protruding such that a terminal of a stator 510 can be positioned. In addition, the mounting accommodating portion 4251 can have a wire support groove 4251*c* defined in the mounting connecting portion 4257. The wire support groove 4251*c* can support a wire connected to a terminal 516 to prevent the wire from interfering with other components.

The mounting circumferential portion 4253 can be connected to the flow inner circumferential portion 4231*b*. A portion in the rear plate 420 at which the flow portion 4231 begins to be recessed can be an outer circumference of the mounting circumferential portion 4253. The mounting accommodating portion 4251 can protrude frontwards than the flow portion 4231.

The mounting circumferential portion 4253 can include a mounting circumferential body 4253*a* having a circular cross-section. The mounting circumferential portion 4253 can include a mounting circumferential guide portion 4253*b* that protrudes toward the fan duct 850. The mounting circumferential guide portion 4253*b* can extend toward the fan duct 850 in a straight line from specific two places of a circumference of the mounting circumferential body 4253*a*, and each extended straight line can come into contact with the fan duct 850 to have a sharp shape. That is, the mounting circumferential guide portion 4253*b* can be the same as the flow inner circumferential guide portion 4231*e* described above.

A portion of the drum rear surface 220 can be constructed to correspond to the mounting portion 425. That is, the drum rear surface 220 can include a drum accommodating portion 223 that is recessed frontwards from an interior of the drum shielding portion 221. The drum accommodating portion 223 can accommodate the mounting accommodating portion 4251 therein and can be coupled with the driver M.

In some implementations, referring back to FIGS. 7 and 8, the driver M can include a motor 500 that provides power to rotate the drum 200. The motor 500 can include a stator 510 that generates a rotating magnetic field, and a rotor 520 that is rotated by the stator 510.

The rotor 520 can be in an outer rotor type that accommodates the stator 510 and rotates along a circumference of the stator 510. In this connection, a rotation shaft can be coupled to the rotor 520 and pass through the stator 510 and the mounting portion 425 to directly connect the rotor 520 to the drum 200. In this case, the rotor 520 can directly transmit the power to rotate the drum 200.

In some implementations, the rotor 520 can be rotated at a high RPM by the stator 510. For example, the rotor 520 can be rotated at an RPM much higher than an RPM at which the laundry inside the drum 200 can be rotated while being attached to an inner wall of the drum 200.

In some examples, when the laundry inside the drum 200 is rotated while being continuously attached to the inner wall of the drum 200, the drying efficiency can be reduced because a portion of the laundry attached to the inner wall of the drum is not exposed to the hot air.

When the rotor 520 is rotated at a low RPM to roll or agitate the laundry inside the drum 200 without attaching the laundry to the inner wall of the drum 200, an output or a torque that the driver M can generate may not be used properly.

Therefore, the driver M of the laundry treating apparatus can further include a reducer 600 capable of increasing the torque while utilizing a maximum output of the motor 500 by reducing the RPM.

The reducer 600 can be constructed to connect the motor 500 and the drum 200 to each other. The reducer 600 can rotate the drum 200 by converting the power of the motor 500. The reducer 600 can be disposed between the motor 500 and the drum 200, receive the power of the motor 500, convert the power, and transmit the converted power to the drum 200. The reducer 600 is constructed to convert the RPM of the rotor into a low RPM but increase the torque value, and transmit the converted RPM and the increased torque value to the drum 200.

Specifically, the reducer 600 can be coupled with a drive shaft 530 extending from the rotor 520 and rotating with the rotor 520. The reducer 600 includes therein a gearbox that can rotate in engagement with the drive shaft 530 and convert a RPM of the drive shaft 530 but increase a torque, and the gearbox is coupled to the drum rotating shaft 650 that is connected to the drum 200 to rotate the drum. Accordingly, when the drive shaft 530 rotates, the drum rotating shaft 650 can rotate at a lower RPM than the drive shaft 530, but can rotate with a greater torque than the drive shaft 530.

A performance of the reducer 600 depends on whether the drive shaft 530 and the drum rotating shaft 650 can remain coaxial. That is, when the drive shaft 530 and the drum rotating shaft 650 are misaligned with each other, there is a risk that coupling of parts constituting the gearbox inside the reducer 600 and at least one of the drive shaft 530 and the drum rotating shaft 650 can become loose or released. Therefore, the power of the drive shaft 530 may not be properly transmitted to the drum rotating shaft 650, or the drive shaft 530 can rotate in vain.

In addition, even when the drive shaft 530 and the drum rotating shaft 650 are temporarily misaligned with each other, the gearboxes inside the reducer 600 can be misaligned and collide with each other, causing vibration or noise.

In addition, even when a misaligned angle between the drive shaft 530 and the drum rotating shaft 650 temporarily becomes great, there is a risk of the gearbox inside the reducer 600 being completely out of position or being damaged.

As a result, even when the drive shaft 530 and the drum rotating shaft 650 temporarily fail to remain coaxial or parallel to each other, the performance of the reducer 600 may not be guaranteed, and the drum 200 may not be rotated as intended.

In some examples, laundry treating apparatuses having the reducer can fix the reducer and the motor to a support body that maintains an original state thereof without deformation even when an external force is generated.

For example, in a case of the washing machine, a scheme of primarily fixing the tub that accommodates the drum therein to the cabinet, and then, secondarily fixing the motor and the reducer to a bearing housing made of a rigid body embedded inside the tub with an injection molding scheme can be applied. In addition, a scheme of disposing a fixed steel plate coupled to the tub outside the tub and fixing the motor and the reducer to the fixed steel plate can be applied.

Thus, even when significant vibration occurs in the tub, the reducer and the driver can tilt or vibrate together with the bearing housing or the fixed steel plate. As a result, the reducer and the driver themselves can maintain the coupled state, and the drive shaft and the rotation shaft can be maintained coaxially.

However, because the laundry treating apparatus is formed as the dryer, the configuration of the tub fixed inside the cabinet is omitted. In addition, because a rear panel of the cabinet is formed as a relatively thin plate, even when the stator 510 is fixed, the rear panel can vibrate or be bent easily due to a repulsive force when the rotor 520 rotates or the drive shaft 530 rotates.

Even when the rear panel vibrates or is temporarily bent, the drum rotating shaft 650 and the drive shaft 530 that are disposed coupled to the drum 200 are bent, which may cause a problem that the drum rotating shaft 650 and the drive shaft 530 are misaligned with each other.

In addition, because the rear panel is formed as the thin steel plate, it may not be possible to support both the reducer 600 and the motor 500. For example, when the reducer 600 and the motor 500 are connected to the rear panel in parallel with each other, a rotation moment can occur by total lengths and self-weights of the reducer 600 and motor 500, causing the reducer 600 to sag downwards. As a result, the drum rotating shaft 650 itself coupled to the drum can be misaligned with the reducer 600, and may not be maintained coaxial with the drive shaft 530.

In some cases, the rear panel may not support the motor 500 itself. For example, the rear panel can have a problem that one surface thereof on which the motor 500 is installed is bent downwards by the self-weight of the motor 500. From the beginning, the rear panel may not be a suitable component for the motor 500 itself to be coupled.

In some implementations, it can be considered that the motor 500 is supported as the stator 510 is coupled to the rear plate 420. When the large amount of laundry is accommodated in the drum 200 or eccentricity occurs, whenever the drum 200 rotates, the drum rotating shaft 650 can be misaligned based on the disposition of the laundry. In this connection, because the stator 510 is separated from the drum 200 and fixed to the rear plate 420, the drum rotating shaft 650 can vibrate at an amplitude different from that of the stator 510 or tilt at an angle different from that of the stator 510. Therefore, the coaxiality of the drum rotating shaft 650 and the drive shaft 530 may not be maintained.

From another point of view, the drum 200 can be supported or installed on the front plate 410 and the rear plate 420 and an installation position of the drum 200 can be fixed at a certain level. Therefore, the position of the drum rotating shaft 650 coupled to the drum 200 can also be fixed at a certain level. Therefore, even when the vibration occurs in the drum 200, the vibration can be buffered in at least one of the front plate 410 and the rear plate 420.

However, when the vibration generated in the drum 200 is transmitted to the motor 500, even when the reducer 600 and the motor 500 are fixed to the rear plate 420, vibration amplitudes of the motor 500 and the rear plate 420 can be greater than that of the drum rotating shaft 650. Even in this case, there can be a problem that the drive shaft 530 and the drum rotating shaft 650 may not remain coaxial.

The laundry treating apparatus can couple the motor 500 to the reducer 600 to fix the motor 500. In other words, the reducer 600 itself can serve as a reference point for the entire driver M. In other words, the reducer 600 can serve as a reference for the vibration and the amount of inclination angle of the entire driver M.

Because the motor 500 is not fixed to other components of the laundry treating apparatus, but only to the reducer 600, when the vibration or the external force is transmitted to the driver M, the motor 500 can tilt or vibrate simultaneously with the reducer 600 when the reducer 600 tilts or vibrates.

As a result, the reducer 600 and the driver M can form one vibration system, and the reducer 600 and the driver M can be maintained in the fixed state without moving relative to each other.

The stator 510 of the driver M can be directly coupled to the reducer 600 and fixed. As a result, the position where the drive shaft 530 is installed may not be changed relative to the reducer 600. A center of the drive shaft 530 and a center of the reducer 600 can be positioned coincident with each other, and the drive shaft 530 can rotate while remaining coaxial with the center of the reducer 600.

The above-mentioned terms "coaxial" and "coincident" do not mean physically perfect coaxial and coincident states, but are concepts that allow a range of errors that can be accepted mechanically or a level that can be recognized as coaxial or coincident by those skilled in the art. For example, a range in which the drive shaft 530 and the drum rotating shaft 650 are misaligned with each other within 5 degrees can be defined as being coaxial or coincident.

Because the drive shaft 530 rotates relative to the reducer 600 but is fixed to be prevented from tilting, and the stator 510 is also fixed to the reducer 600, a distance between the stator 510 and the rotor 520 can be maintained. As a result, the collision between the stator 510 and the rotor 520 can be prevented, and the noise or the vibration that can occur due to a change of a rotation center resulted from the rotor 520 rotating the stator 510 can be fundamentally blocked.

The drum rotating shaft 650 can extend from the interior of the reducer 600 toward the drum 200, and can vibrate together with the reducer 600 and tilt with the reducer 600. That is, the drum rotating shaft 650 can merely be disposed to rotate in the reducer 600, and installation position thereof can be fixed. As a result, the drum rotating shaft 650 and the drive shaft 530 can be placed in parallel with each other and can be coaxial. In other words, the center of the drum rotating shaft 650 and the center of the drive shaft 530 can be maintained coincident with each other.

Referring to FIG. 3, the reducer 600 and the motor 500 can be designed to be disposed along a first axis S1 parallel to the ground when there is no load on the drum 200 or the motor 500 may not operate. The drive shaft 530 and the drum rotating shaft 650 can also be disposed in parallel with each other along the first axis S1.

However, when the drum 200 vibrates or the motor 500 vibrates, as the vibration is transmitted to the reducer 600 and the reducer 600 vibrates or tilts, the reducer 600 can be temporarily tilted with respect to a second axis S2.

In this connection, because the motor 500 is coupled to the reducer 600, the motor 500 can vibrate or tilt together with the reducer 600 to be disposed parallel to the second axis S2. Accordingly, the drive shaft 530 and the drum rotating shaft 650 can also be disposed in parallel with each other along the second axis S2.

As a result, even when the reducer 600 is tilted, the motor 500 can move integrally with the reducer 600, and the drive shaft 530 and the drum rotating shaft 650 can remain coaxial.

Therefore, because the drive shaft 530 and the drum rotating shaft 650 are tilted with respect to the reducer 600, the reducer 600 can serve as an action point of a lever or a seesaw. That is, the reducer 600 can serve as a first action point E1 of the vibration system including the motor 500. In some implementations, the reducer 600 is coupled to the drum 200 through the drum rotating shaft 650, and the drum 200 is spaced apart from the rear plate 420, so that the load on the drum 200 can be transferred to the reducer 600. In the reducer 600, the system including the drum 200 as well as the motor 500 can form one vibration system, and the reducer 600 can serve as a reference or an action point of the vibration system.

In some examples, the reducer 600 can be fixed or supported inside the cabinet 100, even though the reducer 600 itself serves as the center or the action point of the vibration system.

In some examples, the reducer 600 can be coupled to and fixed to the rear plate 420. In this case, because the reducer 600 will tilt or vibrate while being coupled to the rear plate 420, it can be seen that the rear plate 420 plays the role of the center of the vibration system including the reducer 600, the motor 500, and the drum 200. Even in this case, the motor 500 can be only coupled to and fixed to the reducer 600 without being directly coupled to the rear plate 420 even though the motor 500 may be in contact with the rear plate 420.

Specifically, the mounting portion 425 of the rear plate 420 can serve as the second action point E2 of the lever or the seesaw formed by the reducer 600, the motor 500, and the drum 200.

The reducer 600, the motor 500, and the drum 200 can be disposed in parallel with the first axis S1, and then, the reducer 600 can be disposed in parallel with a third axis S3. The third axis S3 can pass through the reducer 600 coupled to the rear plate 420. In this connection, because the reducer 600 and the motor 500 are coupled to each other, the motor 500 can also be disposed in parallel with the third axis S3.

After all, the motor 500 and the drum 200 are coupled to the reducer 600, so that the motor 500 and the drum 200 can tilt in parallel with each other with respect to the reducer 600 or simultaneously vibrate.

As described above, the reducer can be coupled to the rear plate, and the motor can be coupled to the reducer. That is, the coupling of the rear plate, the reducer, and the motor can directly transmit a driving force to the drum and can be variously set. Accordingly, the coupling of the rear plate, the reducer, and the motor can be as follows.

Figure 16A:
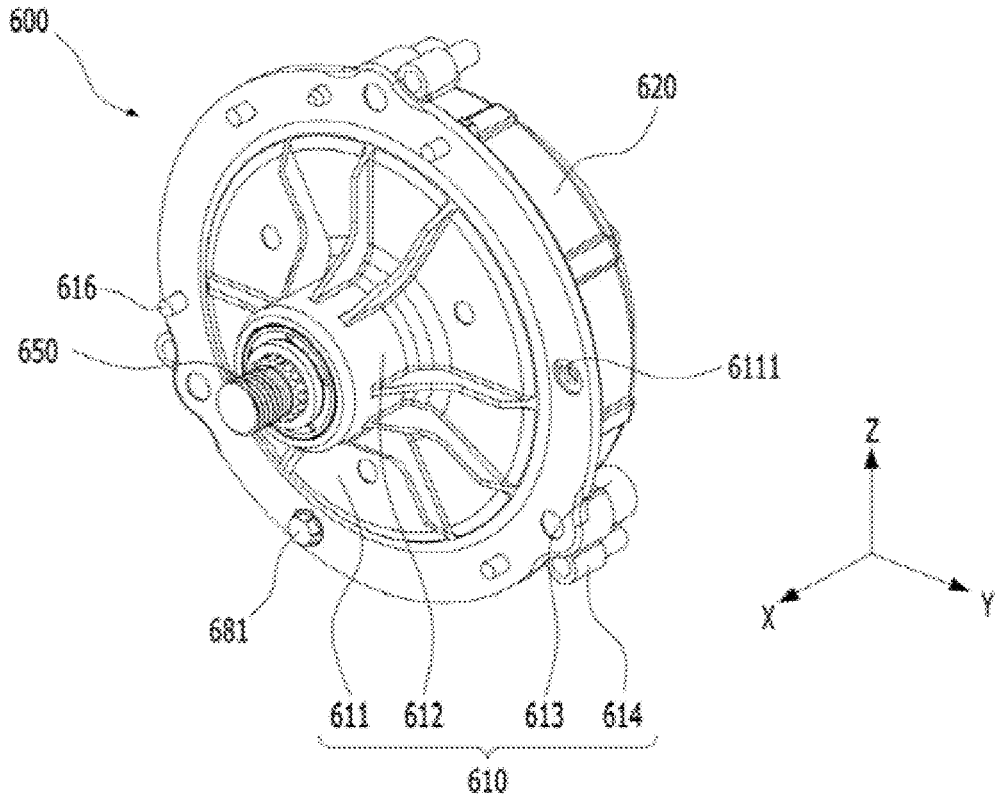
FIGS. 16A and 16B are perspective views showing an example of a reducer.
Figure 16B:
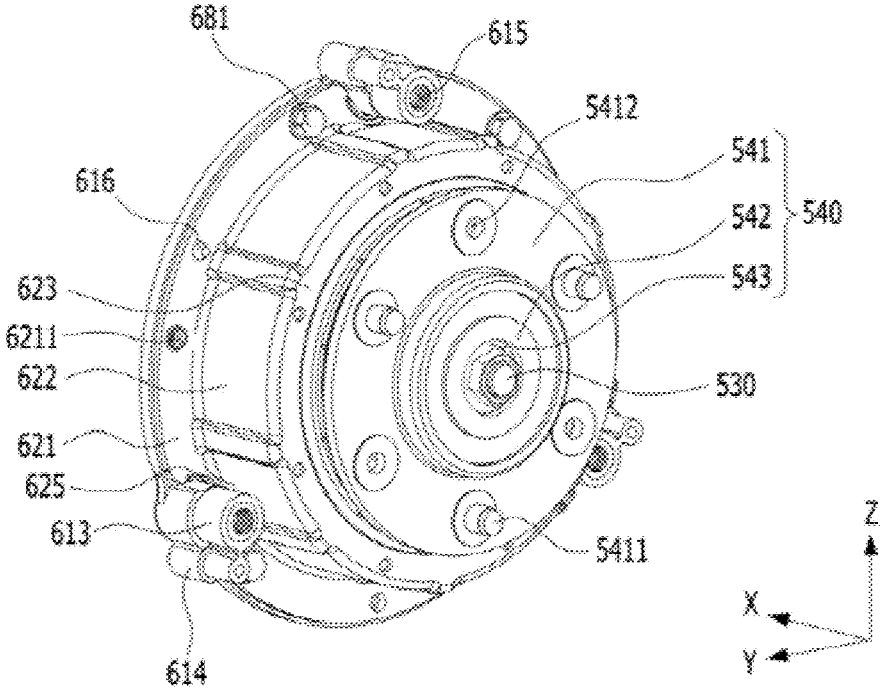
Figure 17A:
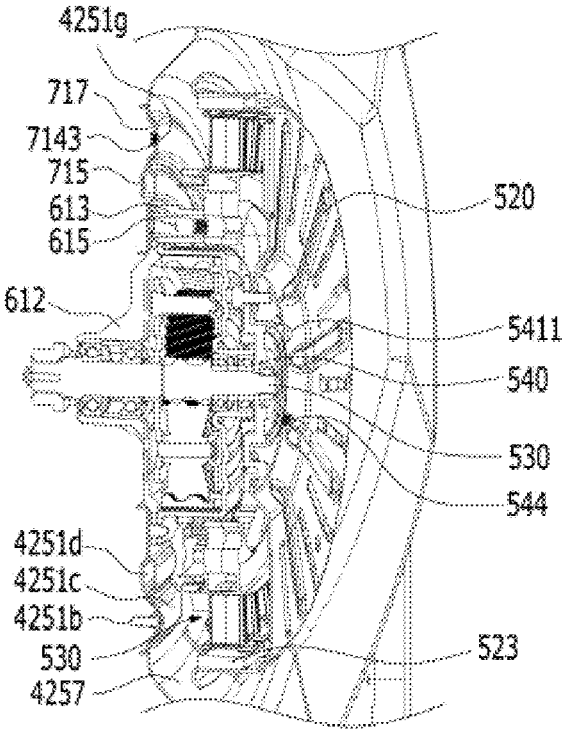
FIGS. 17A and 17B are cross-sectional views showing the reducer coupled to the rear plate.
Figure 17B:
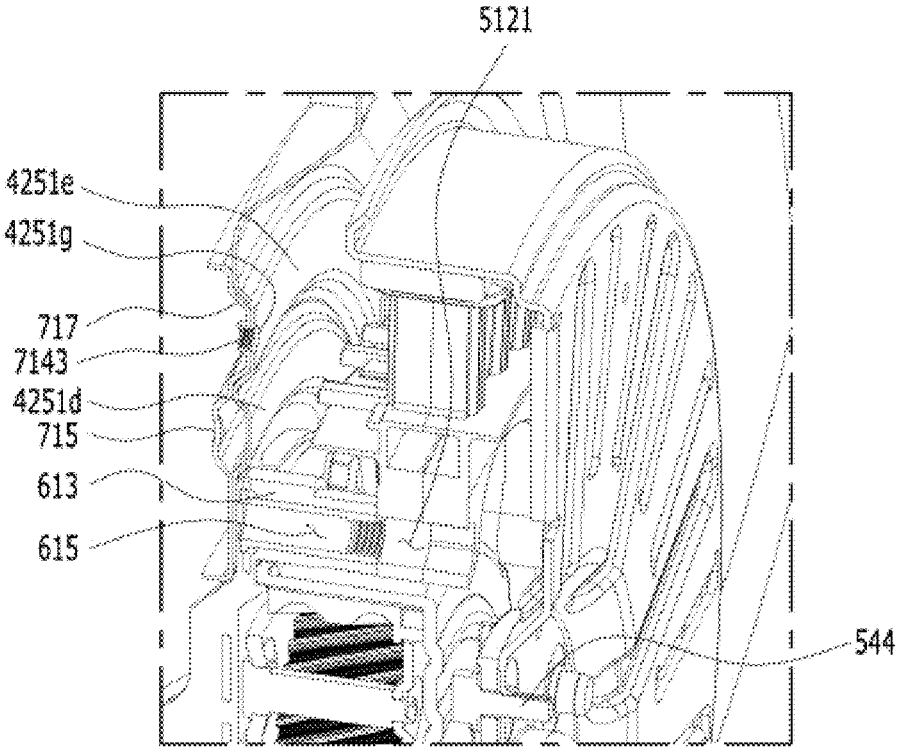

FIGS. 16A and 16B show perspective views of an example of a reducer. FIGS. 17A and 17B are cross-sectional views showing the reducer coupled to a rear plate.

Specifically, FIG. 16A shows one side of the reducer, and FIG. 16B shows the other side of the reducer.

Referring to FIGS. 6A and 6B, 16A and 16B, and 17A and 17B, the reducer 600 can include a first housing 610 that is coupled to the mounting surface 4251*a* from the rear. The first housing 610 can be formed in a circular plate shape. In addition, the first housing 610 can include a first housing shaft accommodating portion 612 protruding frontwards from a center thereof. The first housing shaft accommodating portion 612 can be inserted into the mounting hole 4255 to face the drum accommodating portion 223. In addition, the first housing shaft accommodating portion 612 can be coupled to the drum rotating shaft 650 as the drum rotating shaft 650 is accommodated thereinto. That is, the drum rotating shaft 650 can be coupled to the drum 200 through the drum accommodating portion 223, and the drum rotating shaft 650 can provide a rotation force to the drum 200.

In addition, the reducer 600 can include a second housing 620 coupled to the first housing 610 and having a sun gear 631, a planetary gear 632, a ring gear 633, and the like disposed therein. The second housing 620 can be coupled to the first housing 610 to shield the interior of the reducer 600.

Specifically, the first housing 610 can include a first housing blocking body 611 formed in a circular plate shape. In addition, the second housing 620 can include a second housing blocking body 622 formed in a hollow cylindrical shape. That is, the interior of the reducer 600 can be shielded by the first housing blocking body 611 and the second housing blocking body 622, so that the internal components of the sun gear 631, the planetary gear 632, the ring gear 633, and the like can be prevented from being exposed to the outside.

In addition, the second housing 620 can include a second housing coupling body 621 extending along a circumference of the second housing blocking body 622 to face the first housing 610. The second housing coupling body 621 can be formed in an annular shape to correspond to the first housing blocking body 611.

The first housing 610 can include a first housing fastening hole 6111 including a plurality of first housing fastening holes defined along a circumference of the first housing blocking body 611. The second housing coupling body 621 can include a second housing fastening hole 6211 defined at a position corresponding to the first housing fastening hole 6111. That is, the first housing 610 and the second housing 620 can be coupled to each other through a separate reducer fastening member 681. The reducer fastening member 681 can be coupled through the first housing fastening hole 6111 and the second housing fastening hole 6211 to fix the first housing 610 and the second housing 620.

In addition, the first housing 610 can be disposed inwardly of the first mounting support 4251*d*. Accordingly, the mounting surface 4251*a* can have a first rear fastening hole 4251*f* located inwardly of the first mounting support 4251*d* and penetrating the mounting surface 4251*a*. The first rear fastening hole 4251*f* can be defined at a position corresponding to the first housing fastening hole 6111 and the second housing fastening hole 6211. Accordingly, the reducer fastening member 681 can be coupled through the first rear fastening hole 4251*f* in addition to the first housing fastening hole 6111 and the second housing fastening hole 6211. That is, the reducer fastening member 681 can fix the first housing 610 to the second housing 620 and fix the reducer 600 to the rear plate 420.

In addition, the first housing 610 can include a coupling protrusion 616 protruding frontwards or rearwards. In addition, the second housing 620 can include a second housing accommodating hole 6213 defined therein at a position corresponding to the coupling protrusion 616 protruding rearwards. Furthermore, the mounting surface 4251*a* can further include a first rear accommodating hole 4251*h* at a position corresponding to the coupling protrusion 616 protruding frontwards.

The coupling protrusion 616 can be inserted into the second housing accommodating hole 6213 to support the coupling of the first housing 610 and the second housing 620. In addition, the coupling protrusion 616 can be inserted into the first rear accommodating hole 4251*h* to support the coupling of the first housing 610 and the rear plate 420.

In some implementations, the laundry treating apparatus can include a main bracket that supports the coupling of the reducer and the rear plate and increases structural safety.

Figure 18C:
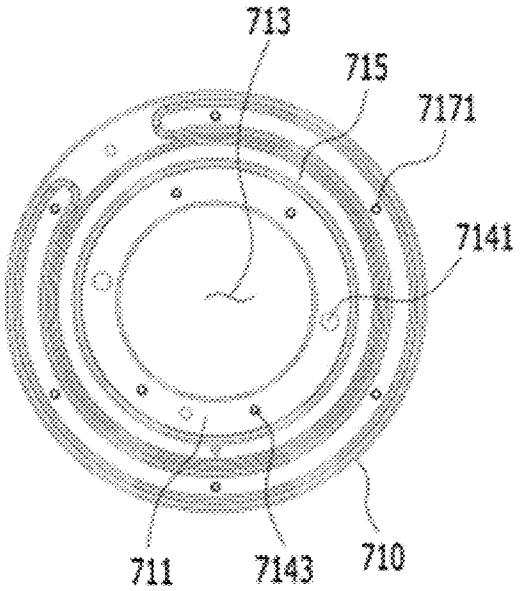
FIGS. 18A to 18C are views showing an example of a main bracket.
Figure 18B:
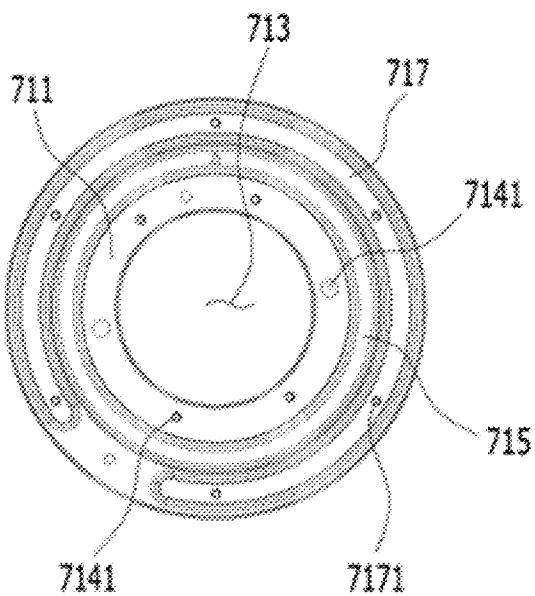
Figure 18A:
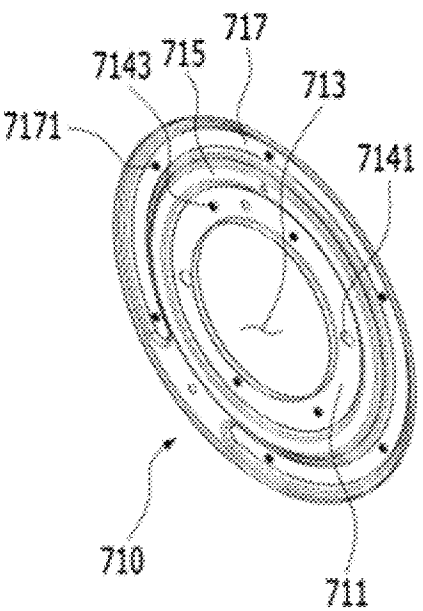
Figure 19:
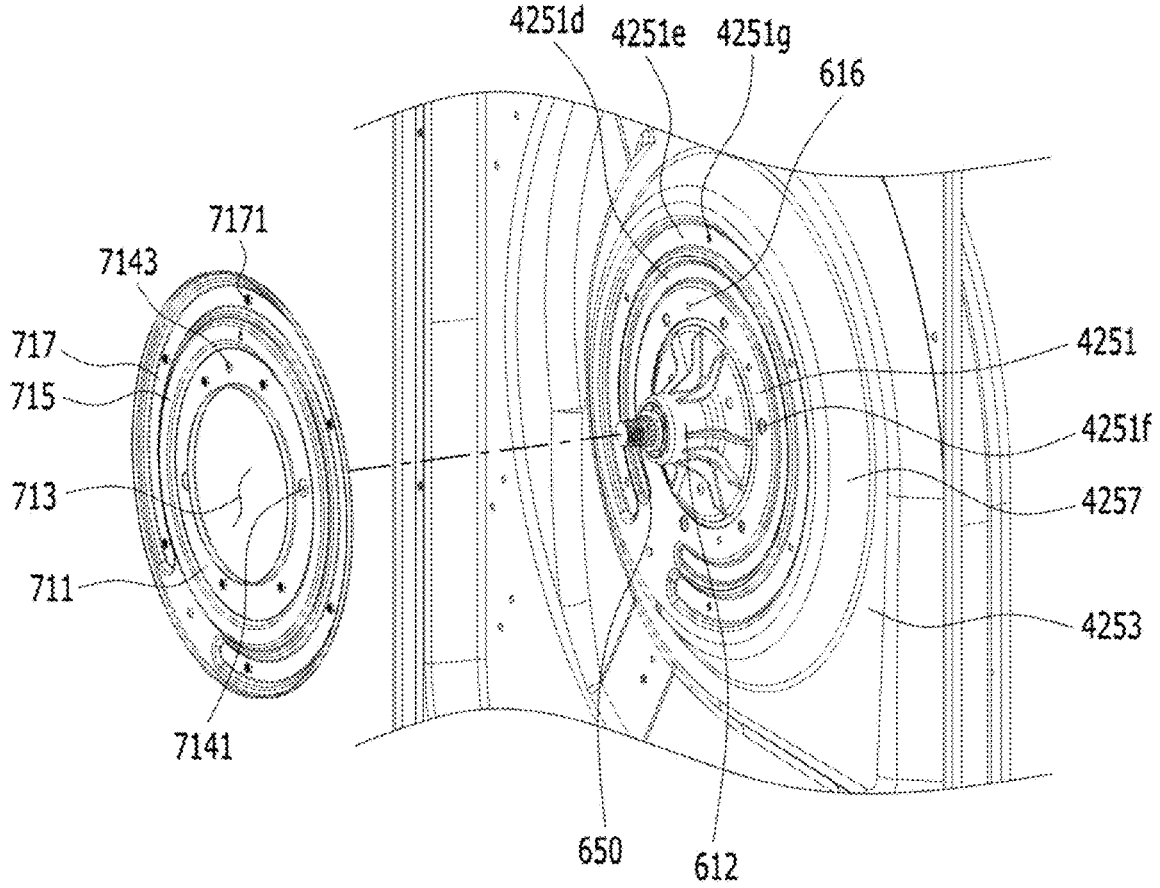
FIG. 19 is a view showing the main bracket separated from the rear plate.

FIGS. 18A to 18C are views showing an example of a main bracket. FIG. 19 is a view showing the main bracket separated from a rear plate.

Specifically, FIG. 18A is a perspective view of the main bracket, FIG. 18B is a front view of the main bracket, and FIG. 18C is a rear view of the main bracket.

Referring to FIGS. 18A to 18C and 19, the main bracket 710 can include a main body 711 formed in a circular plate shape. In addition, the main bracket 710 can include a central accommodating hole 713 defined through a center of the main body 711. The first housing shaft accommodating portion 612 and the drum rotating shaft 650 can pass through the central accommodating hole 713 to be connected to the drum accommodating portion 223.

The main bracket 710 can include a first installation rib 715 formed in a shape corresponding to the first mounting support 4251*d* and protruding frontwards from the main body 711. The first installation rib 715 can define a space from the front surface of the first mounting support 4251*d*. The first installation rib 715 and the first mounting support 4251*d* can receive strong vibration and shock compared to other components because the reducer 600 is coupled to and located inwardly of the first installation rib 715 and the first mounting support 4251*d*.

The main bracket 710 can effectively absorb the vibration and the shock as a predetermined space can be defined between the first installation rib 715 and the first mounting support 4251*d*, an air layer can be formed in the predetermined space, and the first installation rib 715 and the first mounting support 4251*d* can support each other.

In addition, the main bracket 710 can include a first bracket installation hole 7141 located inwardly of the first installation rib 715 and penetrating the main body 711. The first bracket installation hole 7141 can include a plurality of first bracket installation holes at positions corresponding to the first rear fastening holes 4251*f* Accordingly, the main bracket 710 can be fixed to the rear plate 420 and the reducer 600 through the reducer fastening member 681.

In addition, the main bracket 710 can include a first bracket accommodating hole 7143 defined at a position corresponding to the coupling protrusion 616. The coupling protrusion 616 can support the reducer 600, the rear plate 420, and the main bracket 710 through the first bracket accommodating hole 7143 and the first rear accommodating hole 4251*h*.

In addition, the main bracket 710 can include a second installation rib 717 formed in a shape corresponding to the second mounting support 4251*e* and protruding rearwards from the main body 711. The second installation rib 717 can be inserted into and coupled to the second mounting support 4251*e*.

In addition, the main bracket 710 can include a second bracket installation hole 7171 including a plurality of second bracket installation holes defined along a circumference of the second installation rib 717. The second mounting support 4251*e* can include a second rear fastening hole 4251*g* defined at a position corresponding to the second bracket installation hole 7171.

That is, the main bracket 710 can be coupled to the rear plate 420 through a separate bracket fastening member 4251*b*. The bracket fastening member 4251*b* can be coupled through the second bracket installation hole 7171 and the second rear fastening hole 4251*g* to fix the main bracket 710 and the rear plate 420.

Figure 20:
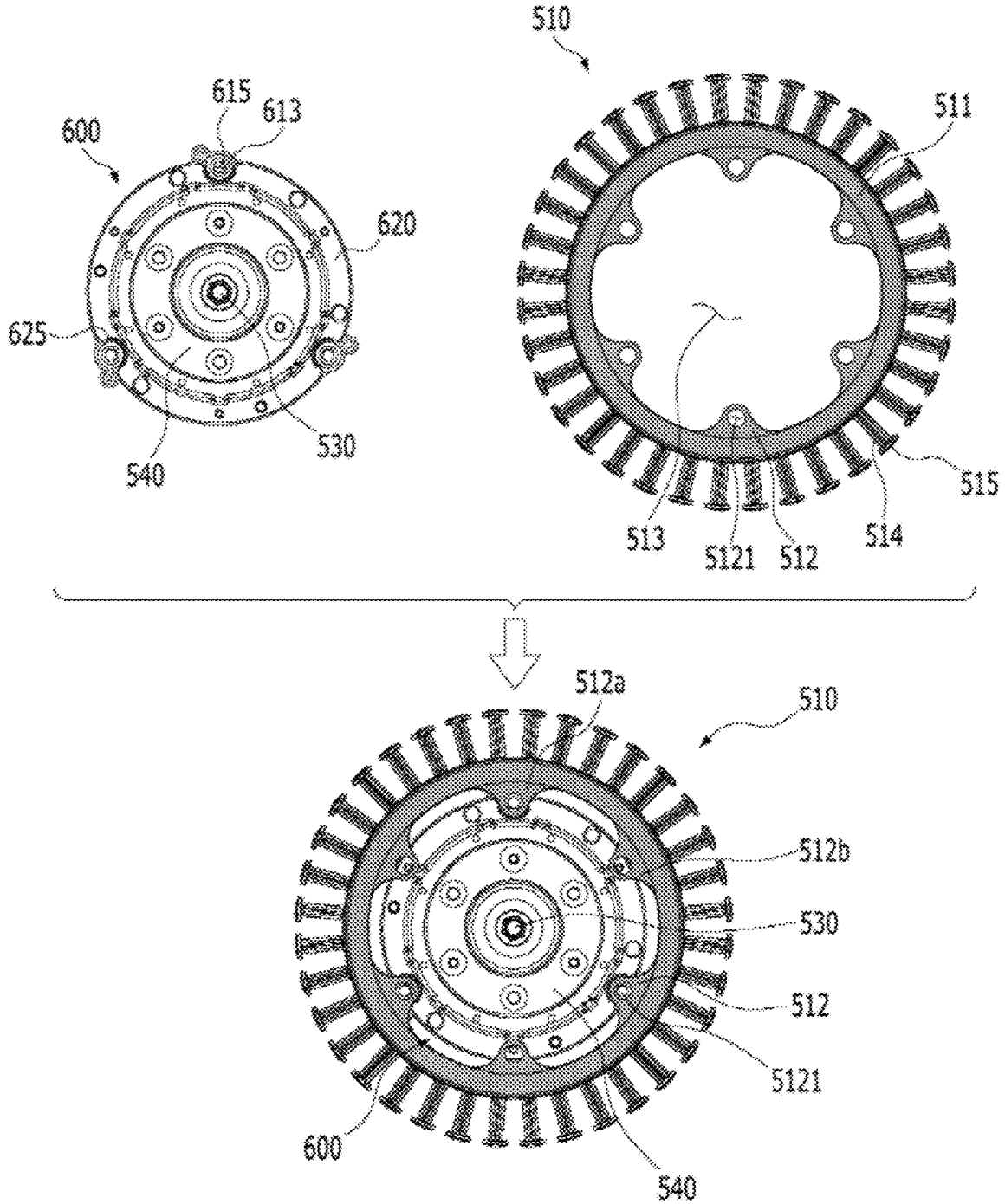
FIGS. 20 and 21 are views showing an example of a motor coupled to the reducer.
Figure 21:
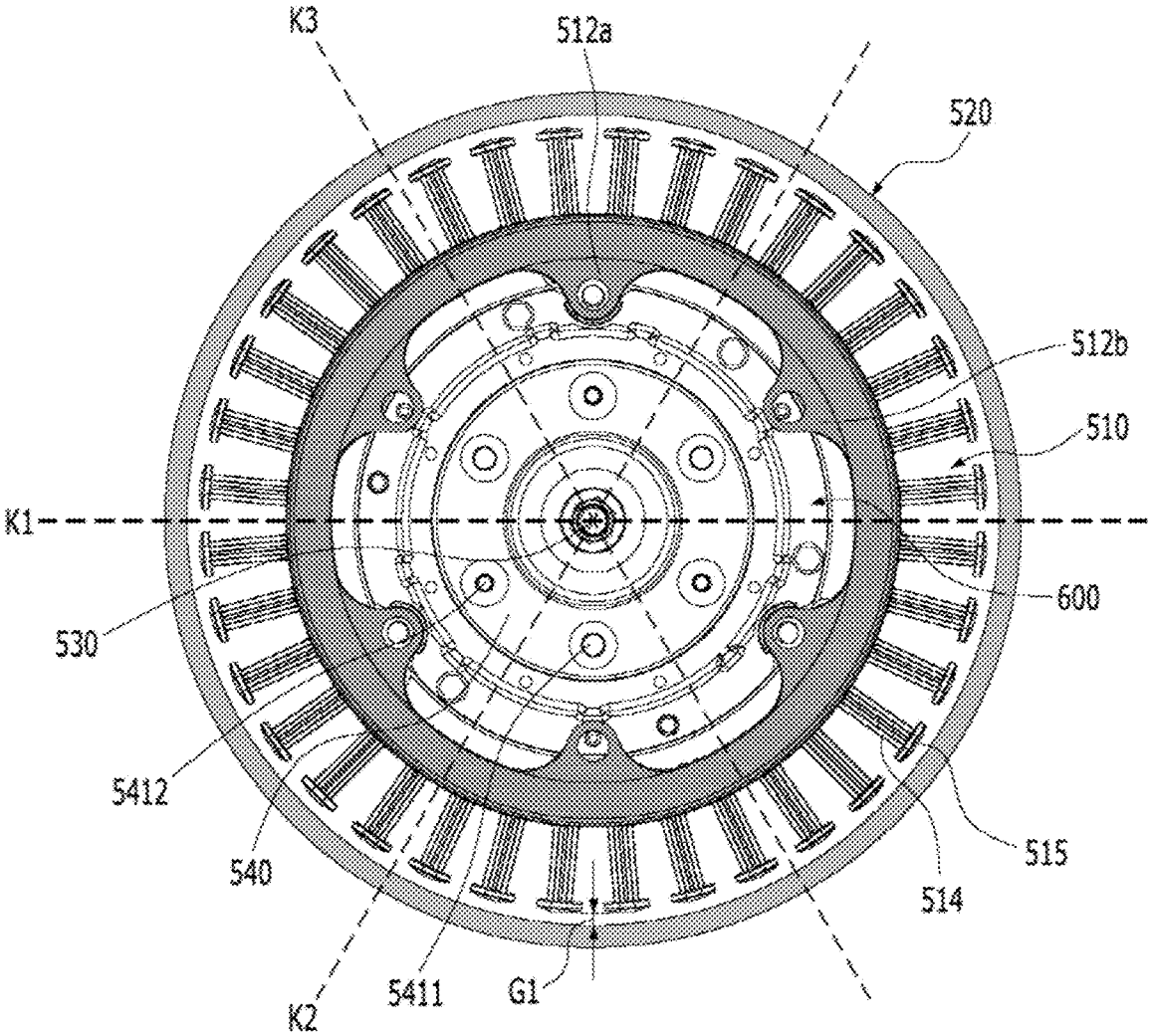

In some implementations, FIGS. 20 and 21 are views showing that a motor is coupled to a reducer. FIG. 22 is a view showing a motor separated from a reducer coupled to a rear plate.

The motor 500 can be coupled to the reducer 600 and can be prevented from being directly coupled to the rear plate 420.

Referring to FIGS. 20 to 22, specifically, the first housing 610 can include a stator coupling portion 613 protruding rearwards. The stator coupling portion 613 can have a stator fastening hole 615 defined therein. In addition, the second housing 620 can include a second housing cutout 625 recessed from an outer circumferential surface of the second housing 620 such that the stator coupling portion 613 can extend toward the stator 510. The second housing cutout 625 can be guided along the stator coupling portion 613 and can serve as a guide during the coupling of the first housing 610 and the second housing 620.

The stator 510 can include a main body 511 fixed to the reducer 600 and formed in an annular shape, a fixing rib 512 extending from an inner circumferential surface of the main body 511 and coupled to the stator coupling portion 613, teeth 514 extending from an outer circumferential surface of the stator 510 along a circumference of the main body 511 and to which a coil is wound, a pole shoe 515 disposed at a free end of each tooth 514 to prevent the coil from deviating, and a terminal 516 that controls to supply current to the coil.

The main body 511 can have an accommodation space 513 defined therein. The fixing rib 512 can include a plurality of fixing ribs spaced apart from each other at a certain angle with respect to the accommodation space 513 within the main body 511. At an inner portion of the fixing rib 512, a fixing rib hole 5121 in which a fixing member coupled to the stator coupling portion 613 is installed can be defined.

Because the stator 510 is directly coupled to the reducer 600, the reducer 600 can be at least partially accommodated in and coupled to the stator 510.

In particular, when the reducer 600 is accommodated in the stator 510, an overall thickness of the driver M can be reduced to further expand the volume of the drum 200. In addition, when the reducer 600 is accommodated in the stator 510, the drum rotating shaft 650 of the reducer 600 and the drive shaft 530 can be more precisely maintained coaxial.

In some examples, the reducer 600 can have a diameter smaller than a diameter of the main body 511. That is, the first housing 610 and the second housing 620 can have the largest diameter smaller than the diameter of the main body 511. Accordingly, at least a portion of the reducer 600 can be accommodated and disposed in the main body 511. However, the stator coupling portion 613 can extend to overlap the fixing rib 512 from a reducer housing. Accordingly, the stator coupling portion 613 can be coupled to the fixing rib 512 and portions of the first housing 610 and the second housing 620 can be located inside the main body 511.

The fixing rib 512 can include a first fixing rib 512*a* coupled directly to the stator coupling portion 613, and a second fixing rib 512*b* that is not directly coupled to the stator coupling portion 613 but can support the stator coupling portion 613 or the first housing 610.

The stator 510 can be coupled to the stator coupling portion 613, so that at least a portion of the reducer housing can be accommodated in the main body 511. Accordingly, the center of the main body 511, the center of the reducer 600, and the drive shaft 530 can be maintained to be coaxial.

In some implementations, the rotor 520 can be disposed to accommodate the stator 510 therein while being spaced apart from the pole shoe 515 by a certain distance. Because the rotor 520 is fixed to the reducer 600 where the drive shaft 530 is accommodated in the main body 511, a gap G1 between the rotor 520 and the stator 510 can be maintained.

Therefore, the rotor 520 and the stator 510 can be prevented from colliding or rotating while being temporarily twisted in the stator 510, preventing noise or vibration from occurring.

In some implementations, all of an imaginary first diameter line K1 passing through the center of the reducer 600 and the center of the drive shaft 530, an imaginary second diameter line K2 passing through the center of the main body 511, and an imaginary third diameter line K3 passing through the center of the rotor 520 can be disposed at the rotation center of the drive shaft 530.

As a result, the reducer 600 itself becomes the rotation center of the drive shaft 530, and the stator 510 is directly fixed to the reducer 600, so that the drive shaft 530 can be blocked from being twisted with respect to the reducer 600. As a result, reliability of the reducer 600 can be guaranteed.

In addition, the motor 500 can include a washer 540 to support the drive shaft 530. The washer 540 can include a washer coupling body 541 formed in a circular plate shape. The washer 540 can include an accommodating body 542 protruding rearwards from the washer coupling body 541. The washer 540 can include a drive shaft support hole 543 defined through a center of the accommodating body 542. The drive shaft 530 can be inserted into the drive shaft support hole 543 and supported by the washer 540.

The rotor 520 can include a rotor body 521 formed in a cylindrical hollow shape. The rotor 520 can also include an installation body 522 that is recessed frontwards from the center of the rotor body 521. The rotor 520 can have a permanent magnet 523 disposed along an inner circumferential surface of the rotor body 521. In addition, the washer 540 can include a washer coupling hole 5412 defined through the washer coupling body 541. In addition, the installation body 522 can include a rotor coupling hole 526 defined at a position corresponding to the washer coupling hole 5412. That is, the washer 540 and the rotor 520 can be coupled to each other as a washer coupling member 544 passes through the washer coupling hole 5412 and the rotor coupling hole 526. That is, the washer coupling member 544 can fix the washer 540 and the rotor 520.

In addition, the washer 540 can include a washer coupling protrusion 5411 protruding rearwards from the washer coupling body 541. In addition, the installation body 522 can include a washer protrusion accommodating hole 525 defined to correspond to the washer coupling protrusion 5411. The washer coupling protrusion 5411 can be inserted into the washer protrusion accommodating hole 525 to support the coupling of the washer 540 and the rotor 520.

In addition, the rotor 520 can include a rotor installation hole 524 defined through the center of the installation body 522. The rotor installation hole 524 can accommodate the accommodating body 542 therein. Accordingly, the washer 540 can be rotated with the drive shaft 530 by the rotor 520 and support the drive shaft 530.

Although representative implementations of the present disclosure have been described in detail above, those of ordinary skill in the technical field to which the present disclosure belongs will understand that various modifications are possible with respect to the above-described implementation without departing from the scope of the present disclosure. Therefore, the scope of the present disclosure should not be limited to the described implementation, and should be defined not only by the claims described below, but also by these claims and equivalents thereof.

What is claimed is:

1. A laundry treating apparatus comprising:

a cabinet comprising a bottom plate that defines a bottom surface of the cabinet;

a drum rotatably disposed inside the cabinet and configured to accommodate laundry therein;

a hot air supply disposed at the bottom plate and configured to generate hot air to be supplied into the drum;

a rear plate that defines a rear surface of the cabinet, the rear plate defining a duct configured to receive the hot air from the hot air supply and to guide the hot air into the drum;

a driver coupled to a rear side of the rear plate and configured to provide a rotational force to the drum; and a fan duct that is coupled to a front side of the rear plate and connects the hot air supply to the duct, the fan duct being configured to transfer the hot air of the hot air supply to the duct.

2. The laundry treating apparatus of claim 1, wherein the duct comprises:

a flow portion having an inner space that is recessed rearward from a front surface of the rear plate facing the drum and has an open front surface, the inner space of the flow portion being configured to receive the hot air from the fan duct and configured to guide the hot air to the drum through the open front surface; and an inflow portion that extends from the flow portion and is connected to the fan duct.

3. The laundry treating apparatus of claim 2, wherein the inflow portion has an open front surface and is recessed rearward from the front surface of the rear plate to thereby define a space that accommodates at least a portion of the fan duct, and wherein the inflow portion accommodates at least the portion of the fan duct and a rear end of the hot air supply.

4. The laundry treating apparatus of claim 3, wherein the hot air supply comprises a blower fan configured to flow the hot air along the fan duct and a blower fan driver configured to provide power to the blower fan, and wherein the inflow portion accommodates at least a portion of the blower fan driver.

5. The laundry treating apparatus of claim 3, wherein the flow portion comprises a flow outer circumferential portion that defines an outer circumferential surface of the inner space of the flow portion, and wherein at least a portion of the fan duct is accommodated inside the inflow portion and extends along a portion of the outer circumferential surface of the inner space of the flow portion.

6. The laundry treating apparatus of claim 5, wherein the fan duct comprises a fan duct body having a first end that is connected to the hot air supply and a second end that is at least partially accommodated inside the inflow portion, the second end extending along the outer circumferential surface of the inner space of the flow portion, and wherein the second end of the fan duct body is opened toward the flow portion and configured to discharge the hot air to the flow portion.

7. The laundry treating apparatus of claim 6, wherein the flow portion and the inflow portion of the duct are in fluid communication with each other, wherein the fan duct further comprises a fan duct shielding portion disposed at the second end of the fan duct body, the fan duct shielding portion being inserted into the inflow portion and dividing the flow portion and the inflow portion from each other, and wherein the fan duct shielding portion defines one continuous surface with the flow outer circumferential portion, the one continuous surface surrounding the inner space of the flow portion.

8. The laundry treating apparatus of claim 7, wherein the fan duct further comprises a fan duct coupling portion disposed at an end of the fan duct shielding portion and coupled to the rear plate, the fan duct coupling portion extending along a circumferential direction of the flow portion, and wherein the rear plate defines a fan duct accommodating portion that extends from the inflow portion along the circumferential direction of the flow portion and seats the fan duct coupling portion, the fan duct coupling portion being coupled to a front side of the fan duct accommodating portion.

9. The laundry treating apparatus of claim 8, further comprising a sealer disposed between the rear plate and the drum and configured to block leakage of the hot air, the sealer having an annular shape extending along an outer circumference of the flow portion, and wherein the fan duct further comprises a coupling guider that protrudes forward from the fan duct coupling portion and supports a portion of the sealer.

10. The laundry treating apparatus of claim 6, wherein the flow portion further comprises a flow inner circumferential portion that defines an inner circumference of the inner space of the flow portion, and wherein a portion of the flow inner circumferential portion protrudes toward the second end of the fan duct body is configured to guide the hot air from the fan duct body in a plurality of directions.

11. The laundry treating apparatus of claim 2, wherein the drum has a drum inlet that is defined at a rear surface of the drum facing the rear plate, the drum inlet being in fluid communication with the flow portion and configured to receive the hot air from the open front surface of the flow portion.

12. The laundry treating apparatus of claim 11, wherein the flow portion comprises a recessed surface that faces the drum inlet and is disposed rearward relative to the open front surface of the flow portion, and wherein the duct further comprises a flow guider that protrudes from the recessed surface toward the drum inlet and is configured to guide the hot air toward the drum inlet.

13. The laundry treating apparatus of claim 1, wherein the fan duct defines a bypass hole that passes through an outer surface of the fan duct and is configured to discharge a portion of the hot air from an inside of the fan duct to an outside of the fan duct.

14. The laundry treating apparatus of claim 13, wherein the fan duct comprises an opening adjusting portion configured to adjust an opening degree of the bypass hole.

15. The laundry treating apparatus of claim 14, further comprising a controller configured to control the opening adjusting portion to adjust the opening degree of the bypass hole based on an amount of the laundry accommodated inside the drum.

16. The laundry treating apparatus of claim 14, wherein the opening adjusting portion is configured to:

adjust the opening degree of the bypass hole to a first opening degree in a main drying process in which a moisture evaporation amount from the laundry is greater than or equal to a preset amount; and adjust the opening degree of the bypass hole to a second opening degree in an amount decreasing drying process that is configured to decrease the moisture evaporation amount from the laundry to be less than the preset amount, the first opening degree being greater than the second opening degree.

17. The laundry treating apparatus of claim 14, further comprising:

a temperature sensor disposed in the cabinet and configured to measure a temperature of the hot air discharged from the drum to the hot air supply; and a controller configured to, in a drying operation, control the opening adjusting portion to adjust the opening degree of the bypass hole, wherein the controller is configured to:

based on the temperature being less than a first reference temperature, determine that a current process is a preheating process of the drying operation in which a moisture evaporation amount from the laundry increases, and the opening degree of the bypass hole in the preheating process is a preheat opening degree, based on the temperature being greater than or equal to the first reference temperature and less than or equal to a second reference temperature, determine that the current process is a main drying process in which the moisture evaporation amount from the laundry is greater than or equal to a preset amount, based on determining that the current process is the main drying process of the drying operation, control the opening adjusting portion to increase the opening degree of the bypass hole to a first opening degree that is greater than the preheat opening degree, based on the temperature exceeding the second reference temperature, determine that the current process is an amount decreasing drying process of the drying operation that is configured to decrease the moisture evaporation amount from the laundry to be less than the preset amount, and based on determining that the current process is the amount decreasing drying process, control the opening adjusting portion to decrease the opening degree of the bypass hole to a second opening degree that is less than the first opening degree.

18. The laundry treating apparatus of claim 14, wherein the hot air supply comprises a blower fan configured to flow the hot air along the fan duct, and wherein the laundry treating apparatus further comprises a controller configured to control the hot air supply to reduce a rotation speed of the blower fan while the opening degree of the bypass hole is increased.

19. The laundry treating apparatus of claim 14, wherein the bypass hole comprises:

an open hole that remains open and is spaced apart from the opening adjusting portion; and an adjusted hole that is configured to be covered by the opening adjusting portion to thereby vary the opening degree.

20. The laundry treating apparatus of claim 14, wherein the opening adjusting portion comprises:

an opening and closing portion that is configured to open and close at least a portion of the bypass hole; and an opening degree adjusting driver connected to the opening and closing portion and configured to provide a driving force to the opening and closing portion, wherein the fan duct comprises an adjusting support that supports the opening degree adjusting driver and fixes the opening degree adjusting driver to the fan duct.

* * * * *